US010252562B2

(12) United States Patent
Holmes

(10) Patent No.: US 10,252,562 B2
(45) Date of Patent: Apr. 9, 2019

(54) SECURITY ELEMENTS AND METHODS OF THEIR MANUFACTURE

(71) Applicant: De La Rue International Limited, Basingstoke, Hampshire (GB)

(72) Inventor: Brian William Holmes, Fleet (GB)

(73) Assignee: DE LA RUE INTERNATIONAL LIMITED, Basingstoke, Hampshire (GB)

( * ) Notice: Subject to any disclaimer, the term of this patent is extended or adjusted under 35 U.S.C. 154(b) by 232 days.

(21) Appl. No.: 15/111,691

(22) PCT Filed: Jan. 15, 2015

(86) PCT No.: PCT/GB2015/050074
§ 371 (c)(1),
(2) Date: Jul. 14, 2016

(87) PCT Pub. No.: WO2015/107347
PCT Pub. Date: Jul. 23, 2015

(65) Prior Publication Data

US 2016/0339733 A1 Nov. 24, 2016

(30) Foreign Application Priority Data

Jan. 20, 2014 (GB) ..... 1400910.4

(51) Int. Cl.
*B42D 25/328* (2014.01)
*B42D 25/324* (2014.01)
(Continued)

(52) U.S. Cl.
CPC ..... *B42D 25/328* (2014.10); *B41M 3/14* (2013.01); *B41M 3/148* (2013.01);
(Continued)

(58) Field of Classification Search
CPC .. B42D 25/328; B42D 25/355; B42D 25/364; B42D 2033/26
See application file for complete search history.

(56) References Cited

U.S. PATENT DOCUMENTS 4,568,141 A * 2/1986 Antes ..... B42D 25/328 283/904
4,758,296 A 7/1988 McGrew
(Continued)

FOREIGN PATENT DOCUMENTS

DE 102008009296 A1 8/2009
EP 0 059 056 A1 9/1982
(Continued)

OTHER PUBLICATIONS

Jul. 1, 2015 International Search Report issued in International Patent Application No. PCT/GB2015/050074.
(Continued)

*Primary Examiner* — Kyle R Grabowski
(74) *Attorney, Agent, or Firm* — Oliff PLC

(57) ABSTRACT

A security element including substrate on which is disposed: in first area, a first optically variable device including a diffractive or reflective relief structure and reflection enhancing material following contours of relief structure; and, in second area, a second optically variable device including an iridescent amplitude interference material. First optically variable device is constituted by a plurality of sub-areas arranged in cyclically repeating sequence along predetermined direction of the security element, the plurality of sub-areas collectively forming first area. Relief parameters of diffractive or reflective relief structure vary from one sub-area to next within each repeat cycle whereby, at any viewing angle, each sub-area within any repeat cycle exhibits different diffractive color or reflected intensity from those of other sub-areas within same repeat cycle, so, when device
(Continued)

is tilted, different diffractive colors or reflected intensities appear to move from one sub-area to next within each repeat cycle along predetermined direction.

22 Claims, 23 Drawing Sheets

(51) Int. Cl.

| | |
|---|---|
| ***B42D 25/355*** | (2014.01) |
| ***B42D 25/364*** | (2014.01) |
| ***B42D 25/445*** | (2014.01) |
| ***B42D 25/378*** | (2014.01) |
| ***B41M 3/14*** | (2006.01) |
| ***B42D 25/369*** | (2014.01) |

(52) U.S. Cl.
CPC ..... *B42D 25/324* (2014.10); *B42D 25/355* (2014.10); *B42D 25/364* (2014.10); *B42D 25/369* (2014.10); *B42D 25/378* (2014.10); *B42D 25/445* (2014.10)

(56) References Cited

U.S. PATENT DOCUMENTS

| | | | | |
|---|---|---|---|---|
| 5,714,213 | A | 2/1998 | Antes et al. | |
| 7,884,983 | B2 * | 2/2011 | Funada | B44C 1/1704 283/93 |
| 2002/0030360 | A1 | 3/2002 | Herrmann et al. | |
| 2005/0151368 | A1 | 7/2005 | Heim | |
| 2006/0097511 | A1 * | 5/2006 | Keller | B42D 25/355 283/72 |
| 2007/0183045 | A1 | 8/2007 | Schilling et al. | |
| 2007/0211317 | A1 * | 9/2007 | Heim | B42D 25/346 359/2 |
| 2007/0273142 | A1 * | 11/2007 | Tompkin | B42D 25/00 283/72 |
| 2008/0122218 | A1 * | 5/2008 | Reid | G07D 7/12 283/83 |
| 2010/0045024 | A1 | 2/2010 | Attner et al. | |
| 2011/0007374 | A1 * | 1/2011 | Heim | B42D 25/364 359/2 |
| 2011/0012337 | A1 * | 1/2011 | Heim | B42D 25/328 283/94 |
| 2011/0069360 | A1 | 3/2011 | Dichtl et al. | |
| 2011/0079997 | A1 * | 4/2011 | Heim | B42D 25/328 283/85 |
| 2011/0095518 | A1 * | 4/2011 | Hoffmuller | B42D 25/45 283/85 |
| 2011/0127762 | A1 * | 6/2011 | Hoffmuller | B42D 25/355 283/72 |
| 2012/0156446 | A1 * | 6/2012 | Brehm | B42D 25/328 428/195.1 |
| 2012/0229368 | A1 * | 9/2012 | Watanabe | B42D 25/328 345/32 |

FOREIGN PATENT DOCUMENTS

| | | | | |
|---|---|---|---|---|
| EP | 407550 | A1 | 1/1991 | |
| EP | 0723501 | A1 | 7/1996 | |
| EP | 0724519 | A1 | 8/1996 | |
| EP | 1141480 | A1 | 10/2001 | |
| EP | 1 398 174 | A1 | 3/2004 | |
| EP | 1478520 | A1 | 11/2004 | |
| EP | 1497141 | A2 | 1/2005 | |
| EP | 1567714 | A1 | 8/2005 | |
| EP | 1770657 | A2 | 4/2007 | |
| EP | 2312345 | B1 * | 3/2016 | B42D 25/328 |
| GB | 2 387 812 | A | 10/2003 | |
| GB | 2 387 813 | A | 10/2003 | |
| GB | 2430648 | A | 4/2007 | |
| GB | 2452078 | A | 2/2009 | |
| GB | 2495629 | A | 4/2013 | |
| WO | 83/00659 | A1 | 3/1983 | |
| WO | 95/10419 | A1 | 4/1995 | |
| WO | 95/10420 | A1 | 4/1995 | |
| WO | 00/009391 | A1 | 2/2000 | |
| WO | 00/039391 | A1 | 7/2000 | |
| WO | 03/054297 | A2 | 7/2003 | |
| WO | 03/061980 | A1 | 7/2003 | |
| WO | 03/070482 | A1 | 8/2003 | |
| WO | 2009024265 | A1 | 2/2009 | |
| WO | 2009/053673 | A1 | 4/2009 | |
| WO | 2011/104551 | A1 | 9/2011 | |
| WO | 2012/176169 | A1 | 12/2012 | |
| WO | 2013163287 | A1 | 10/2013 | |

OTHER PUBLICATIONS

Jul. 1, 2015 Written Opinion issued in International Patent Application No. PCT/GB2015/050074.
Jul. 20, 2016 Search Report issued in British Patent Application No. 1601023.3.
Jul. 18, 2014 Search Report issued in British Patent Application No. 1400910.4.
Dec. 16, 2014 Search Report issued in British Patent Application No. 1400910.4.
Mar. 8, 2016 Examination Report issued in British Patent Application No. 1500623.2.
Jul. 1, 2015 Search Report issued in British Patent Application No. 1500623.2.

* cited by examiner

SECURITY ELEMENTS AND METHODS OF THEIR MANUFACTURE

The present invention relates to security elements suitable for use in determining the authenticity of security documents, such as banknotes, passports and the like, and other objects of value. Methods of manufacturing such security elements are also disclosed.

It is well known to provide security documents such as banknotes with security elements which exhibit optical effects which cannot be reproduced by standard means such as photocopying or scanning. Typical examples of such elements include holograms and other diffractive devices, which exhibit different appearances, e.g. diffractive colours and holographic replays, at different viewing angles. Similarly, reflective elements can be configured to display different intensities (i.e. brightnesses) at different viewing angles. Photocopies of such elements will not exhibit the same optically variable effects. The term "optically variable effect" means that the device has an appearance which is different at different viewing angles.

Another known class of optically variable security devices are so-called iridescent amplitude interference materials, which display different colours at different viewing angles. Examples include thin-film interference structures, interference pigments, pearlescent pigments, liquid crystal film and pigments, photonic crystals and the like. Thin film interference structures comprise repeating layers of different refractive indices; examples can include purely dielectric stacks (metal oxide or polymer) or those composed of alternate dielectric and metallic layers. Thin film interference structures are also known as Bragg stacks or 1D photonic crystals. What all of the above examples have in common is the provision of two or more closely spaced interfaces, at least one of which partially reflects and partially transmits incident light, i.e. the amplitude of the incident light is split. The transmitted portion is reflected at the second or subsequent interfaces and interferes with the portion reflected from the first or earlier interfaces, leading to constructive interference of some wavelengths and destructive interference of others, and hence a characteristic colour which varies with viewing angle.

There is a constant need to stay ahead of would-be counterfeiters by developing new security elements with an increased security level, i.e. which are more difficult to imitate. One approach is to combine two or more known security device types, which leads to a corresponding increase in the difficulty of forging a copy of the security element since the counterfeiter must be competent in more than one technology. An example of a security element which comprises both a metallic (optionally holographic) device and an interference device is disclosed in WO-A-03/061980. This represents an improvement over previous elements but is nonetheless prone to counterfeiting by a determined forger who may have access to examples of separate holographic and interference elements. By cutting and combining portions of the two elements it may be possible to create an assembly with a sufficiently similar appearance to that of the genuine element to pass inspection by the average man on the street.

It would be desirable to increase the security level of such elements still further.

A first aspect of the present invention provides a security element comprising a substrate on which is disposed:

in a first area, a first optically variable device comprising a diffractive or reflective relief structure and a reflection enhancing material following the contours of the relief structure; and in a second area, a second optically variable device comprising an iridescent amplitude interference material;

wherein the first optically variable device is constituted by a plurality of sub-areas arranged in a cyclically repeating sequence along a predetermined direction of the security element, the plurality of sub-areas collectively forming the first area, the relief parameters of the diffractive or reflective relief structure varying from one sub-area to the next within each repeat cycle whereby, at any one viewing angle, each sub-area within any one repeat cycle exhibits a different diffractive colour or reflected intensity from those of the other sub-areas within the same repeat cycle, and such that, when the device is tilted, the different diffractive colours or reflected intensities appear to move from one sub-area to the next within each repeat cycle along the predetermined direction.

As mentioned previously, "iridescent amplitude interference materials" are materials which exhibit a different colour appearance depending on the viewing angle as a result of constructive and/or destructive interference of certain wavelengths of light reflected at different interface structures defined by the material (typically referred to as a "colour shift" effect). Examples include thin-film interference structures, interference pigments, pearlescent pigments, liquid crystal pigments, photonic crystals and the like. The material may be present either in the form of a continuous layer, e.g. a thin film interference structure deposited across (a portion of) the element, or may be carried in a lacquer or other binder material, e.g. if the material is in the form of pigments or particles. It should be noted that the term "iridescent amplitude interference material" does not include volume holograms which, whilst their optical effect arises from amplitude interference, are not iridescent.

By combining an iridescent amplitude interference device with a cyclical reflective or diffractive device as defined above, the apparent integration of the two devices is enhanced. This is because, in practice, the iridescent amplitude interference device will appear anisotropic: when the security element is held in any one orientation in front of an observer, a change in colour of the iridescent amplitude interference material will be exhibited far more quickly (i.e. over relatively small tilt angles) when the element is tilted towards or away from the observer as compared with when the element is tilted in the perpendicular direction (i.e. "left/right") In the latter case, substantially no colour change will be exhibited at low tilt angles. This anisotropy is a result of the optical geometry: tilting the device forwards and backwards causes a rapid change in the angle between the user's eyes and the plane of the device, and hence the path length of the light through the interference structure, such that the point at which the wavelength preferentially reflected by the structure to the observer changes (i.e. the point of colour shift) is reached relatively quickly. In contrast, when the device is tilted left-right, the path length changes much more slowly and hence the switching point is not reached until the document has been tilted by a relatively large amount (which may be beyond typical tilt values reached during everyday handling). The above-described cyclical reflective or diffractive device is also anisotropic since as the element is tilted, the different diffractive colours or reflected intensities appear to move along the predetermined direction, which distinguishes this direction of the device from other directions.

As a result of combining two effectively anisotropic devices in this way, the two visual effects appear to be functionally linked to one another and can be designed to exhibit their respective effects when the element is tilted either together when the element is tilted in one direction, or separately when the device is tilted in two, known, different directions. Replicating this directional requirement relative to the fixed predetermined direction defined by the cyclical reflective or diffractive device significantly increases the difficulty of producing a counterfeit version of the element.

Additionally, whilst the iridescent amplitude interference material exhibits its colour shift effect more rapidly when the document is tilted front/back rather than left/right, this effect is still much slower (i.e. its rate of colour change with tilt angle is much lower, or equivalently its angular dispersion is greater) than in a diffractive device such as a hologram. For example, a typical thin film amplitude device will require tilting over a relatively large angle (e.g. at least 25 degrees) to exhibit a distinct colour change, whereas in a diffractive device, tilts of as little as 3 to 5 degrees will generate a distinct colour change. Also, a thin film amplitude device has rotational isotropy or invariance for rotations around the substrate normal (azimuthal angle rotation) whereas a diffractive device shows strong rotational variance or anisotropy. These different characteristics of the two devices provide the advantage that the security element as a whole will display an optically variable effect even from very low tilt angles (due to the diffractive device) which continues as tilting progresses and then exhibits a further, unexpected change at the point where the colour shift effect takes place. This change in colour remains as tilting proceeds, providing a different overall appearance to the element at higher tilt angles even as the same diffractive replay continues.

Preferably, the first and/or second area comprising the first or second optically variable device respectively is elongate and extends along the predetermined direction of the security element. Most preferably both of the areas are elongate. This further improves the visual integration of the two elements since the two areas appear similar in extent. Also, this arrangement guides the observer to tilt the element along the long direction of the two devices. The predetermined direction need not be parallel to any specific direction defined by the security element: for example, the element could be elongate and the predetermined direction could make some non-zero angle with the long axis of the element such that the optical effect appears to follow a line tilted relative to the axis. However, preferably the security element itself is also elongate in the predetermined direction, the predetermined direction being the long axial direction of the element. For example, the security element may be a thread or strip.

It should be noted that whilst in preferred embodiments the predetermined direction will be the same along the full length of the security element (i.e. the same for the whole of the first area), this is not essential. For example, in different sections of the first area, the predetermined direction along which the different diffractive colours or reflected intensities appear to move could be different from one another. This can be achieved by arranging the sub-areas according to a different geometrical layout in each section and/or by changing their order, e.g. reversing the sequence in which the relief parameters change. In especially preferred embodiments, the different sections of the first area may be configured such that the different diffracted colours or reflected intensities will appear to move along the same predetermined direction, but the sense of movement along this direction could be opposite in different sections. For example, the sub-areas could be arranged so that when the device is tilted in a certain direction, one section (e.g. one or more cyclical repeats) will exhibit movement in the positive axial direction whilst simultaneously another section (e.g. a different one or more cyclical repeats) of the pattern on the security device will exhibit movement in the negative axial direction (i.e. parallel but in the opposite sense).

The reflective or diffractive device can be configured in a number of different ways. In one particularly preferred example, the first optically variable device is configured such that, when the device is tiled in the direction parallel to the predetermined direction, the different diffractive colours or reflected intensities appear to move from one sub-area to the next within each repeat cycle along the predetermined direction. This is advantageous since the optically variable effects of both devices will then be exhibited together when the device is tilted in the predetermined direction (i.e. about an axis perpendicular to the predetermined direction).

Where the first optically variable device comprises a diffractive relief structure (preferably a diffraction grating), this can be achieved for example by arranging the relief structure to have a pitch (i.e. a periodic repeating distance) which varies from one sub-area to the next, the pitch within each sub-area preferably lying in the range 0.5 microns to 10 microns, preferably 0.5 microns to 3 microns, still preferably 0.5 microns to 1.5 microns, most preferably 0.7 microns to 1.2 microns. Relief pitches within about 0.5 to 1.5 microns have been found to give particularly good colour dispersion although though diffraction gratings of much larger pitch can be recorded—for example 3 microns or more—although at such values the dispersion is relatively weak and the gratings diffract light close to the specular direction, in which case changes in orientation from one sub-area to the next may be preferred to deliver the optical variance (see below). At the lower end of the range, the pitch is preferably no less than the wavelength of light so as to avoid the diffracted light being evanescent. Due to the pitch variation, each sub-area therefore exhibits a diffraction spectrum with a different angular spread, such that at any one viewing angle a different part of the spectrum from each sub-area (i.e. different colour) is directed to the viewer. As the device is tilted parallel to the predetermined direction, the portion of each spectrum which the viewer sees changes, which appears as if each colour is moving from one sub-area to the next.

Alternatively, where the first optically variable device comprises a reflective relief structure made up of an array of reflective facets, a similar effect can be achieved by arranging the angle between the facets and the plane of the device to vary from one sub-area to the next. In this way the intensity of the light reflected to the viewer will be different for each sub-region and as the device is tilted in the predetermined direction, different ones of the sub-areas will become optimised to reflect light to the viewer most brightly. Again this results in bright/dark regions of the device appearing to move along the predetermined direction.

In other preferred embodiments, the first optically variable device may be configured such that, when the device is tilted in the direction perpendicular to the predetermined direction, the different diffractive colours or reflected intensities appear to move from one sub-area to the next within each repeat cycle along the predetermined direction. In such examples, the optically variable effect of the iridescent amplitude interference material would be observed alone when the device is tilted along the predetermined direction, with the diffractive or reflective device remaining static, and vice versa when the device is tilted along the perpendicular direction. Whilst only one optically variable effect will be displayed at a time, the counterintuitive nature of the device gives rise to a strong visual impression and hence security level.

Where the first optically variable device comprises a diffractive relief structure (preferably a diffraction grating), this can be achieved by arranging the orientation of the relief structure in the plane of the device to vary from one sub-area to the next. This has the result that the direction in which the different colours of the diffraction spectrum are spread out is different from one sub-area to the next such that a different colour is directed to the viewer from each area. When the device is tilted in the direction perpendicular to the axis, the portion of each diffraction spectrum seen by the viewer changes and the colours thus appear to move along the predetermined direction (i.e. perpendicular to the direction of tilt).

Alternatively, where the first optically variable device comprises a reflective relief structure having an array of reflective facets, a similar effect can be achieved by arranging the orientation of the facets in the plane of the device vary to vary from one sub-area to the next. This has the result that bright and dark regions of the device will appear to move along the predetermined direction when the device is tilted perpendicularly.

In the above examples, the cyclical diffractive or reflective effect is exhibited upon tilting either along the predetermined direction or perpendicular to that direction. However in still further preferred embodiments, the relief device can be configured to require tilting along both those directions in order to reveal the effect: for example, tilting along a direction lying between the predetermined direction and its perpendicular may elicit the optical effect. This can be achieved by varying both the relief pitch (or facet angle) and the orientation of the relief from one sub-area to the next. This also has the effect of enhancing the visual discrimination between sub-areas, making the motion effect appear sharper.

The theory behind this is as follows. For light to enter the eye from a particular diffractive element or grating, then the light must have satisfied the diffraction equation—consider first the sub-areas to have the same relief orientation but different pitches and also the simplest case where the illuminating light is a monochromatic directional point source (a laser in extremis). For a given light source location, each sub-area will replay light into the observer's eye at one angle of tilt, thus as we tilt the device we will see the sub-areas successively switch on and off. More particularly, since there will be a jump in pitch value from one sub-area to the next, there will be an angular separation between the respective light rays diffracted by each sub-area—this creates angular gaps where, as we tilt, there will be a transition between sub-areas where no light is diffracted, which serve to emphasise the animation. If we now also add in some change in orientation of the relief structure between sub-areas, this will further widen the angular separation such that we not only have to tilt the device vertically (front/back) but also left to right to redirect light into the observer's eye. Suppose now we make our light source polychromatic (e.g. white), then for a given incidence/viewing geometry, for each sub-area there will be a wavelength which satisfies the diffraction condition. Thus we will see the sequence of sub-areas exhibit a sequence of colours (the rainbow spectrum in a preferred design). As before, by adding variation in orientation between sub-areas we can change the replay characteristics such that left to right tilting is also required to "switch on" successive sub-areas. This is desirable since in practice the white light source will typically not be a point source but may be extended in an axis parallel to the plane of reflection, in which case a band of colours can be diffracted into the eye by each sub-area. However, a band of colour means less colour saturation and thus less discrimination between adjacent sub-areas and a tendency for them all to be visible simultaneously thus reducing the effectiveness of the colour and/or spatial animation effect. As such there is benefit in introducing some azimuthal orientation to restore the angle gap and thus discrimination between sub-areas.

The sub-areas can be arranged to take various different shapes which may or may not be the same as one another. For example, in preferred embodiments, each sub-area has the form of a line, band, geometrical shape, symbol or alphanumeric character. For instance where (at least some of) the sub-areas adjoin one another to form a continuous area such as a line, the sub-areas may each constitute a portion, e.g. a band or stripe, of that line. Alternatively the sub-areas may be spaced from one another and could each take the form of a symbol or character, such as a series of letters or numbers (e.g. "A, B, C, D . . . ") or many repeats of one symbol or number (e.g. "5, 5, 5, 5. . . "). A plurality of adjoining sub-areas may also collectively form a geometrical shape, symbol or alphanumeric character. Where at least some of the sub-areas abut one another along the predetermined direction, the boundary between one sub-area and the next preferably lies substantially perpendicular to the predetermined direction so that the apparent motion from one sub-area to the next is always in the predetermined direction.

In some preferred embodiments, the sub-areas are each of substantially the same size and shape. This may be the case for example where each sub-area is a band or stripe forming part of a continuous area such as a line or character. This may be desirable since the apparent speed of motion will be uniform along the element. In alternative embodiments, the size and/or shape of the sub-areas may vary cyclically along the predetermined direction, preferably with the same cycle repeat length as that of the relief parameters of the diffractive or reflective relief structure. This echoes the cyclic nature of the reflective or diffractive relief itself and thus further enhances the visual impression.

In preferred examples, each sub-area has a length along the predetermined direction of between 0.5 and 5 mm, preferably between 1 and 2 mm. The larger the sub-areas, the slower the apparent motion along the predetermined direction so the exact dimensions will be selected according to the desired effect. However dimensions of this sort have been found to be suitable. Similarly the number of sub-areas and overall cycle repeat length can be selected as appropriate for the application in question, but in preferred examples, the cycle repeat length of the relief parameters is between 5 and 20 mm, preferably between 5 and 10 mm. Dimensions of this sort correspond to typical sizes of windows for viewing security threads and the like embedded in banknotes and hence at least one full cycle repeat can be made visible within each window.

Preferably, the security device (e.g. thread) may be incorporated into a security document such as paper in a controlled registered manner (e.g. as is known from EP1567714) such that a known number of sub-areas or cycle repeats repeats appear in each window. Optionally the registration may be such that different aesthetic repeats (for example movement in different senses along the predetermined direction) could be present in adjacent windows.

The visual effect will also depend on the number of sub-areas making up each repeat cycle of the relief parameters. The greater the number of sub-areas, the smoother the perceived motion will appear to be. In preferred examples, the number of sub-areas making up each repeat cycle is at least three, more preferably at least five.

The two devices could be formed entirely separately from one another on the element. However, in preferred implementations, the diffractive or reflective relief structure is disposed in both the first and second areas of the element, and is substantially concealed in the second area of the element by an overlying light absorbing material layer. This enables accurate registration to be achieved between the two areas and hence between the two visual effects. Similarly it is preferred that the iridescent amplitude interference material is disposed in both the first and second areas of the element, and is substantially concealed in the first area of the element by light diffracted or reflected from the diffractive or reflective relief structure. The reflection enhancing layer may be present in both areas and if so will similarly be concealed by the light absorbing material layer in the first area. The reflection enhancing layer could be continuous between the first and second areas but most preferably it is absent between the first and second areas to provide a clear separation between the two devices.

A second aspect of the present invention provides a security element comprising a substrate on which is disposed, in at least a region of the security element:

- a diffractive or reflective relief structure present at least in first partial areas of the region;
- a reflection enhancing material present at least in the first partial areas of the region and being disposed on and following the contours of the diffractive or reflective relief structure;
- a light absorbing material provided in second partial areas of the region which do not overlap the first partial areas;
- the first partial areas being arranged between the second partial areas such that a half-tone or screened pattern is formed by the reflection enhancing material and the light absorbing material in combination and is exhibited across the region; and
- a non-opaque layer of iridescent amplitude interference material at least over the second partial areas of light absorbing material;
- wherein, in the areas of the light absorbing material, the visual effect of the iridescent amplitude interference material is visible, and in the intervening areas where the reflection enhancing material and the diffractive or reflective relief structure are present, the visual effect of the diffractive or reflective relief structure is visible, such that the two visual effects appear superimposed on one another across the region.

In the first partial areas of the region, the diffractive or reflective relief effect is rendered visible by the reflection enhancing material in combination with the relief structure. By "following the contours of the relief" it is meant that the reflection enhancing material conforms to the vertical profile of the relief, i.e. out of the plane of the device.

The term "iridescent amplitude interference material" is as already defined above, exhibiting for example a colour-shift effect upon tilting. The light absorbing material may comprise for example a black or other dark-coloured material such as an ink and renders the overlying iridescent amplitude interference material visible in the second partial areas of the region by absorbing stray light other than that reflected by the material which would otherwise overwhelm and conceal the optically variable effect. However, it should be noted that the light absorbing material need not absorb at all (UV and visible) wavelengths, and also need not absorb 100% of those wavelengths it does absorb, as discussed further below.

By arranging the first and second partial areas in accordance with a half-tone or screened pattern, the visual effect of the iridescent amplitude interference material and that of the diffractive or reflective device are superimposed on one another, i.e. both are visible across the same region of the element with one appearing as a background to the other. This significantly increases the visual integration between the two devices and makes counterfeiting through the use of separate interference and diffractive/reflective devices extremely hard if not impossible, since to imitate the result it would be necessary to cut and accurately interweave a multitude of tiny fragments of two devices with each other.

By a half tone or screen pattern, it is meant an array of pattern elements, e.g. lines, dots, geometric shapes, symbols or alphanumeric characters, etc., which may be provided by the partial areas of light absorbing material or the partial areas of reflection enhancing material, or defined by gaps in either material (i.e. the elements may be positive or negative). Preferably the array of pattern elements is regular in terms of arrangement and pitch, e.g. with the pattern elements arranged on an orthogonal or hexagonal grid. The dimensions of the pattern elements and array are generally such that at least from a normal viewing distance (e.g. 20 cm or more), the individual pattern elements are not distinguishable to the unaided eye and instead the region appears either uniform or, if the density of the half-tone or screen pattern varies across the region, as an image or other effect arising from the density variation. The term "pattern density" refers to the proportion of the surface area which exhibits each visual effect: here, 0% pattern density corresponds to the proportion of the surface area exhibiting the iridescent amplitude interference being zero (equivalent to 100% exhibiting the diffractive/reflective effect), and 100% the opposite.

Thus, in some preferred embodiments, the half-tone or screen pattern varies in pattern density across the region, the variation preferably comprising one or more stepwise transitions between different pattern densities, or a gradual transition in pattern density.

In at least a first part of the region, the light absorbing material will be provided at a pattern density of less than 100%, the pattern density preferably being between 5 and 85%, more preferably between 10 and 60%, still preferably between 20 and 25%. As discussed above the density may vary within this part of the region. In some preferred embodiments, the light absorbing material is provided at a pattern density of substantially 100% in a second part of the region. Here, assuming the iridescent amplitude interference material is present over the part, its effect will dominate as discussed above. In a third part of the region the light absorbing material may be provided at a pattern density of substantially 0% in which case only the diffractive or reflective device will be visible. In particularly preferred embodiments the first part of the region will be located between the first and second parts and arranged such that the change in density from 100% to 0% is gradual over the region.

In some cases the variation in pattern density may give simply rise to the appearance of a gradient between the two effects. However in other preferred examples, the half-tone or screen pattern varies in pattern density in a more complex manner so as to define indicia, such as an image, symbol, logo and/or alphanumerical character(s). "Dark" portions of the image may for example be represented by a higher pattern density of light absorbing material, and "light" portions by a lower pattern density.

Depending on the desired visual effect, the pattern elements could be sized so as to be indistinguishable by the observer, giving rise to a smooth, high resolution effect, or a more "pixelated" appearance may be desired. Hence in some preferred embodiments, the elements of the half-tone or screen pattern are dimensioned so as not to be individually perceived by the naked eye, the elements preferably having dimensions in the range 50 to 100 microns. In other preferred embodiments, the elements of the half-tone or screen pattern are dimensioned so as to be individually perceivable, the elements preferably having dimensions in the range 0.25 to 1 mm, more preferably around 0.5 mm.

The construction of the security element can take various different forms to achieve the above result. In a first preferred implementation, the reflection enhancing material is provided across the whole of the region (i.e. not only in the first partial areas, but also in the second partial areas and any gap there between), and the light absorbing material is disposed over the reflection enhancing material in the second partial areas. Assuming that the diffractive or reflective relief structure extends at least over all of the region outside the second partial areas, this ensures that the diffractive/reflective effect is provided as a continuous background to the iridescent amplitude interference effect, with no gaps between the two. This arrangement is preferred where the reflection enhancing material is provided in the form of a deposited metal layer, for example such as may be applied by vacuum deposition. Typically such deposition mechanisms lead to a coating of the whole exposed surface, and if only selective coverage is desired, a second step of removing the material from any areas in which it is not to be present must be employed, such as etching. In the present embodiment, the reflection enhancing layer is concealed in the second partial areas (where it is not to be viewed) by the light absorbing layer such that no removal step is essential (although may be employed to achieve decorative demetallisation if desired).

Preferably, this embodiment further comprises a transparent material disposed over the reflection enhancing material at least in the first partial areas where the light absorbing material is not present. The transparent material preferably acts as a resist material to prevent the removal of the reflection enhancing material from the first partial areas during any such etching step as mentioned above. Additionally or alternative the transparent material may carry a colourant or other substance which modifies the appearance of the diffractive or reflective device through the material as discussed further below.

The transparent material could be provided only in the first partial areas with the light absorbing material being disposed on the reflection enhancing material in the second partial areas (and optionally also acting as a resist). Alternatively the transparent material may be provided across the whole of the region and, in the second partial areas where the light absorbing material is present, either the transparent material is disposed between the light absorbing material and the reflection enhancing material or the light absorbing material is disposed between the transparent material and the reflection enhancing material. Since the light absorbing material will be visible through the transparent material, the same result will be achieved. These latter options minimise the registration demands on the manufacturing process since the first partial areas are in effect defined by the application of the light absorbing material to the second partial areas, i.e. in one and the same step.

In a second preferred embodiment, the reflection enhancing material is only provided in the first partial areas. This may be advantageous where the reflection enhancing material is laid down by a selective application technique such as printing, as may be the case for a metallic ink for example. In such embodiments, preferably the first partial areas substantially fill the intervening areas between the second partial areas, in which case the finished appearance will be substantially the same as in the first embodiment mentioned above. However this is not essential and it may be desirable to leave gaps between the first and second partial areas, e.g. if a semi-transparent appearance is desired.

The non-opaque layer of iridescent amplitude interference material need only be applied to the areas in which it is to be visible, i.e. those in which the light absorbing material is provided, and this may be the case where the material is applied by a selective method such as printing. However, the iridescent amplitude interference material can also be disposed over both the second partial areas of the light absorbing material and the intervening areas. This is because in the intervening areas where the light absorbing material is absent, the visual effect of the iridescent amplitude interference material will be overwhelmed by reflected light from other layers of the security element and will effectively not be visible. This is particularly the case where the iridescent amplitude interference material is located over the first partial areas where the diffracted or reflected light from the relief structure will conceal the presence of the iridescent amplitude interference material. In particularly preferred embodiments, the non-opaque layer of iridescent amplitude interference material is disposed over the whole region. This minimises the registration requirements for the application of the iridescent amplitude interference material.

The diffractive or reflective relief structure need only be present in those areas of the security element where the diffractive/reflective effect is ultimately to be visible, i.e. the first partial areas. This can be achieved through appropriate configuration of an embossing tool used to form the relief structure across the region, or by selective application of an embossing lacquer where a cast-cure technique is used. In such cases, application of the reflection enhancing layer and light absorbing material will need to be registered to the applied relief. In more preferred embodiments, the diffractive or reflective relief structure is configured to extend across the whole region, in which case no registration between it and the subsequently applied materials is essential (though may still be desirable). The optical effect of the relief structure will only be rendered visible where the reflection enhancing material is applied and is not concealed by light absorbing material.

It should be noted that in the second aspect of the invention, the diffractive or reflective relief structure can be of any type and can exhibit any desired visual effect. For example, the structure may be a hologram or kinegram with any desired replay image, or could be a diffraction grating or series of reflective facets. However in particularly preferred examples, a diffractive or reflective relief structure as utilised in the first aspect of the invention is provided in order to additionally achieve the benefits already described with reference to the first aspect. Hence, preferably, the diffractive or reflective relief structure extends across an area of the security element and is constituted by a plurality of sub-areas arranged in a cyclically repeating sequence along an predetermined direction of the security element, the plurality of sub-areas collectively forming the area, the relief parameters of the diffractive or reflective relief structure varying from one sub-area to the next within each repeat cycle whereby, at any one viewing angle, each sub-area within any one repeat cycle exhibits a different diffractive colour or reflected intensity from those of the other sub-areas within the same repeat cycle, and such that, when the device is tilted, the different diffractive colours or reflected intensities appear to move from one sub-area to the next within each repeat cycle along the predetermined direction.

The second aspect of the invention also provides a method of manufacturing a security element, comprising:

- forming a diffractive or reflective relief structure at least in first partial areas of a region of the security element;
- applying a reflection enhancing material at least in the first partial areas of the region, onto and following the contours of the diffractive or reflective relief structure;
- applying a light absorbing material in second partial areas of the region which do not overlap the first partial areas;
- the first partial areas being arranged between the second partial areas such that a half-tone or screened pattern is formed by the reflection enhancing material and the light absorbing material in combination and is exhibited across the region; and
- applying a non-opaque layer of iridescent amplitude interference material at least over the second partial areas of light absorbing material;
- whereby in the areas of the light absorbing material, the visual effect of the iridescent amplitude interference material is visible, and in the intervening areas where the reflection enhancing material is present, the visual effect of the diffractive or reflective relief structure is visible, such that the two visual effects appear superimposed on one another across the region.

The resulting security elements provides strong visual integration between the two effects and hence a high security level as already discussed. It should be noted that the reflection enhancing material and the light absorbing material do not need to be applied in the same order as recited but could be applied in the reverse order or simultaneously.

As mentioned above, the security element can be constructed using various different techniques. In one preferred implementation, the reflection enhancing material is applied across the whole of the region (i.e. not only in the first partial areas) and the light absorbing material is applied over the reflection enhancing material in the second partial areas, such that the reflection enhancing material appears as a continuous background to the light absorbing material. This is preferred for example where the reflection enhancing material is initially applied using a non-selective process such as vacuum deposition. Preferably the method further comprises applying a transparent material over the reflection enhancing material at least in the first partial areas where the light absorbing material is not applied. The transparent material can act as a resist, protecting the reflection enhancing material during a subsequent process such as etching and/or could be used to modify the appearance of the diffractive/reflective device. The transparent material need only be applied over the first partial areas, in which case it is preferably applied in register with the light absorbing material so as to accurately define the half-tone or screened pattern, but in particularly preferred embodiments the transparent material is applied over the reflection enhancing material across the whole of the region either before or after application of the light absorbing material in the second partial areas. In this case the registration requirements between the transparent material and the light-absorbing material effectively negated since the application of the light absorbing material defines the first and second partial areas in a single step (the first partial areas being those areas not covered by light absorbing material).

As mentioned above the reflection enhancing layer may continue across any spaces between the first and second partial areas (i.e. between the diffractive/reflective device areas and the interference device areas), but in preferred embodiments the method further comprises removing any area of the reflection enhancing layer which is not covered by either the transparent material or the light absorbent material. In this way spaces can be provided between the different visual effects, which demonstrate high registration achieved between the devices and hence further increases the security level, and also results in a semi-transparent device. For example this may be achieved by etching, in which case at least one or both of the transparent and light absorbing materials are preferably resist materials such that they protect the underlying reflection enhancing material from the etchant. It is not vital for both materials to be resists: for example, a transparent resist could be applied across the whole region to protect the reflection enhancing material and then covered by a light absorbing material (e.g. ink) according to the half-tone or screen pattern to create the aforementioned visual effect.

In alternative implementations, the reflection enhancing material is only applied in the first partial areas, as may be the case where the reflection enhancing material is applied by a selective process such as printing, or if a demetallisation process is performed prior to the application of the light absorbing material.

Preferably, the first partial areas substantially fill the intervening areas between the second partial areas. In the second partial areas, the light absorbing material is preferably applied to the same surface as that carrying the reflection enhancing material in the first partial areas, which may be the relief structure itself if it continues into the second partial areas.

As mentioned previously, the iridescent amplitude interference material need only be provided in the second partial areas, where it is to be visible, but preferably is applied over both the second partial areas of the light absorbing material and the intervening areas. Most preferably, the non-opaque layer of iridescent amplitude interference material is applied over the whole region.

Similarly, the diffractive or reflective relief structure need only be provided in the first partial areas but preferably is configured to extend across the whole region.

The method can be adapted to manufacture a security element having any of the features discussed above.

A third aspect of the present invention provides a security element comprising a substrate on which is disposed, in at least a region of the security element:

- a diffractive or reflective relief structure present at least in first partial areas of the region in accordance with a first pattern;
- a reflection enhancing material provided in the first partial areas of the region in accordance with the first pattern, disposed on and following the contours of the diffractive or reflective relief structure;
- a light absorbing material provided in second partial areas of the region in accordance with a second pattern;
- one or both of the first and second patterns comprising a plurality of discrete pattern elements; and a non-opaque layer of iridescent amplitude interference material at least over the second partial areas of the light absorbing material;

wherein the first and second patterns are in register with one another and each switches repeatedly from one side to the other of a straight line defining an axis of the security element along the same portion of the line in an alternating manner with the other pattern, whereby in the areas of the reflection enhancing layer defined by the first pattern, the visual effect of the diffractive or reflective relief structure is visible, and in the areas of the light absorbing material defined by the second pattern, the visual effect of the non-opaque iridescent amplitude interference material is visible, such that the two visual effects are exhibited on opposite sides of the straight line at any one location and alternate with one another along the axis of the security element.

Again, in the first partial areas of the region, the diffractive or reflective relief effect is rendered visible by the reflection enhancing material in combination with the relief structure. By "following the contours of the relief" it is meant that the reflection enhancing material conforms to the vertical profile of the relief, i.e. out of the plane of the device.

The term "iridescent amplitude interference material" is as already defined above, exhibiting for example a colour-shift effect upon tilting. The light absorbing material may comprise for example a black or other dark-coloured material such as an ink and renders the overlying iridescent amplitude interference material visible in the second partial areas of the region by absorbing stray light other than that reflected by the material which would otherwise overwhelm and conceal the optically variable effect. However, it should be noted that the light absorbing material need not absorb at all (UV and visible) wavelengths, and also need not absorb 100% of those wavelengths it does absorb, as discussed further below.

By arranging the first and second patterns to alternate on either side of a straight line, the visual integration of the two optically variable effects is increased due to the interlocking appearance of the patterns. In addition, the difficulty in imitating the element through the use of separate diffraction/reflection and interference devices is significantly enhanced since the desired appearance cannot be achieve by placing two complete devices alongside one another. Rather, portions of each device would need to be cut out and accurately positioned on both sides of the straight axial line and this will act as a significant deterrent. The security element is preferably elongate (e.g. a security thread or strip) and, most advantageously, the straight axis is preferably parallel to the long axis of the element.

The first and second patterns are defined by pattern elements each of which is defined by one or more of the respective first or second partial areas. At least one of the patterns will comprise multiple discrete pattern elements, in order to form the interlocking arrangement described above but the other may if desired comprise a single pattern element which crosses from one side of the axis to the other. If both patterns are formed of discrete pattern elements, all of the pattern elements could be spaced away from the straight axis itself, but in preferred embodiments at least one of the first and second patterns, preferably both, comprises at least one pattern element which crosses over the axis. For example one or both of the patterns could comprise one or more portions of a sinusoidal line, "square wave" line or "zig-zag" line.

The elements of the first pattern could abut those of the second pattern. However in particularly preferred embodiments the first and second patterns are configured to exhibit gaps between pattern elements of the first pattern and pattern elements of the second pattern of less than 1 mm, more preferably less than 0.5 mm. It will be appreciated that it is not necessary to provide such gaps between all pair of elements and typically there may be larger gaps present in the combined pattern in addition and/or instances where there is no gap between two elements. However, by providing at least some gaps between elements of the different patterns of this scale, high registration accuracy between the different optical devices is demonstrated and hence demanded of counterfeiters.

As already mentioned, in some embodiments, both patterns may comprise multiple pattern elements, but in other implementations, the first or second pattern could comprise one continuous pattern element extending along the axial direction and crossing from one side of the axis to the other, preferably at multiple locations. In this case the other pattern may comprise multiple separate elements arranged on either side of the continuous pattern element so as to give the visual impression that the other pattern is also a continuous element located under the first. Alternatively the impression of two interlocking continuous elements can be created by forming both patterns of multiple pattern elements arranged to appear as if one is passing over the other alternately along the device.

In preferred embodiments, the first and second patterns are substantially mirror images of one another about the axis. This further increases the visual integration of the two devices since the overall impression is of one single element. In addition this can be used to demonstrate the register between the two patterns, since one can readily be compared to the other. In further preferred embodiments, the first and second patterns are substantially the same, the first pattern being translated along the axis relative to the second pattern. For instance, each pattern may have the appearance of a sinusoidal wave, the two waves being translated such that they appear out of phase with one another, preferably by half a wavelength. Advantageously, the first and/or second patterns repeat periodically along the axis.

The security element can be constructed in various different ways. In a first preferred embodiment, the reflection enhancing material is additionally disposed in the second partial areas of the region defined by the second pattern, the light absorbing material being disposed on the reflection enhancing material. This is preferred where the reflection enhancing material is initially applied across the whole region and is then selectively removed. However in other embodiments the reflection enhancing material may be applied selectively, e.g. only in the first partial areas, and the light absorbing material can be applied adjacent it, onto the same supporting surface. For example, if the diffractive or reflective relief structure is additionally provided in the second partial areas of the region defined by the second pattern, the light absorbing material may be disposed on the diffractive or reflective relief structure.

In some preferred examples, the security element further comprises a transparent material disposed over the reflection enhancing material in accordance with the first pattern. This may act as a resist material should regions of the reflection enhancing material be subject to removal, e.g. by etching, and/or could carry a colourant or similar to modify the appearance of the diffractive/reflective device.

As in the second aspect of the invention, the non-opaque layer of iridescent amplitude interference material need only be provided in the second partial areas of the region but may be disposed over both the first partial areas of the reflection enhancing material and the second partial areas of the light absorbing material since in the first partial areas its effect will be overwhelmed by light reflected from other layers of the security element. Most preferably, the non-opaque layer of iridescent amplitude interference material is disposed over the whole region.

Similarly the diffractive or reflective relief structure need only be provided in the first partial areas but preferably is configured to extend across the whole region.

It should be noted that in the third aspect of the invention, the diffractive or reflective relief structure can be of any type and can exhibit any desired visual effect. For example, the structure may be a hologram or kinegram with any desired replay image, or could be a diffraction grating or series of reflective facets. However in particularly preferred examples, a diffractive or reflective relief structure as utilised in the first aspect of the invention is provided in order to additionally achieve the benefits already described with reference to the first aspect. Hence, preferably, wherein the diffractive or reflective relief structure extends across an area of the security element and is constituted by a plurality of sub-areas arranged in a cyclically repeating sequence along a predetermined direction of the security element (preferably the straight axis), the plurality of sub-areas collectively forming the area, the relief parameters of the diffractive or reflective relief structure varying from one sub-area to the next within each repeat cycle whereby, at any one viewing angle, each sub-area within any one repeat cycle exhibits a different diffractive colour or reflected intensity from those of the other sub-areas within the same repeat cycle, and such that, when the device is tilted, the different diffractive colours or reflected intensities appear to move from one sub-area to the next within each repeat cycle along the predetermined direction.

The third aspect of the invention further provides a method of manufacturing a security element, comprising:

- forming a diffractive or reflective relief structure at least in first partial areas of a region of the security element in accordance with a first pattern;
- applying a reflection enhancing material in the first partial areas of the region in accordance with the first pattern, onto and following the contours of the diffractive or reflective relief structure;
- applying a light absorbing material in second partial areas of the region in accordance with a second pattern;
- one or both of the first and second patterns comprising a plurality of discrete pattern elements; and
- applying a non-opaque layer of iridescent amplitude interference material at least over the second partial areas of the light absorbing material;
- wherein the first and second patterns are in register with one another and each switches repeatedly from one side to the other of a straight line defining an axis of the security element along the same portion of the line in an alternating manner with the other pattern, whereby in the areas of the reflection enhancing layer defined by the first pattern, the visual effect of the diffractive or reflective relief structure is visible, and in the areas of the light absorbing material defined by the second pattern, the visual effect of the non-opaque iridescent amplitude interference material is visible, such that the two visual effects are exhibited on opposite sides of the straight line at any one location and alternate with one another along the axis of the security element.

The resulting security element provides strong visual integration between the two effects and hence a high security level as already discussed.

It should be noted in particular that the step of applying the reflection enhancing material to the first partial areas can be implemented by initially applying the reflection enhancing material to all or part of the region (without patterning), if desired, and subsequently removing the material to leave it present at least in the first partial areas corresponding to the first pattern, e.g. by etching. In this case, the reflection enhancing material may also remain in the second partial regions corresponding to the second pattern, under the light absorbing material. Thus the light absorbing material may be applied onto the reflection enhancing layer.

Alternatively, if the reflection enhancing material is only applied in the first partial areas, e.g. by a selective application process such as printing, the light absorbent material may be applied alongside the reflection enhancing material to the same support surface. For example, if the diffractive or reflective relief structure is additionally formed in the second partial areas of the region defined by the second pattern, the light absorbing material may be applied onto the diffractive or reflective relief structure.

In preferred embodiments the method further comprises applying a transparent material over the reflection enhancing material in accordance with the first pattern. The transparent material can be used as a resist during a subsequent etch procedure and/or to modify the appearance of the diffractive/reflective device.

Preferably the method further comprises removing any area of the reflection enhancing material which is not covered by either the transparent material or the light absorbing material. For example this may be achieved by etching, in which case at least one or both of the transparent and light absorbing materials are preferably resist materials such that they protect the underlying reflection enhancing material from the etchant. It is not vital for both materials to be resists: for example, a transparent resist could be applied across the first and second patterns to protect the reflection enhancing material and then covered by a light absorbing material (e.g. ink) according to the second pattern only to create the aforementioned visual effect. In this way spaces can be provided between the different visual effects, which demonstrate the high registration required between the devices and hence further increases the security level.

The method can be adapted to manufacture a security element having any of the features discussed above.

The following preferred features can be applied to the first, second or third aspects of the invention unless otherwise specified:

Preferably, the security element further comprises one or more substantially transparent regions in which the reflection enhancing layer and light absorbing material are absent, the substantially transparent regions preferably defining a decorative pattern or negative indicia such as alphanumeric characters, symbols or logos. For example the transparent regions may form writing or other indicia which is visible in transmission when the element is held against a backlight. The transparent regions may be bounded by either or both of the two aforementioned optically variable effects.

The reflection enhancing layer may be contiguous or in other preferred embodiments, it may be arranged in accordance with a screened or half-tone pattern, or may be semi-transparent (e.g. having a thickness of 35 nm or less, in the case of a semi-transparent metal layer). This can be utilised to introduce further information to the element, e.g. by varying the density of the screen or half-tone, optionally so as to define an image or similar, or can be used to render the device semi-transparent so that it can be applied over printed information, for example, without entirely concealing it. This may also be desirable where the element is to be displayed in a window region of a document.

Advantageously the reflection enhancing material comprises a metal or metal alloy (e.g. aluminium, copper, chrome, etc.), a material comprising reflective particles, preferably metallic particles, or a material having a different refractive index from that in which the relief structure is formed (so-called "high refractive index" or "HRI" materials, e.g. ZnS).

In particularly preferred examples, the reflection enhancing material is electrically conductive (preferably metal) and includes at least one continuous path from one end to the other of the security element, at least a portion of the continuous path preferably being concealed by the iridescent amplitude interference material. This is advantageous because the continuous conductive path can be detected (using for example a capacitive probe since the conductive path will disrupt or modify the electric field around the probe) and hence acts as an additional authentication feature. However, its presence is not apparent from visual inspection of the security element because the reflective/diffractive device (which might be expect to be conductive) is not visible along the length of the pathway, being interrupted in at least one place (preferably a plurality of locations) by the iridescent amplitude interference device, which does not appear conductive. As such a person hoping to produce a counterfeit element is unlikely to include a complete conductive path and the absence of this can be used as an additional feature to detect forgeries.

Preferably, the security element further comprising any of: a luminescent substance, a fluorescent substance, a phosphorescent substance, a visible colourant, a magnetic substance, a piezochromic substance or a thermochromic substance. The substance(s) could be included in one or more of the layers already described, or could be provided in one or more additional layers.

Where provided, the transparent material could be optically clear but in preferred examples could also comprise a visible colourant and/or a luminescent substance, a fluorescent substance or a phosphorescent substance. A visible colourant will introduce a coloured tint to at least the regions in which the reflective or diffractive device is visible. Luminescent, fluorescent or phosphorescent substances may be preferred, especially those which are not visible to the human eye under standard (visible) illumination, but emit visible light when illuminated with non-standard (e.g. non-visible, such as UV or IR) illumination, thereby acting as an additional security feature. The addition of any of these substances also provides the manufacturing advantage that the location of the transparent resist can be optically detected which assists in achieving registration between it and the light absorbing material. This can also be achieved through the addition of a substance which is only visible at wavelengths outside the visible spectrum, since this can be detected by machine. Preferably the transparent material is a resist, i.e. will protect an underlying layer from chemical etching.

Advantageously, the light absorbing material absorbs at least 70% of incident visible light, preferably at least 80%, more preferably at least 90%. Visible light is defined here as meaning all light with wavelengths between 380 nm and 750 nm, inclusive. Advantageously the light absorbing material is additionally non-transparent and preferably transmits less than 30% of incident visible light in a single pass, more preferably less than 20%, still preferably less than 10%, most preferably is substantially opaque. Desirably, the light absorbing material is dark in colour, preferably black, although alternatives such as dark blue or dark green are also envisaged. For example, the light absorbing material may comprise an ink containing a dark pigment such as carbon black. The light absorbing material may also comprise a magnetic or electrically conductive substance, which may or may not be the same pigment as that which gives the resist its colour.

As mentioned above, in preferred examples, light absorbing material is a resist material.

In any of the aspects, the security element preferably further comprises a layer of magnetic material (e.g. magnetic ink), preferably applied according to a pattern to form a magnetic coding, the magnetic material preferably being concealed by the reflection enhancing layer and/or the iridescent amplitude interference material. This acts as a further authentication feature. Alternatively the security element could comprise a transparent magnetic layer as is known from EP1497141 or WO2009053673A1.

By a "coding" it is meant a system for communication of hidden information, in particular secret information, in which the meaning of said information is conveyed using machine readable elements said configuration of elements being chosen so as to render the information unintelligible to casual interrogation. More preferably we are referring to a spacial code: i.e. it is the relative position of the individual elements that provides the information rather than the appearance of the elements.

In one example the magnetic regions are formed from a magnetic ink, such as iron oxide, or another iron, nickel or cobalt based material. Ferrites, such as barium ferrite, and alloys, such as AlNiCo or NdFeCo, would also be suitable. Hard or soft magnetic materials may also be used, or materials with high or low coercivity. Transparent magnetic inks such as those described in GB-A-2387812 and GB-A-2387813 are also suitable.

The code may be a block magnetic code. Block magnetic coding describes the arrangement of regions containing magnetic material separated by blank spaces. More advanced magnetic codes digitise the code. IMT is an example of spacial coding, and is described in EP-A-407550 and another type of coding is intensity coding.

Magnetic materials with a low coercivity can be used to form the code. The magnetic signal detected from a low coercivity material can differ in polarity from an iron oxide type material depending on the geometry of the detector. Such low coercivity materials have a lower coercivity than conventional iron oxide materials which means that they can be reversed in polarity by weaker bias magnetic fields, whilst they are still magnetically hard so that they retain the induced magnetism which can then be detected when the article is in a region no longer affected by the bias magnetic field. This is known as a reversed edge magnetic signature. Suitable low coercivity magnetic materials preferably have a coercivity in the range 50-150 Oe, most preferably 70-100 Oe. The upper limit of 150 Oe could increase with higher biasing fields. A number of examples of suitable materials include iron, nickel, cobalt and alloys of these. In this context, the term "alloy" includes materials such as Nickel:Cobalt, Aluminium:Nickel:Cobalt and the like. Flake nickel materials can be used. In addition, iron flakes are also suitable. Typical iron flakes have lateral dimensions in the range 10-30 μm and a thickness less than 2 μm. The preferred materials include metallic iron, nickel and cobalt based materials (and alloys thereof) which have the highest inherent magnetisations and so benefit from the requirement for least material in a product to ensure detectability. Iron is the best of the three with the highest magnetisation, but nickel has been shown to work well from other considerations. EP1770657A2 discloses a method of detecting such low coercivity materials. If both nickel based and iron based magnetic inks are used at set positions, then a more complex code can be achieved.

It is important that the code can be detected and related to the physical dimension of the security element. One method for achieving this is to have a binary code with a recognisable start and end bit to a detection trace. The presence of start and end bits enables the detector to "clock" or recognise the detection trace independent of the note speed in the detector and so enable a measurement of the complete length of the security element and thus determine where the other code elements should be. Suggestions to enable a self-clocking code would be a known length of start magnetic block (as described in EP407550), a reversed edge magnetic signature (as described in EP1770657), or the presence of materials with different magnetic properties: for example the material used for the start bit could have a different (e.g. higher or lower) magnetic remanence then the rest of the bits.

In a particularly preferred example the magnetic material is incorporated into any one or more of the resist layers mentioned herein. This enable automatic registration between the magnetic and the reflection enhancing material enabling the magnetic material to be concealed by the metal and not provided in the region of negative indicia or otherwise desired gaps.

Advantageously, the security element is elongate and preferably comprises a security thread or strip.

The present invention further provides a security article, preferably a transfer foil, comprising a security element according to any of the aspects described above. Typically a transfer foil comprises a carrier layer on which the security element is formed. On application to the surface of a security document or other object of value, the security element is released from the carrier layer and affixed to the document or object. This may be suitable for example for transferring the security element onto a document where the security element by itself is not self-supporting. Alternatively the security element may be configured to be self-supporting either by permanent attachment to a support layer or by forming the substrate to be sufficiently robust itself.

The invention further provides a security document comprising a security element according to any of aspects described above, applied to or incorporated in the security document, wherein the security document is preferably a banknote, polymer banknote, passport, identification document, passport, visa, cheque or certificate.

Examples of security elements and methods for their manufacture will now be described with reference to the accompanying drawings (which are not to scale), in which:—

FIG. 1 schematically depicts an exemplary security document incorporating a security element;

FIG. 2 shows a security element in accordance with a first embodiment of the invention, in (a) plan view and (b) cross-section;

FIG. 3 schematically illustrates a portion of a first exemplary diffractive relief device suitable for use in embodiments of the invention, in (a) plan view and (b) cross-section;

FIG. 4 schematically illustrates a portion of a first exemplary reflective relief device suitable for use in embodiments of the invention, in (a) plan view and (b) cross-section;

FIG. 5 schematically illustrates a portion of a second exemplary diffractive or reflective device suitable for use in embodiments of the invention, in (a) plan view and (b) cross-section;

Figure 9A:
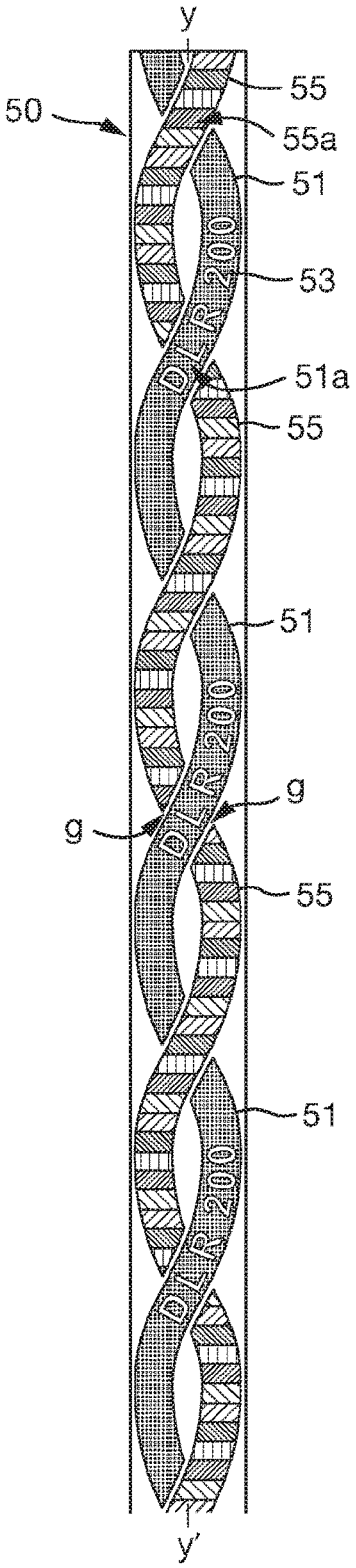
Figure 9B:
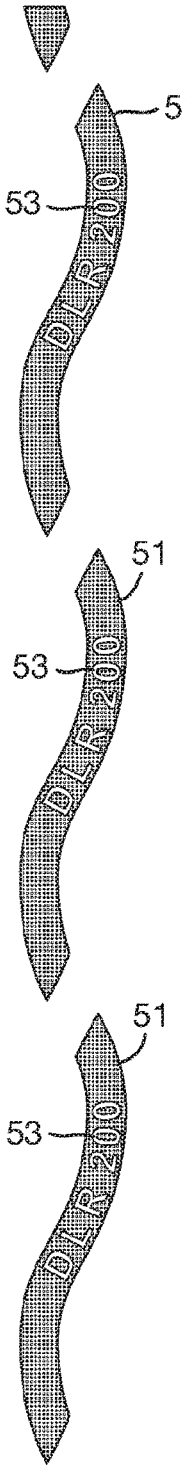
Figure 9C:
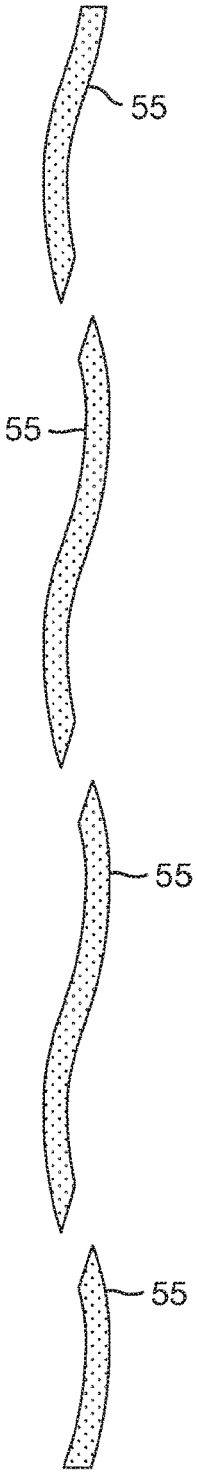
Figure 10A:
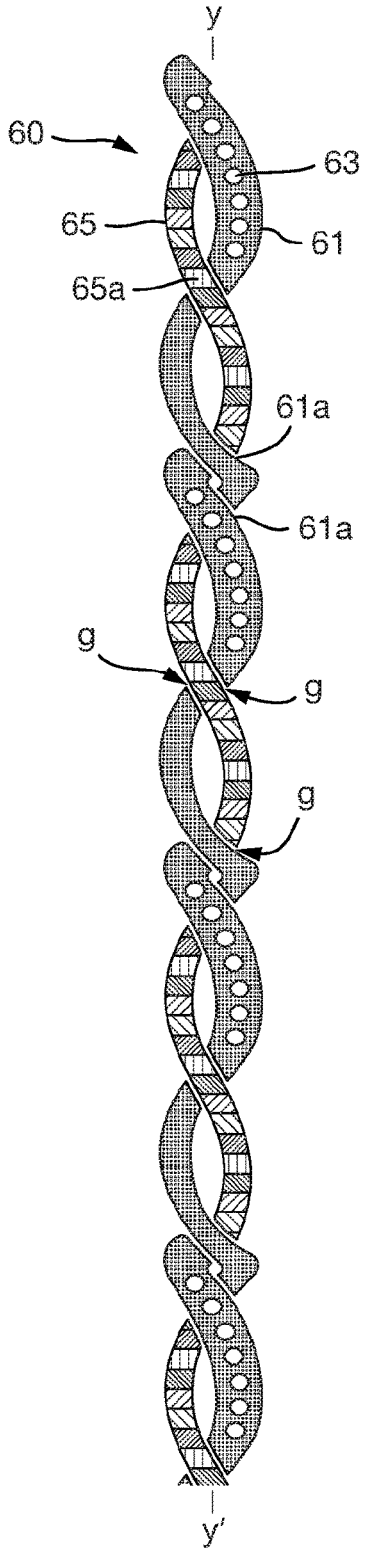
Figure 10B:
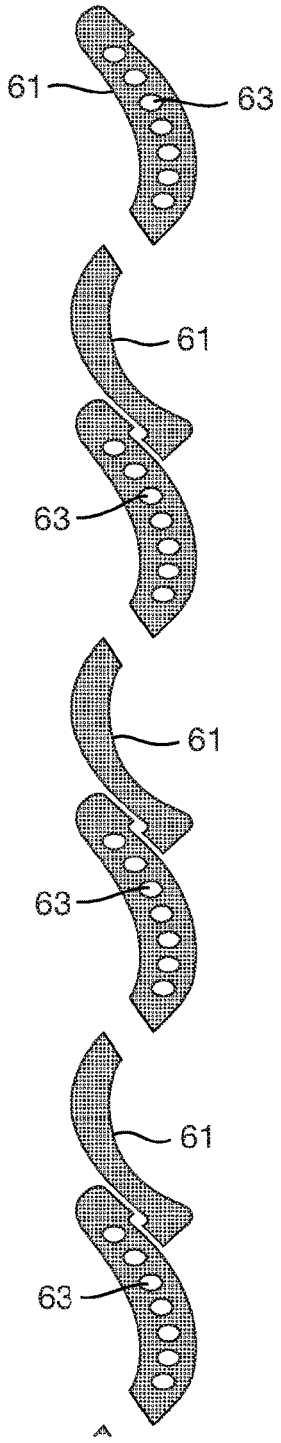
Figure 10C:
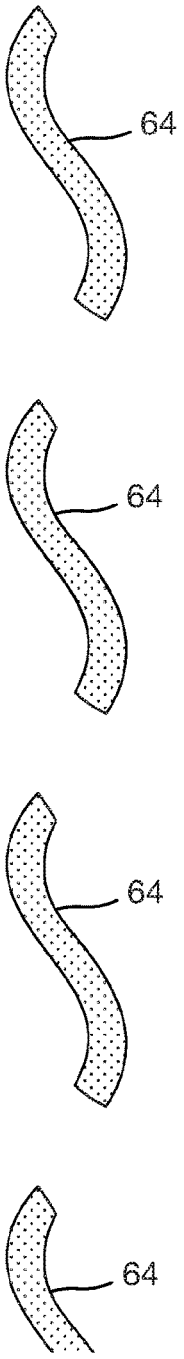
Figure 11A:
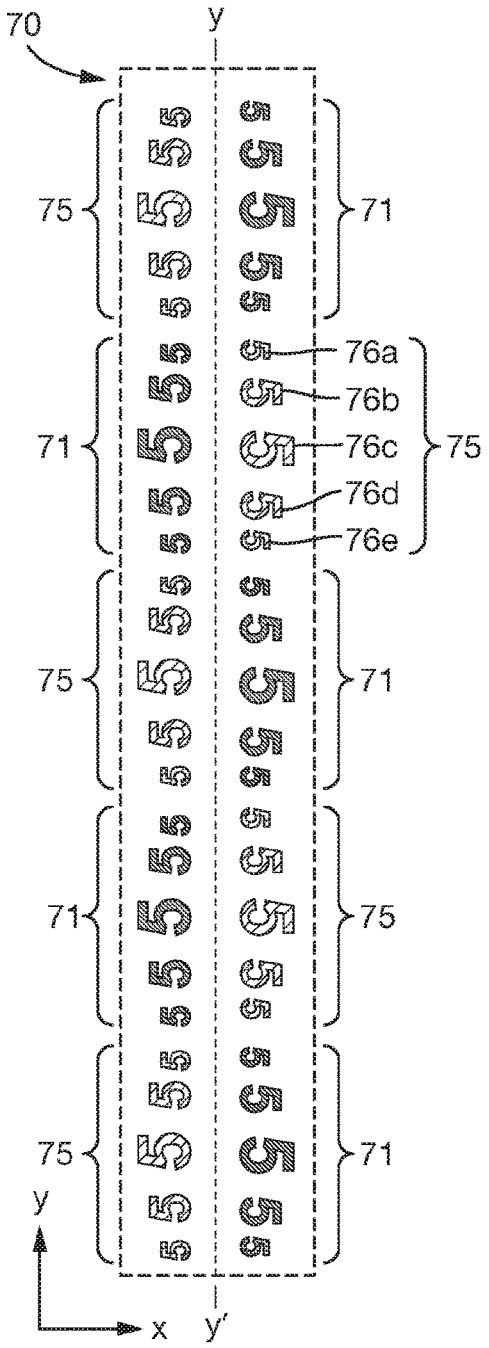
Figure 11B:
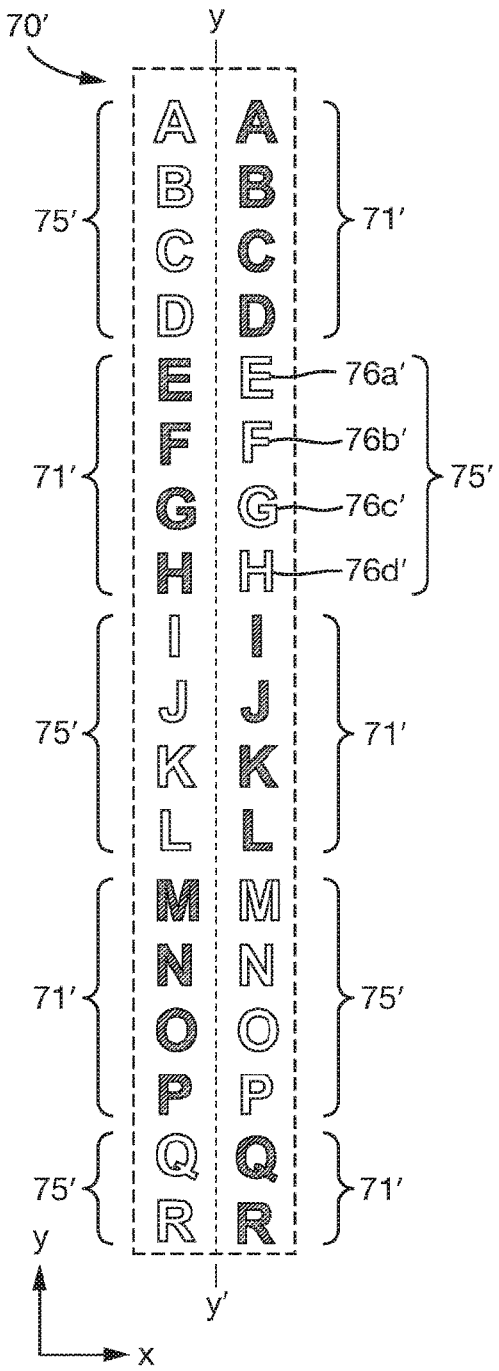
Figure 12A:
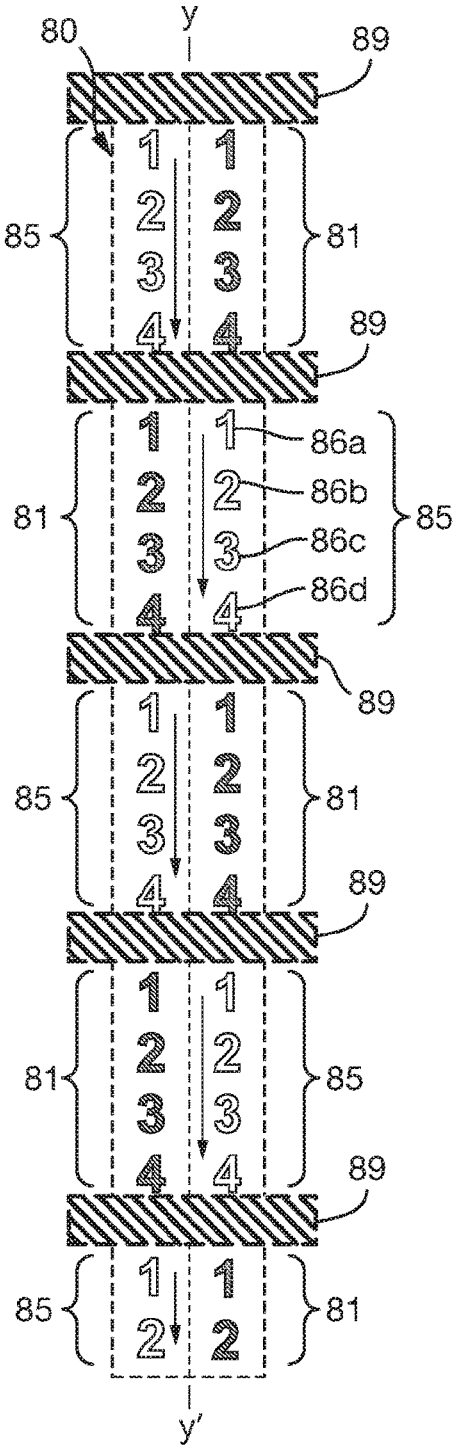
Figure 12B:
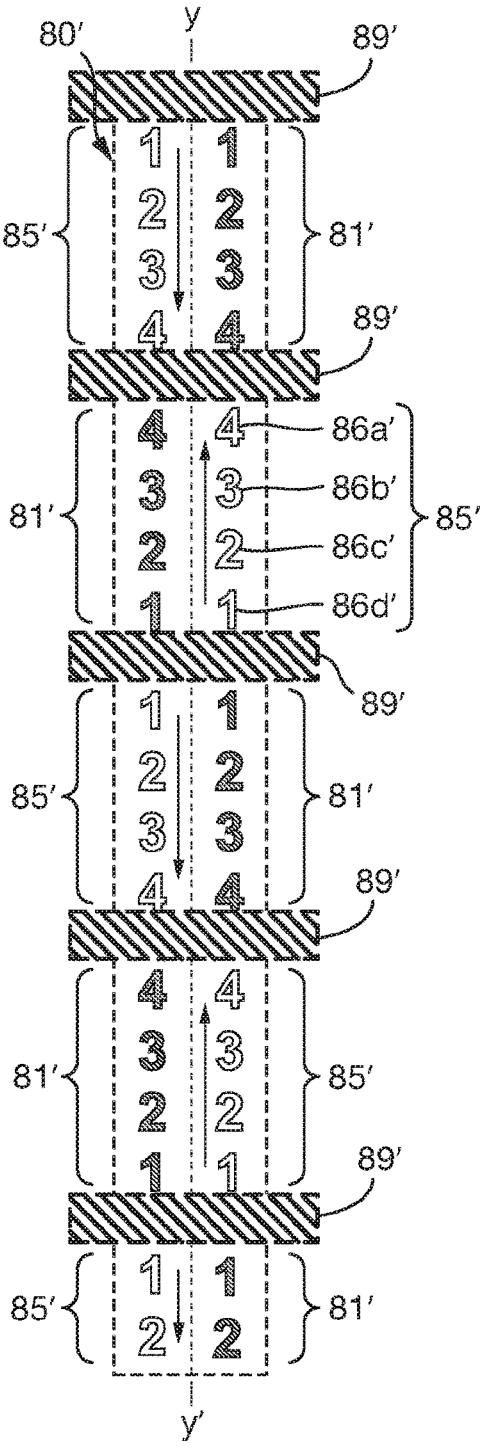
Figure 13A:
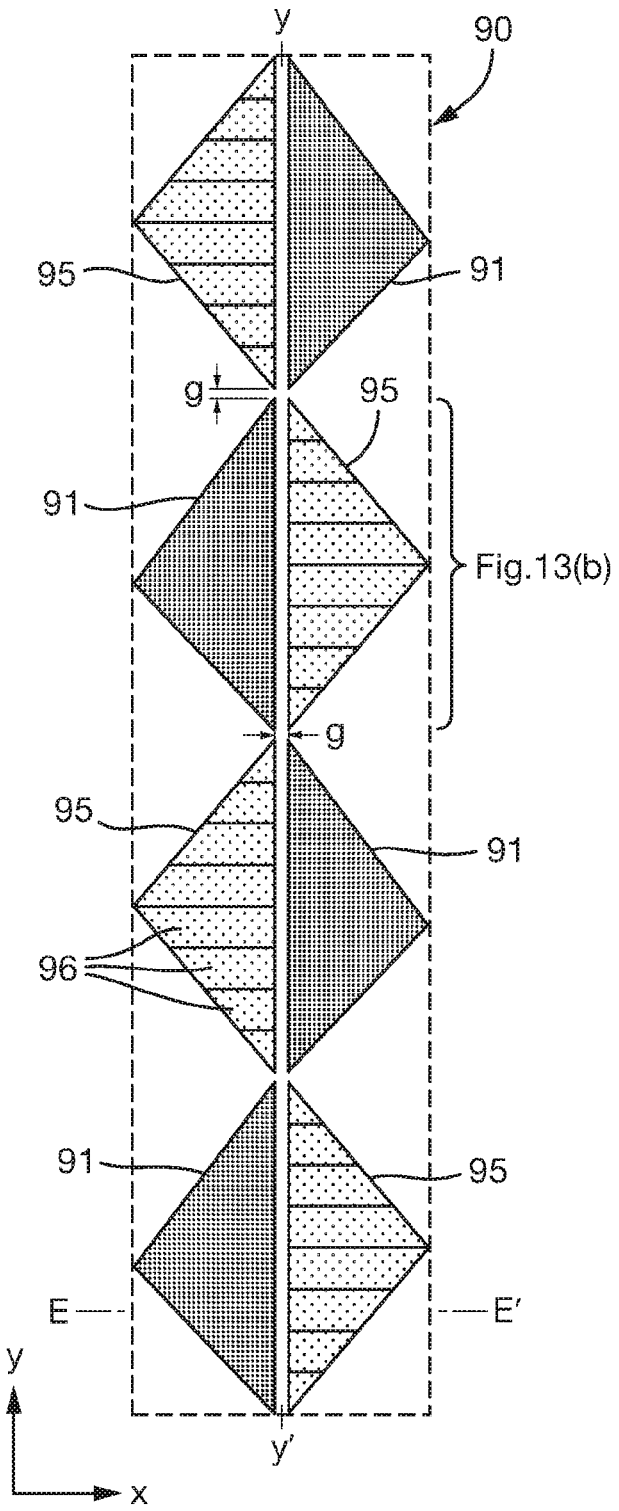
Figure 13B:
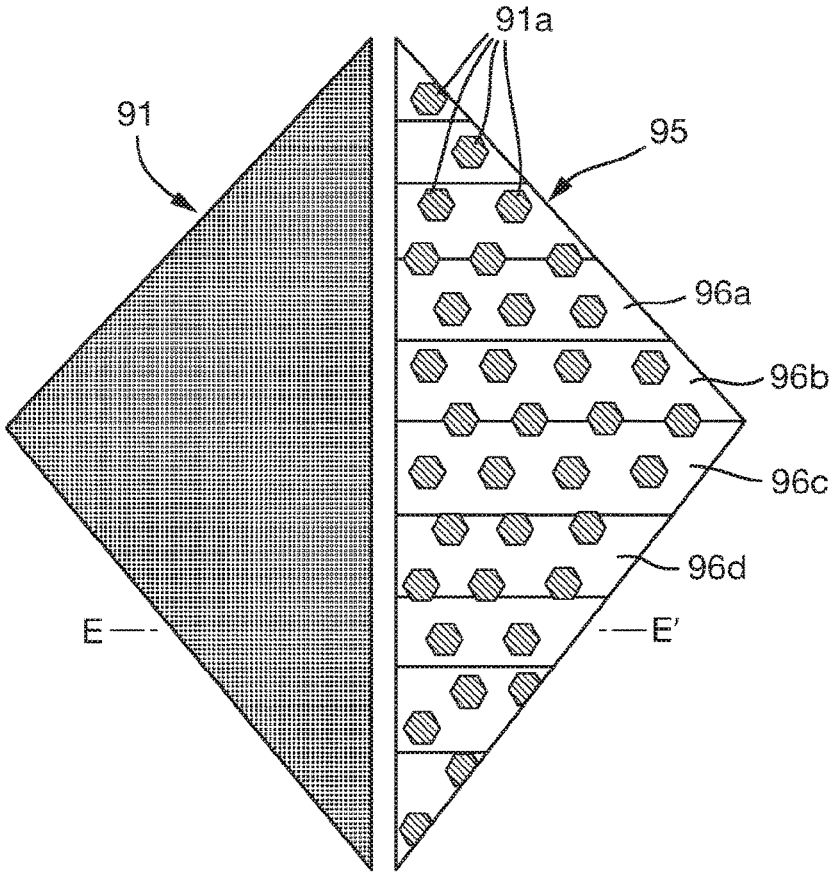
Figure 13C:
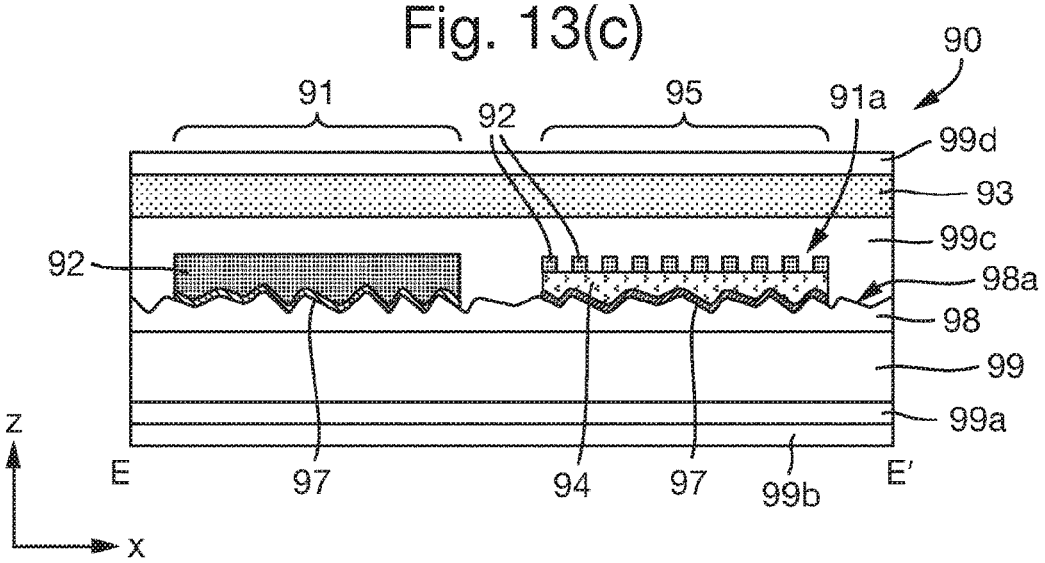
Figure 14:
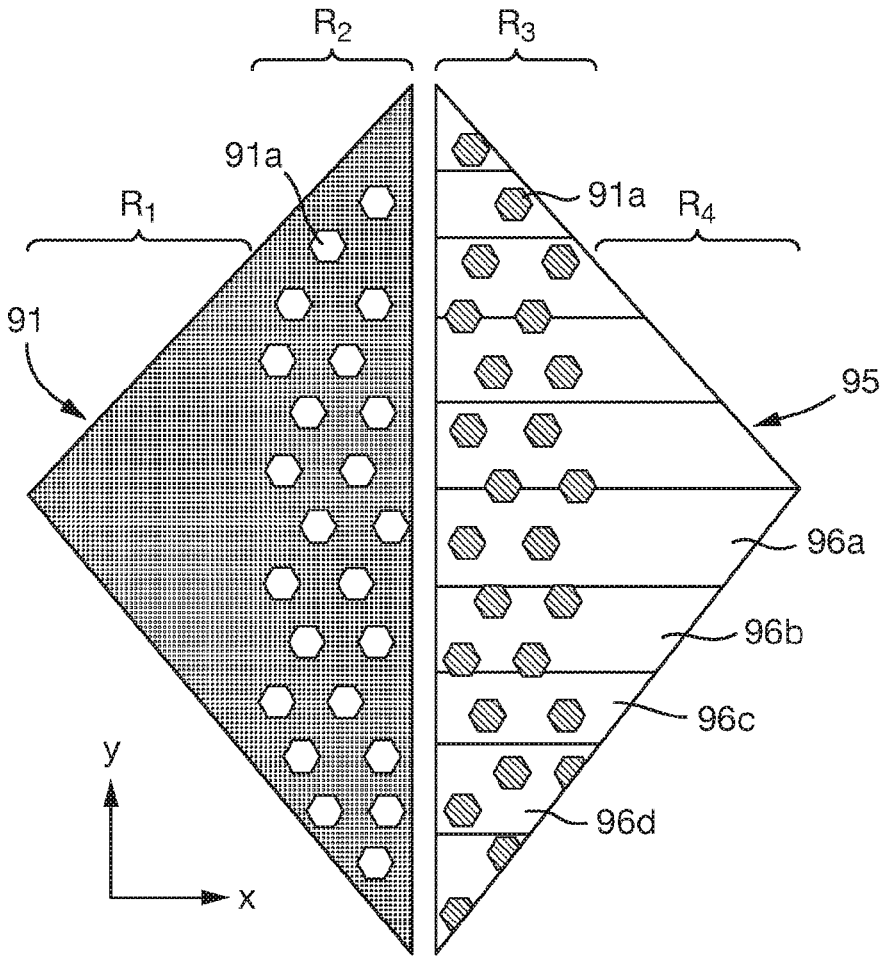
Figure 15A:
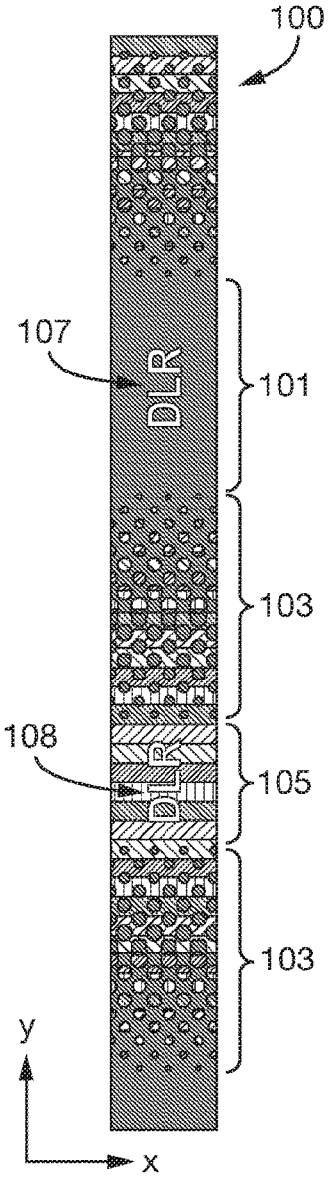
Figure 15B:
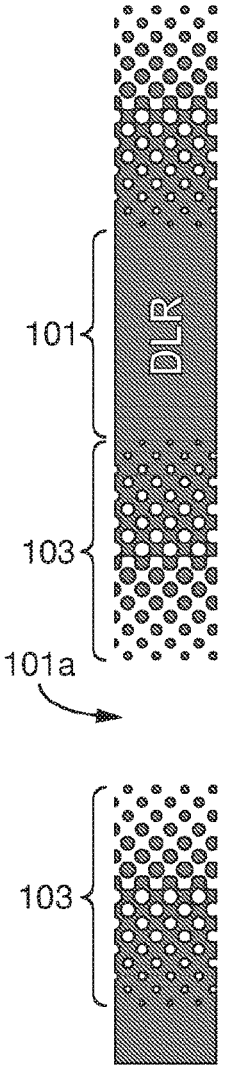
Figure 15C:
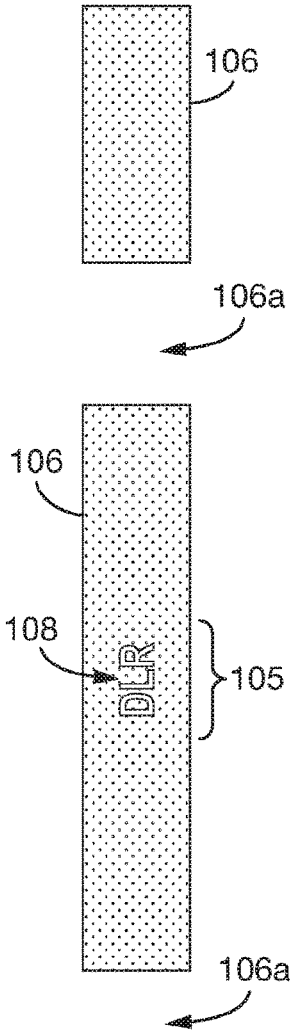
Figure 17A:
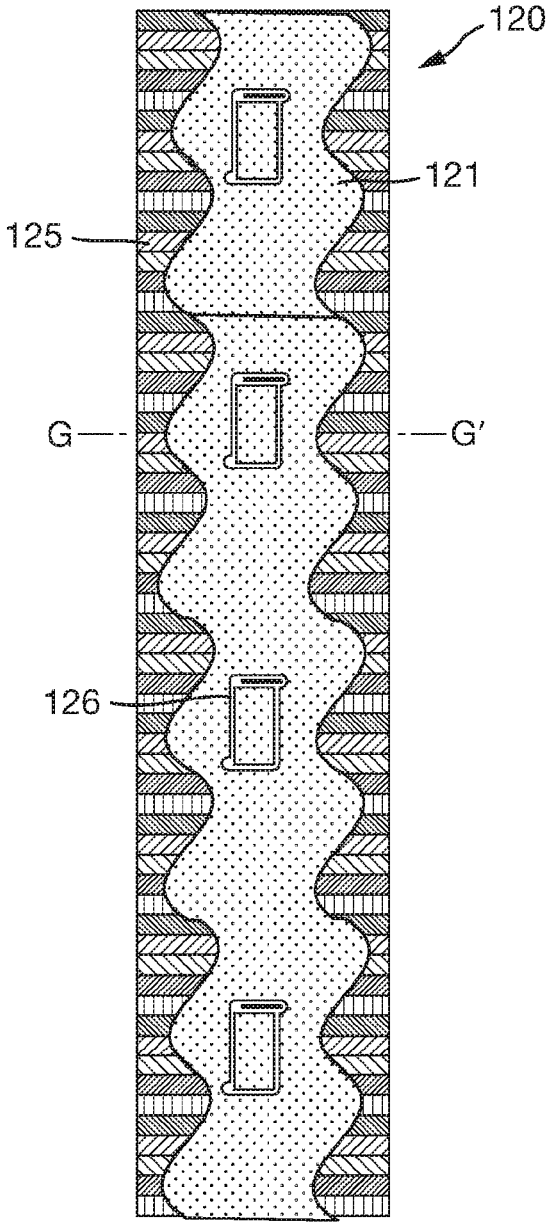
Figure 18A:
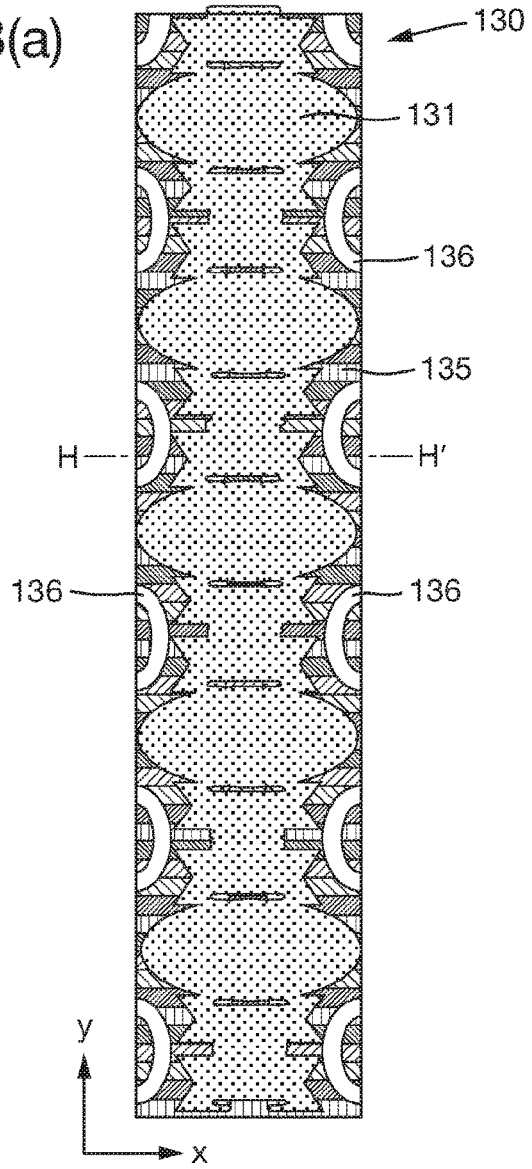
Figure 19C:
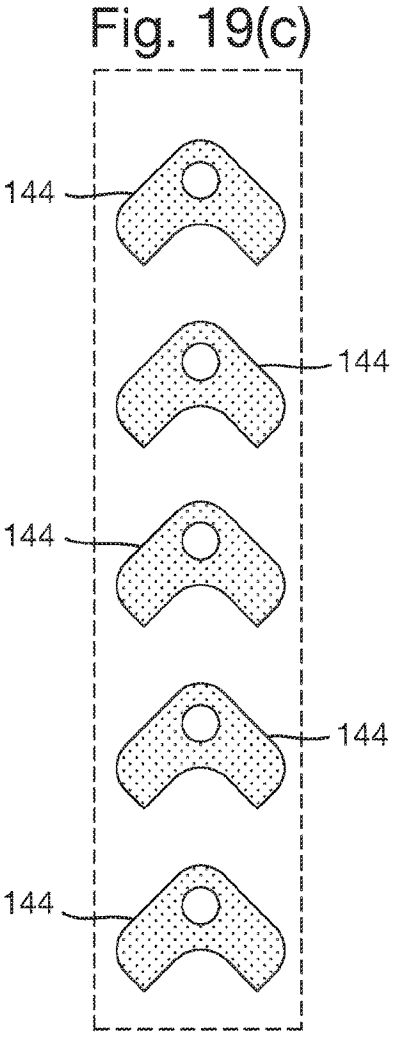
Figure 19B:
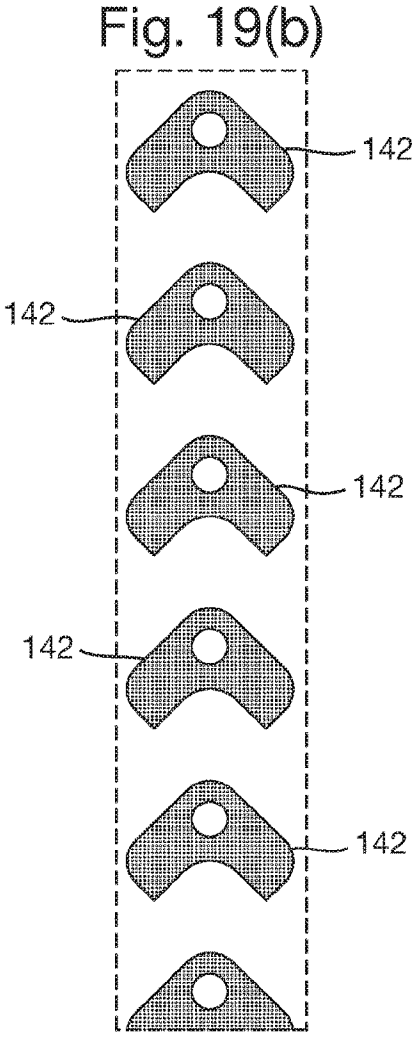
Figure 19A:
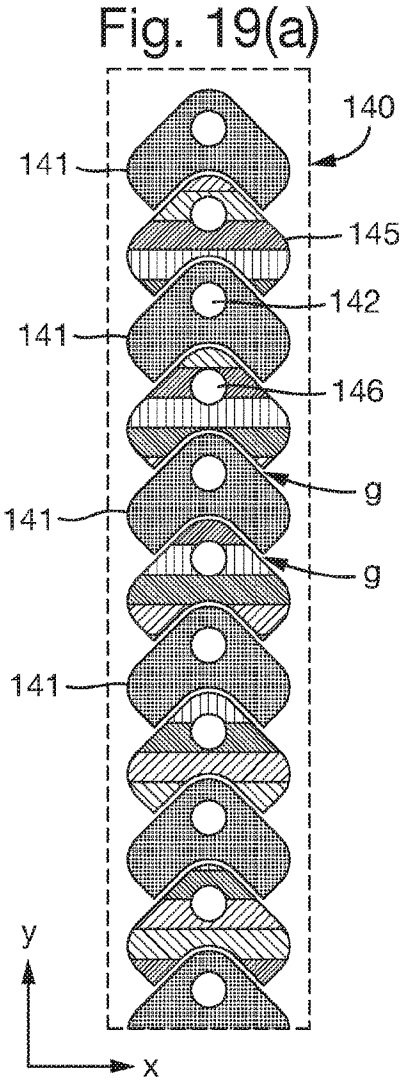
Figure 20A:
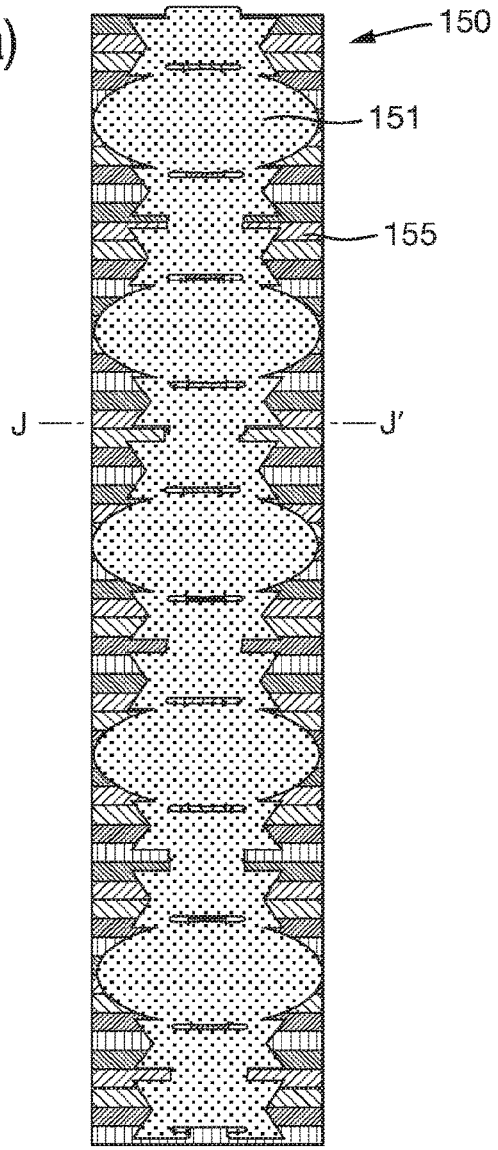
Figure 20B:
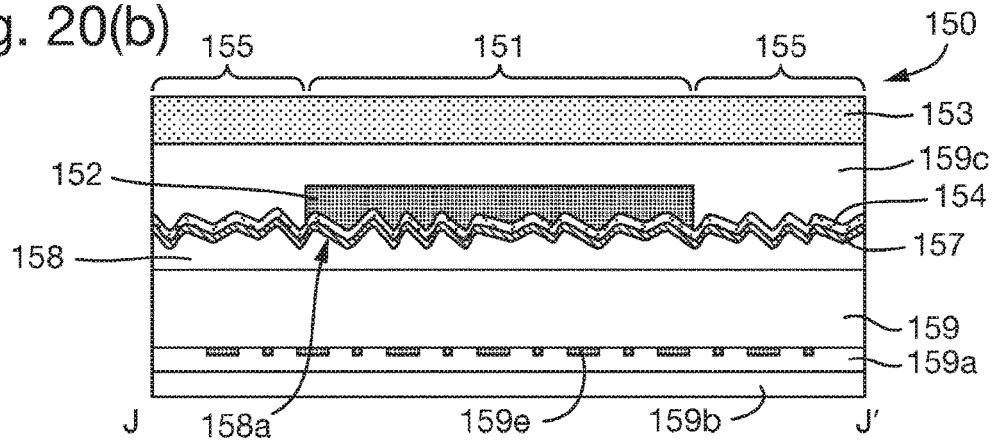
Figure 21:
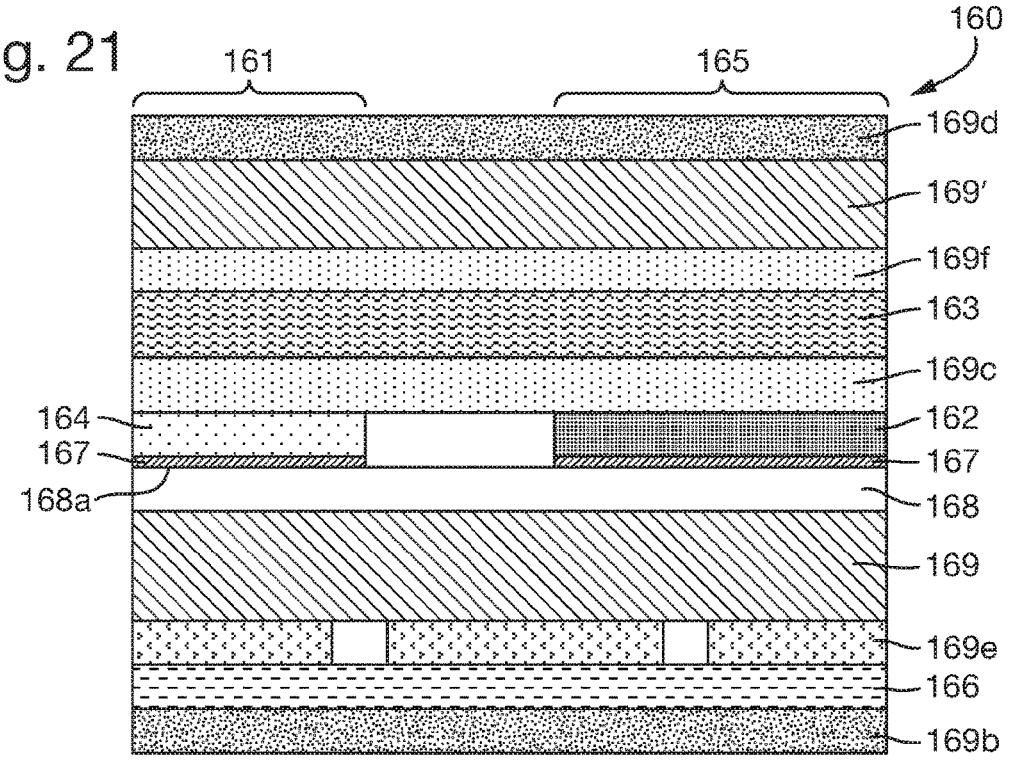
Figure 22:
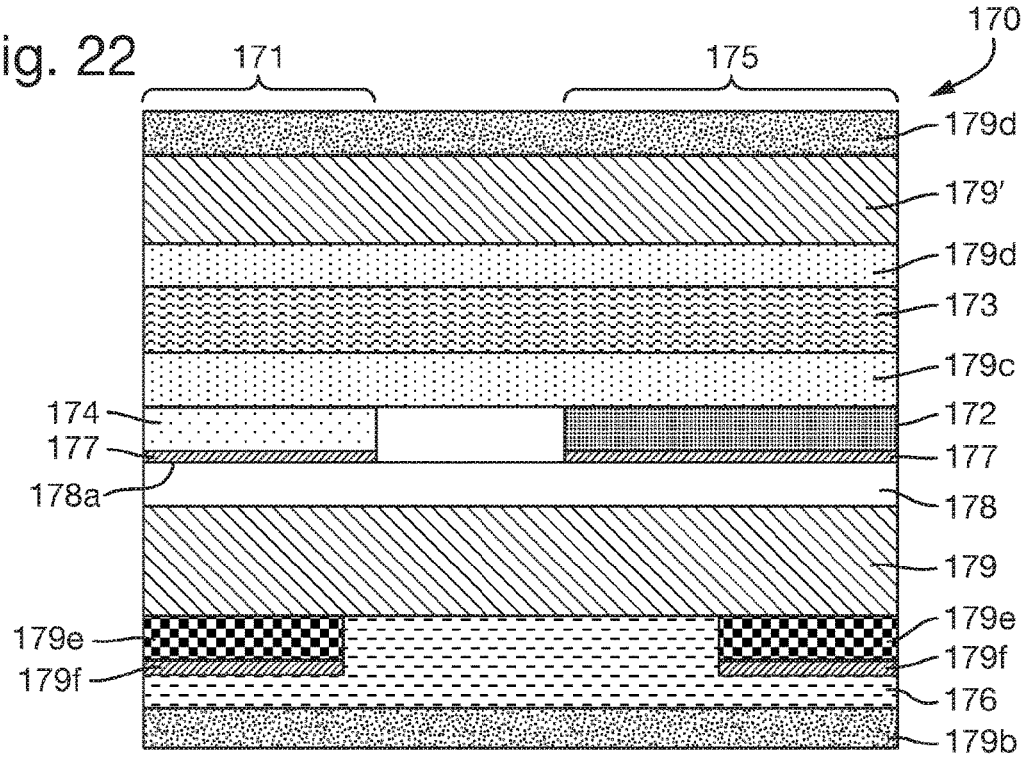
Figure 23A:
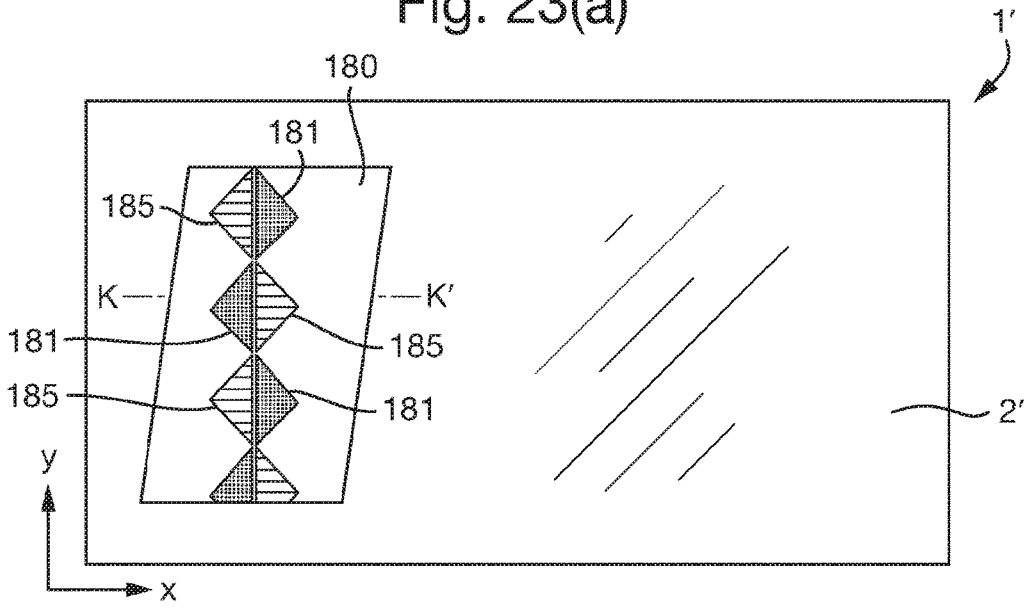
Figure 23B:
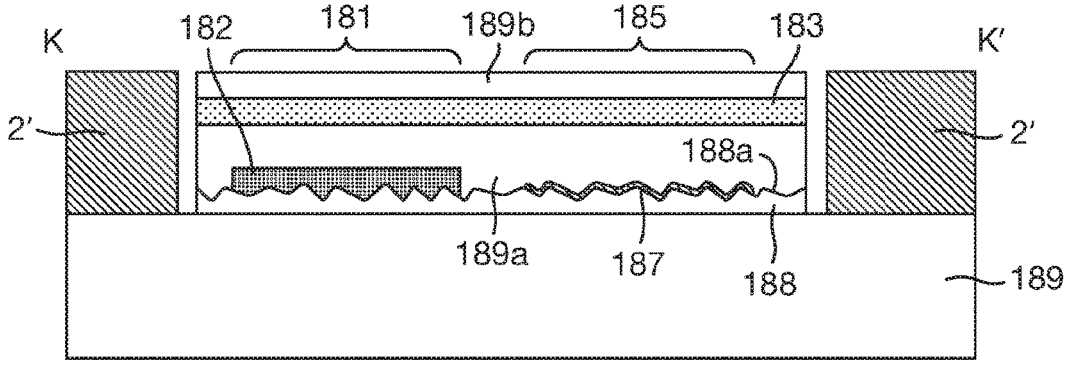
Figure 23C:
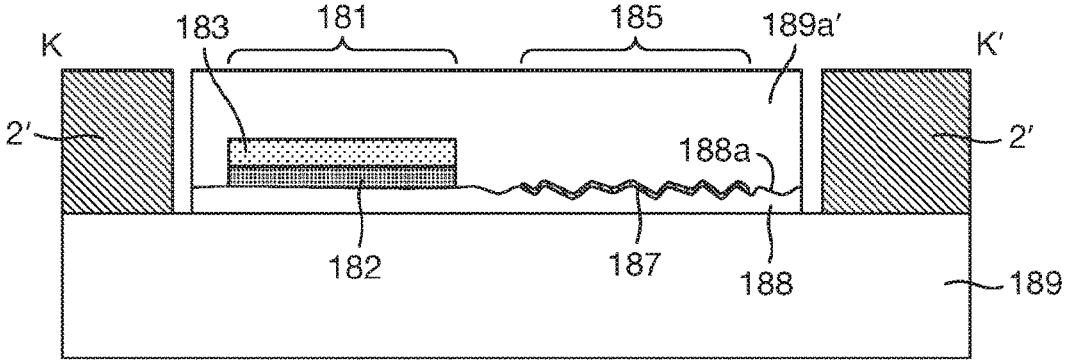
Figure 24A:
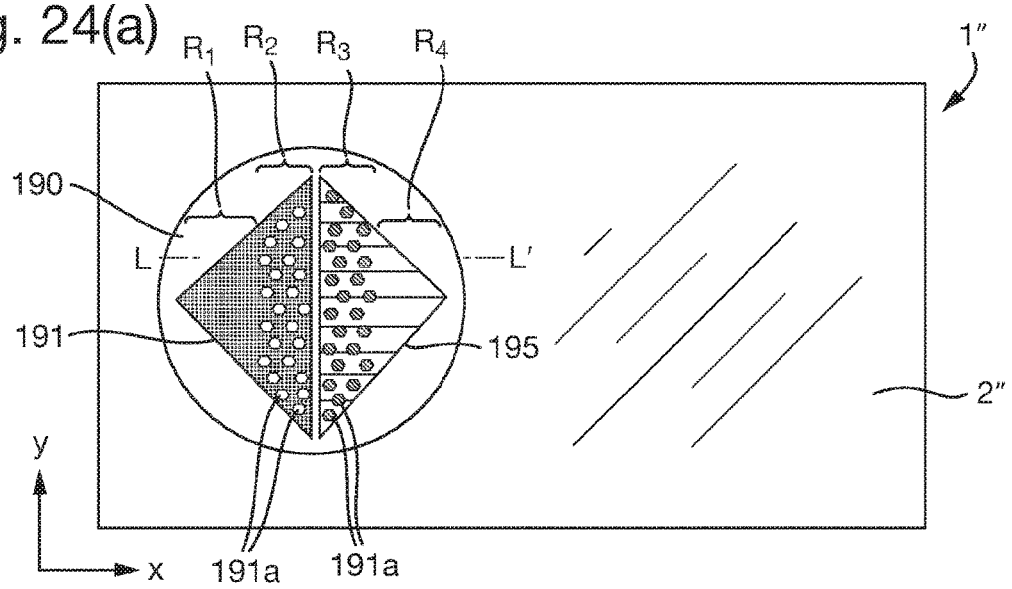
Figure 24B:
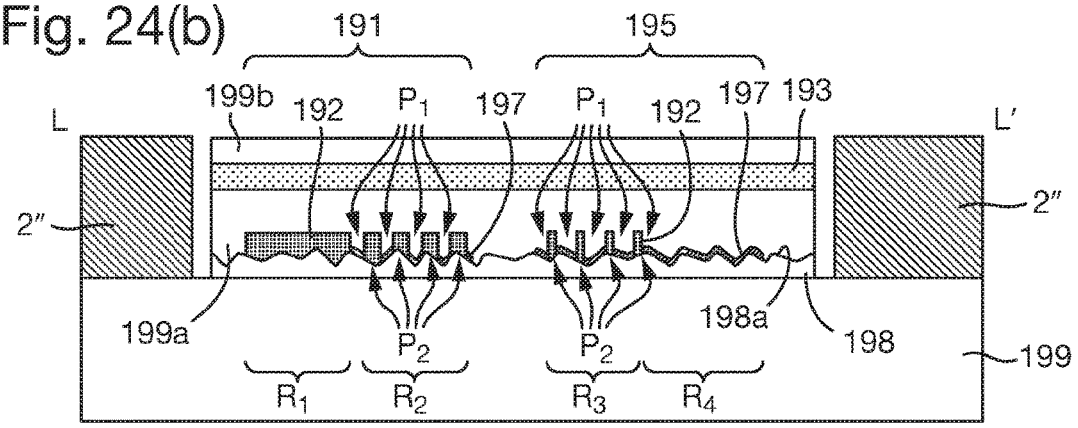
Figure 24C:
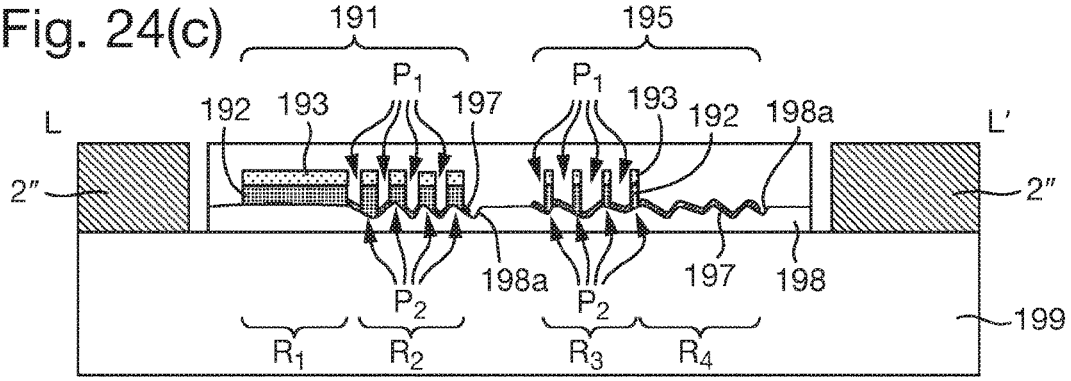

FIG. 9*a* depicts a security element in accordance with a fifth embodiment of the invention, in plan view, FIGS. 9*b* and 9*c* illustrating selected layers thereof;

FIG. 10*a* depicts a security element in accordance with a sixth embodiment of the invention, in plan view, FIGS. 10*b* and 10 illustrating selected layers thereof;

FIGS. 11*a* and 11*b* show security elements in accordance with seventh and eighth embodiments of the invention, respectively, in plan view;

FIGS. 12*a* and 12*b* show security elements in accordance with variants of the seventh and eighth embodiments, in plan view;

FIG. 13 shows a security element in accordance with a ninth embodiment of the invention, in (a) plan view, (b) enlarged detail and (c) cross-section;

FIG. 14 shows an enlarged detail of the security element of FIG. 13 according to a variant;

FIG. 15*a* depicts a security element in accordance with a tenth embodiment of the invention, in plan view, FIGS. 15*b* and 15*c* illustrating selected layers thereof;

FIG. 16 shows a security element in accordance with an eleventh embodiment of the invention, in (a) plan view and (b) cross-section;

FIG. 17 shows a security element in accordance with a twelfth embodiment of the invention, in (a) plan view and (b) cross-section;

FIG. 18 shows a security element in accordance with a thirteenth embodiment of the invention, in (a) plan view and (b) cross-section;

FIG. 19*a* depicts a security element in accordance with a fourteenth embodiment of the invention, in plan view, FIGS. 19*b* and 19*c* illustrating selected layers thereof;

FIG. 20 shows a security element in accordance with a fifteenth embodiment of the invention, in (a) plan view and (b) cross-section;

FIGS. 21 and 22 show two further embodiments of security elements in cross-section;

FIG. 23(*a*) shows a further embodiment of a security document incorporating a security element, FIGS. 23(*b*) and (*c*) depicting cross-sections through part of the security document including the security element according to two variants; and FIG. 24(*a*) shows a further embodiment of a security document incorporating a security element, FIGS. 24(*b*) and (*c*) depicting cross-sections through part of the security document including the security element according to two variants.

Figure 1:
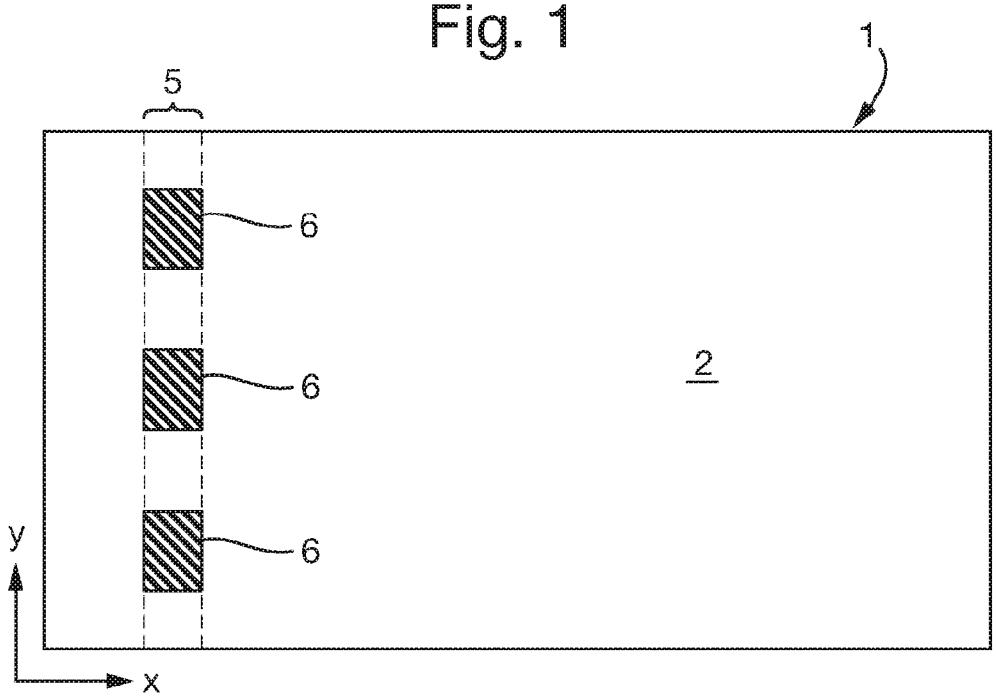

The following description will focus on security elements in the form of a thread or strip adapted for use in security documents such as banknotes, passports, certificates, cheques and the like, of which an example is shown in FIG. 1. However it should be appreciated that the present invention is not so limited and whilst elongate security elements such as these constitute preferred implementations, in practice the security elements could also take other forms, such as foils or patches of any shape, further examples of which will be described in connection with FIGS. 23 and 24. The elements could also be applied to any other objects of value, the authenticity of which is to be determined.

In the FIG. 1 example, the document 1 is a banknote with a paper substrate 2 and is provided with a security element 5 in the form of a windowed thread. Techniques for incorporating threads into substrates in this way are well known and may for example involve embedding the thread 5 into the substrate during papermaking in such a way that it is left exposed at one or more window regions 6, e.g. using the method described in EP0059056. Within each window region the element 5 is visible and displays optically variable effects as discussed in relation to any of the embodiments below. Between the windows, the thread is not visible in reflected light although, depending on its composition, will typically be apparent when the document 1 is viewed against a back light. On the reverse side of the document, the thread 5 may again be visible in window regions, or could be wholly concealed. In other examples, the thread or strip 5 may be applied wholly on one side or the other of the banknote, such that it is exposed on one side along its full length.

Examples of security elements 5 will now be described with reference to FIGS. 2 to 22 first in terms of the visual and other effects achieved, with reference to preferred structures and manufacturing techniques. However, it should be appreciated that security elements of substantially the same appearance and presenting the same key effects can be manufactured by alternative means, and hence correspondingly different structures, examples of which will be discussed with reference to FIGS. 23 and 24.

Figure 2A:
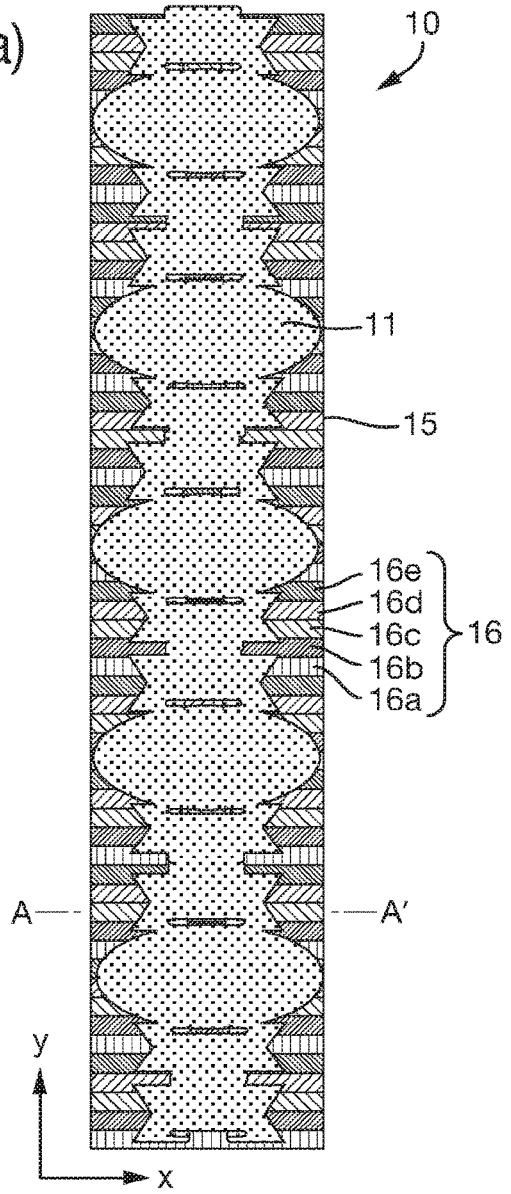
Figure 2B:
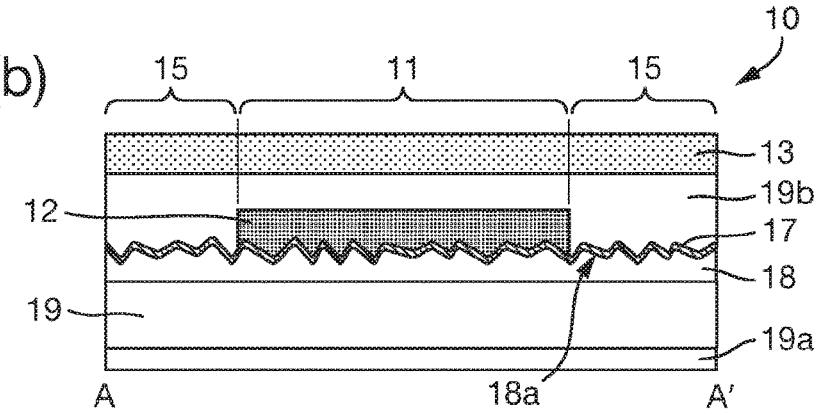

A first embodiment of a security element 10 is shown in plan view in FIG. 2*a*, and in cross-section along the line A-A' in FIG. 2*b*. In a first area 11 of the element, an iridescent amplitude interference (e.g. coloursHift) device is disposed, comprising for example a liquid crystal continuous film or a coating comprising liquid crystal pigments or a thin-film interference structure. In this example the first area 11 is elongate, consisting of a series of shapes disposed along the long axis (y-axis) of the element 10 such that its perimeter varies relative to the straight edge of the element itself. When a user holds a document carrying element 10 in front of themselves in the default orientation as shown in FIG. 1, the whole area 11 will exhibit a switch in colour as it is tilted in the direction parallel to the elongate axis of the element (i.e. parallel to the y-axis, about the x-axis). It should be noted that this colour switch effect will be visually static since the whole area 11 will appear to change colour substantially simultaneously at a certain tilt angle. When the device is held in this orientation but tilted in the perpendicular direction (i.e. about the y-axis), in effect the area 11 does not appear to display any colour-shift since the element would require tiling to much higher angles in order to reveal this. This is because the amplitude interference device operates by preferentially reflecting a particular colour (wavelength) of light towards the observer as a result of the partial amplitudes reflected at each respective thin film interface constructively interfering at that the wavelength band pertaining to that colour and destructively interfering at other wave-lengths. The interference is governed by the relative interlayer path length difference and this will change on tilting in any direction. However, when tilting the device towards or away from the viewer there is a simpler and more natural reflection geometry (and hence plane of dispersion) resulting in the path length changing quickly with tilt angle. When the device is tilted in the perpendicular (left/right) direction, the rate of change of path length with tilt angle is reduced by a significant factor such that no colour shift effect is visible until the device has been tilted to a much larger extent.

A second area 15 of the element, which here fills the remainder of the element 10 and thus appears as a background to the first area 11, carries a diffractive or reflective relief device. The second area 15 is divided into a series of sub-areas 16, of which five are labelled 16*a*, 16*b*. 16*c*, 16*d* and 16*e* in FIG. 2*a*. The sub-areas 16 are arranged along a predetermined direction which here corresponds to the axial direction (i.e. y-axis) of the element. As will be described in more detail below, the parameters of the relief structure defining the diffractive or reflective device are varied from one sub-area to the next in a cyclical manner along the axis of the element. The result is that, within each repeat of the cycle, from any one viewing angle, each sub-area will exhibit a different appearance from the next, either in terms of diffractive colour or reflected brightness (intensity), depending on the nature of the relief device. As the device is tilted, each colour or brightness level will progress from one sub-area to the next within the repeat cycle along the axial direction of the element.

Since this apparent "movement" of colours or brightness levels will only occur along the axial direction, due to the arrangement of the sub-areas, the diffractive or reflective device is anisotropic and hence its orientation clearly demarcated. In combination with the iridescent amplitude interference device provided in the first area 11, this presents an obstacle to counterfeiters since the diffractive or reflective device must be accurately orientated relative to the iridescent amplitude interference device. Such visual integration is extremely difficult to achieve through the attempted grafting together of two separate devices. It should be noted that whilst it is preferred that the predetermined direction of the diffractive or reflective device is parallel to the elongate direction of the iridescent amplitude interference device (as in the present example), in order that the "movement" effect in area 15 appears parallel to the tilt direction required to observe the colour switch in area 11, this is not essential. For example, the predetermined direction along which the sub-areas 16 are arranged could be rotated within the plane of the element relative to the long axis such that the device exhibits a pre-determined, non-zero angle between the two directions which the counterfeiter would still need to replicate in an imitation element. Different sections of the second area 15 could also be configured to exhibit this movement effect in opposite directions, e.g. one in the +y axis direction and another in the −y axis direction, simultaneously, by appropriate configuration of the sub-areas 16*a* to *e*.

By combining an iridescent amplitude interference device with a diffractive device in this way, the complexity of the optical effect exhibited upon tilting is enhanced and hence the security level of the element increased. For example, when the element is tilted along the y-axis (i.e. about the x-axis), substantially immediately, the diffractive replay from the device 15 will be visible since it becomes active at very low tilt values (e.g. 3 to 5 degrees). This, combined with the first colour appearance of the amplitude interference device 11, will continue to be exhibited until tilting reaches some threshold value at which the colour shift effect of device 11 occurs, at which the appearance of the device 11 changes to a second colour. Upon continued tiling, the diffractive motion effect of device 15 continues but is now set against the second colour of device 11, giving the element as a whole a different appearance at higher tilt angles from those at low tilt angles whilst exhibiting the same diffractive optically variable effect throughout.

A cross-section through element 10 is shown along the line A-A' in FIG. 2*b*. A substrate 19 is provided which in this case is self-supporting and provides element 10 with structural support. The substrate may be transparent, translucent or opaque depending on the desired appearance of the element. In one example, the substrate comprises a polymer such as PET, e.g. 12 micron thick PET. If substrate 19 is transparent, a mask layer 19*a* may optionally be provided so that the optically variable effects are only visible from one side of the element 10. A lacquer 18 is applied to the substrate and a surface relief 18*a* defining the diffractive or reflective device is formed in its surface, e.g. by embossing or cast-curing from a master. In other cases the relief 18*a* could be formed directly in the surface of substrate 19. A reflection enhancing material, e.g. metal or an HRI material, is deposited onto the relief 18*a* such that it conforms to the relief contours, e.g. by vacuum deposition. A light absorbing material 12 is selectively applied, e.g. by printing, onto the relief to form the first area 11 in which the iridescent amplitude interference device will ultimately be visible. The light absorbing material 12 preferably comprises a visually dark, e.g. grey or black, substance such as an ink. An example of a suitable light-absorbing material which can be used in this and all other embodiments disclosed herein would be an ink carrier, lacquer, binder or resist substance containing a black or dark dye or pigment such as the dye BASF Neozapon X51 or the pigment "carbon black 7" (well dispersed). The dye loading can be up to 50% (by weight) of the final coat of material depending on coat thickness and desired darkness.

A non-opaque layer comprising an iridescent amplitude interference material 13 is then provided at least over the light absorbing material 12 and preferably across substantially the full extent of the element 10. This may be achieved in a number of ways. For example, the iridescent amplitude interference material may be supplied in the form of a film or foil which is laminated to the rest of the structure using a lamination adhesive 19*b*. This may be particularly suitable where the iridescent amplitude interference material comprises a contiguous thin film interference structure or a liquid crystal film, for example. Alternatively the layer 13 could comprise interference pigments dispersed in a binder (e.g. a colourshift ink), in which case it may be laid down by printing. In this case the use of a layer such as adhesive 19*b* is still preferred in order to achieve a level surface. In order for the element 10 to be affixed to a security document or similar, adhesive layers may be disposed on either or both sides of the element (not shown in FIG. 2*b*).

In the first area 11, where the light absorbing material 12 is present, the underlying relief structure 18*a* is concealed from view. The light absorbing material 12 absorbs stray light reflections and hence renders the optically variable effect of the iridescent amplitude interference material 13 visible. The remaining area of the element 10 outside the light absorbing material 12 constitutes the second area 15 and here the diffractive or reflective device formed by relief 18*a* is visible. Whilst the iridescent amplitude interference material 13 preferably also extends across this area, its visual effect is substantially overwhelmed, and hence concealed, by the reflected or diffracted light from relief 18*a*.

It should be noted that substantially the same visual effect could be achieved by selectively applying the reflection enhancing material 17 only in the second area 15, e.g. by performing a demetalisation step prior to the application of light absorbing material 12, or by use of a selective application process such as printing, in which case the reflection enhancing material may comprise a metallic ink for example. In both cases the light absorbing material may then be applied to the relief 18*a* in the first area 11 alongside the reflection enhancing material. It is also not essential for the relief 18*a* to extend under the light absorbing material. Examples of alternative structures such as these will be discussed with respect to FIGS. 23 and 24.

Figure 3A:
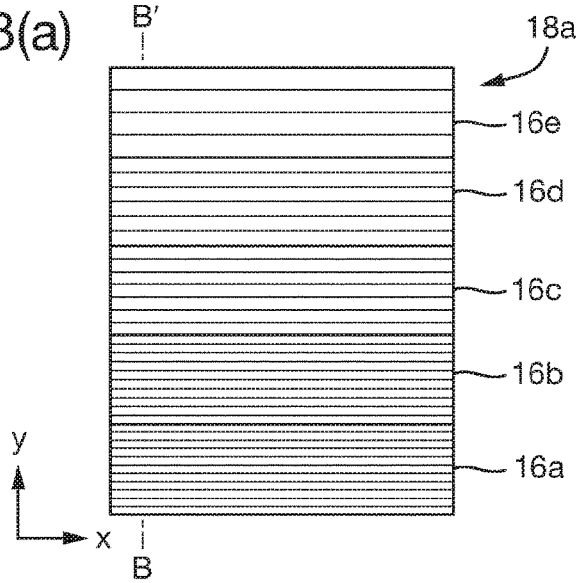
Figure 3B:
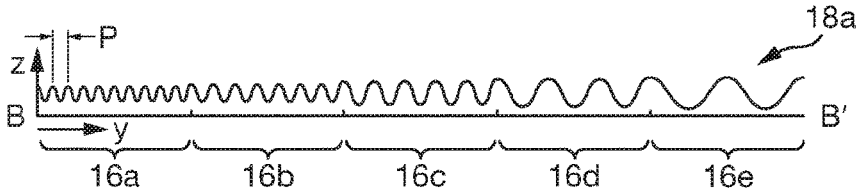

The diffractive or reflective device visible in area 15 can take various different forms. Most preferably, the movement of the colours or brightness levels along the device 15 takes place when the device is tilted in the axial direction y (i.e. the same direction as that in which the movement occurs). In this way, the colour-switching effect of the iridescent amplitude interference material and the movement effect of the diffractive or reflective device will both be activated by the same tilt action, giving rise to an apparent functional link between the two visual effects.

Where the device is a diffractive relief such as a diffraction grating, this result can be achieved by arranging the pitch of the relief structure 18*a* to vary from one sub-area 16 to the next. This is schematically illustrated in FIG. 3, where FIG. 3*a* shows a portion of a diffractive relief 18*a* in plan view, and FIG. 3*b* shows a cross section through the relief along line B-B'. Five sub-areas 16*a*, 16*b*, 16*c*, 16*d* and 16*e* are illustrated and in this case these form one complete cycle of the relief, i.e. the device as a whole will consist of multiple repeats of the partial area shown in FIG. 3*a*, arranged next to one another along the y-axis. The pitch P (i.e. the spacing between relief features in the x-y plane) is arranged to increase from one sub-area to the next in the y-direction. Thus for example, sub-area 16*a* may have a pitch of 0.7 microns, sub-area 16*b* a pitch of 0.8 microns, sub-area 16*c* a pitch of 0.9 microns, sub-area 16*d* a pitch of 1.0 microns and sub-area 16*e* a pitch of 1.1 microns. Preferably, as in this example, the difference in pitch between each adjoining pair of sub-areas is constant along the device (e.g. 0.1 microns) but this is not essential.

The different pitch P of the relief in each sub-area 16 has the effect that the respective diffraction spectrum exhibited by each sub-area has a different angular spread. From any one viewing angle, the portion of each diffraction spectrum seen by the viewer will therefore be different, which is visualised as a different colour in each sub-area. As the device is tilted parallel to the axial direction, the observed portion of each diffraction spectrum changes and gives the appearance that each colour moves progressively from one sub-area to the next along the device.

Figure 4A:
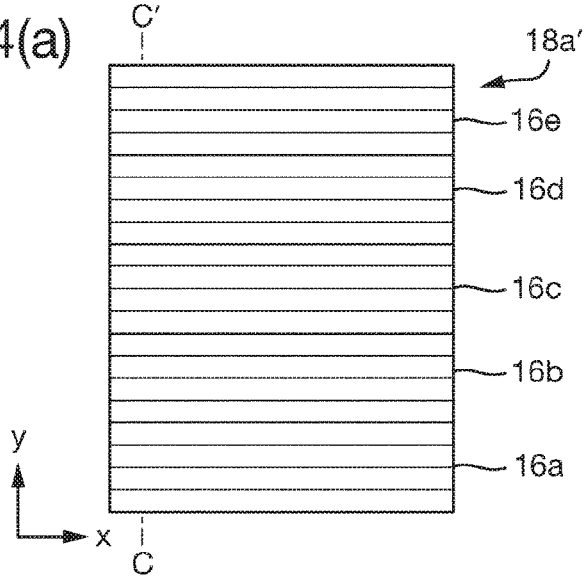
Figure 4B:
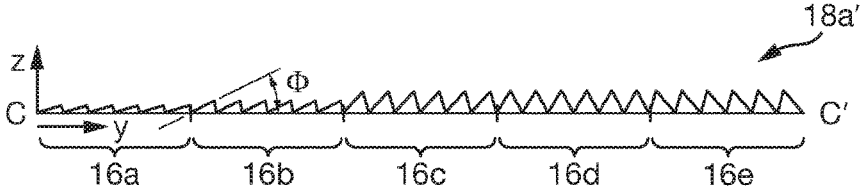

Preferably, the smallest pitch in the cycle (i.e. that of sub-area 16*a* in this example) will be at least 0.5 microns. Diffractive reliefs at this scale and above exhibit diffraction spectra spread over a sufficiently small angular range that the above-described colour movement will be seen over relatively small degrees of tilt. Further, the rate of change of colour with tilt will generally be greater than that displayed by the iridescent amplitude interference device, meaning that the full (or a least a substantial proportion of the) colour movement exhibited by the diffractive device will be seen by the viewer before the colour switch of the iridescent amplitude interference device takes place. This is desirable since otherwise the composite device could appear visually static over a relatively large tilt angle, and once the colour shift effect has been seen, the user may not tilt the device further.

Where the device is a reflective device it will typically comprise an array of reflective facets, e.g. prisms, as illustrated schematically in FIG. 4, where FIG. 4*a* shows a portion of a reflective relief 18*a*' in plan view, and FIG. 4*b* shows a cross section through the relief along line C-C'. As before, in this example there are five sub-areas 16 making up the repeat cycle. In order to achieve the movement effect on tilting in the axial direction, the angle ϕ between the facets and the plane of the device is varied from one sub-area 16 to the next. For example, in sub-area 16*a* the angle ϕ may be close to zero degrees and arranged to increase progressively between successive sub-areas up to close to 90 degrees in sub-area 16*e*. As the device is tilted in the axial direction, different ones of the sub-areas become optimised to reflect incident light to the viewer, meaning that at any one viewing position, one sub-area of the cycle will appear brightest and another darkest. The brightest and darkest positions will appear to move from one sub-area to the next as tilting in the axial direction progresses.

Figure 5:
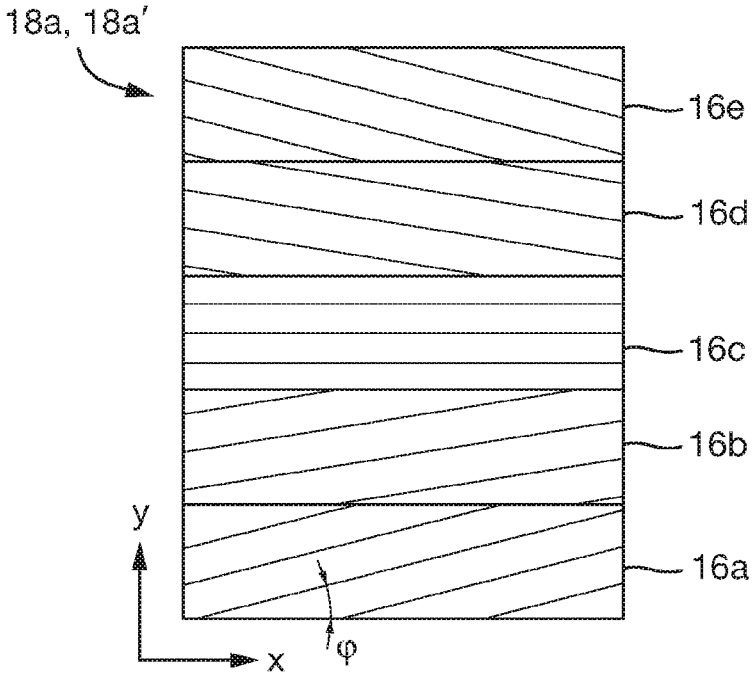

In alternative embodiments it may be preferable for the motion effect to be activated upon tilting in the perpendicular direction, i.e. about the y-axis. In this case only one of the two optically variable effects will be exhibited at a time, but the motion effect will still be along the same axial direction. The impression of a functional link between the two devices is still given since one appears active when the other is static, and vice versa. This result can also be achieved using either a diffractive or reflective relief structure and in this case the necessary measures are the same for both relief types. FIG. 5 schematically illustrates a diffractive or reflective device of this sort in plan view and again in this example there are five sub-areas 16. In order to achieve the desired movement effect, the orientation of the diffractive relief lines or reflective facets in the plane of the device is varied from one sub-area to the next. This can be denoted by the azimuthal angle φ between the x-axis and the direction of the relief structure in each sub-area. Hence, in this example, the angle φ varies from about +10 degrees in sub-area 16*a*, though φ=zero in sub-area 16*c*, to about −10 degrees in sub-area 16*e*.

In the case of a diffractive relief, the differently orientated sub-areas give rise to respective diffraction spectra which have correspondingly different orientations from one another, such that different portions of each are directed to the viewer at any one viewing angle. As the device is tilted about the y-axis (i.e. in the direction perpendicular to the movement direction), the portion of each diffraction spectrum seen by the viewer will change giving rise to the apparent motion of each diffracted colour from one sub-region to the next. Similarly, in the case of a reflective relief, the strongest light reflection will occur in a different direction in each sub-area, and different sub-areas will reflect light most strongly to the viewer as the device is tilted about the y-axis, resulting in bright and dark bands moving along the axial direction (y-axis).

In a still further example, both the pitch of the relief (or facet angle in the case of a reflective device) and its orientation can be varied from one sub-area to the next. In this case, the device will exhibit the above-described cyclical effect when the element is tilted in both the predetermined and the perpendicular direction, e.g. along a line which makes a non-zero angle with both of these directions such that a component of the tilt acts in both directions. This has been found to produce a striking, sharply-defined motion effect for the reasons explained previously.

Irrespective of the mechanism utilised for creating the movement effect, the sub-areas themselves can take various different layouts. In the examples shown in FIGS. 2, 3 and 4 the sub-areas 16 of the relief 19 are each of the same shape and size, each corresponding to a band or stripe forming part of the second area 15. The sub-areas 16 abut one another and this is preferred in order to give rise to a smooth animation effect as the colours (or reflected intensities) appear to move from one sub-area to the next. However these are not essential requirements and alternative implementations will be discussed below.

Preferably, the repeat cycle comprises at least three and more preferably at least five sub-areas 16. The more sub-areas provided, the smoother the movement effect appears. Advantageously, the repeat length (i.e. the distance between two sub-areas possessing the same relief parameters) is selected such that at least a full cycle will be visible once the element has been incorporated into the final security document or other article, e.g. through a window region 6 as shown in FIG. 1. Thus in preferred examples the repeat length is between 5 and 20 mm. The dimensions of the sub-areas can be selected as necessary to achieve the desired effect. The greater the dimensions of the sub-areas in the axial direction, the faster the diffractive colours will appear to move along the device. In preferred examples, sub-areas with axial lengths of the order of 1 to 2 mm have been found to produce good results.

The direction of the apparent motion will correspond to the direction along which the various sub-areas 16*a* to 16*e* are arranged. In the present examples this is parallel to the y-axis (as is preferred) but different orientations are also envisaged. The sense of motion along the chosen direction can be reversed by reversing the sequence in which the sub-areas are arranged. For example, in each of the embodiments of FIGS. 3, 4 and 5 the sub-areas 16*a*, 16*b*, 16*c*, 16*d* and 16*e* are arranged in that order in the +y axis direction. If the same sub-areas (with the same relief parameters are described above) are now arranged in the same order but in the −y axis direction, the direction of apparent motion will be reversed.

Figure 6A:
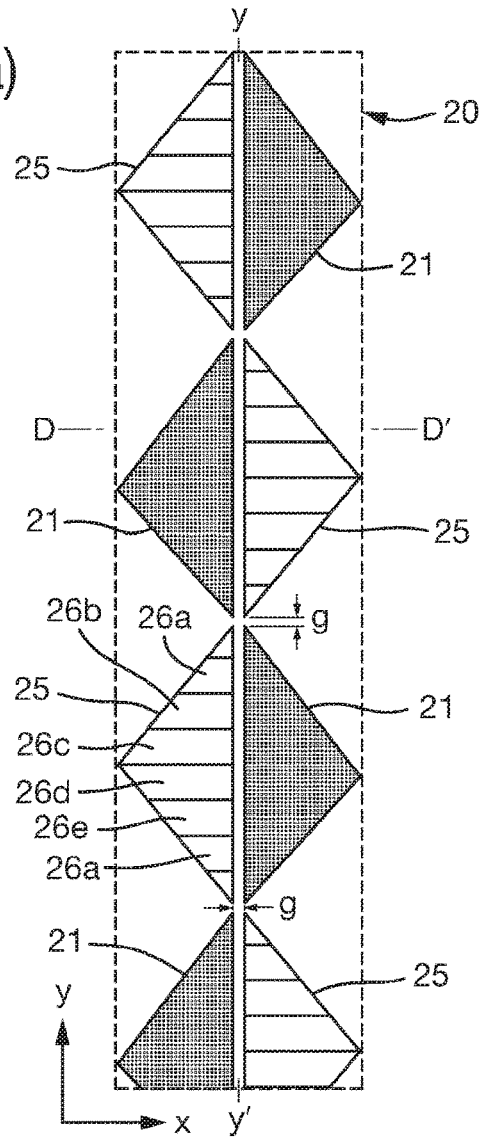
FIG. 6 shows a security element in accordance with a second embodiment of the invention, in (a) plan view and (b) cross-section.

FIG. 6 shows a second embodiment of a security element 20 in which an iridescent amplitude interference device 21 is integrated yet further with a diffractive or reflective relief device 25 of the sort discussed above by arranging the two devices according to respective patterns which are registered with one another and alternate with one another along a straight line, here the axial direction (y-axis) of the element 20, from one side of the axis to the other, such that the two optically variable effects appear interlocked or interwoven with one another.

The extent of the security element 20 is depicted in FIG. 6 by the outermost dashed-line rectangle. An iridescent amplitude interference device is arranged according to a first pattern of elements or partial areas 21 (collectively forming a first area), comprising a series of triangles positioned on alternating sides of the straight line Y-Y' defining the long axis of the element 20. As before the iridescent amplitude interference device comprises a colourshift material such as liquid crystal film or pigmented coating or similar and exhibits a change from a first colour to a second colour upon tilting the device in the axial direction (y-axis). A second pattern of elements or partial areas 25 defines the extent of the diffractive or reflective relief device (i.e. collectively forming a second area) and again in this example this comprises a series of triangular elements arranged on alternating sides of the line Y-Y' along the axis. The first and second patterns are arranged to interweave with one another such that at a first position along the y-axis, an element of the iridescent amplitude interference device 21 will be on the left side of the line Y-Y' and an element of the diffractive or reflective device 25 on the right side (e.g. as is the case at the line marked D-D'), and at another position along the axis, the reverse will be the case. By alternating the two devices from one side to the other along the axis in this way, such that the two optically variable effects appear interlocked, it is not possible for a counterfeiter to imitate the appearance by positioning two separate devices (e.g. a colourshift foil and a holographic foil) alongside one another or superimposed on one another. In this example the visual integration of the two patterns is increased still further by configuring the two patterns to be mirror images of one another, reflected about the axial direction Y-Y'.

The areas of the security element 20 outside the two patterns 21, 25 are preferably optically invariable, i.e. neither optically variable effect is strongly apparent in these regions, and may advantageously be transparent. Such "gaps" in the optically variable effects assist in demonstrating the register between the two patterns, and therefore act as a further obstacle to counterfeiters since they must also be able to achieve register in order to produce an imitation. This is particularly the case where the patterns are arranged so as to include one or more gaps between elements of the first pattern and elements of the second which are smaller than is generally achievable without a registered production process. For example, in the FIG. 6 embodiment, some of the smallest gaps between elements of the two patterns are labelled "g" and it is preferred that at least some of these are arranged to be less than 1 mm, more preferably between 0.1 and 0.4 mm, wide.

Figure 6B:
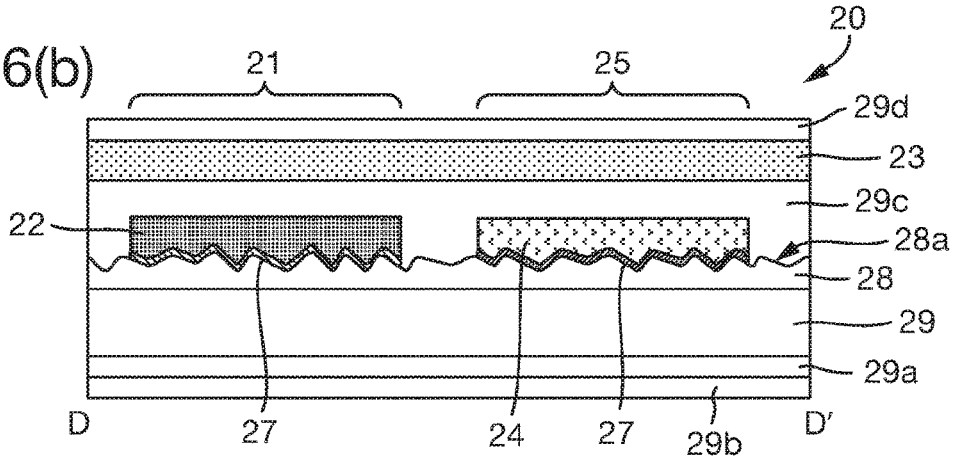

FIG. 6*b* shows a preferred construction of the element 20 in cross-section along the line D-D'. As in the first embodiment, a substrate 29 is provided with a lacquer 28 in which a diffractive or reflective relief structure 28*a* is formed. A reflection enhancing layer 27 such as a metal or alloy is deposited across the relief structure, e.g. by vacuum deposition. In either order, two resist materials 22 and 24 are applied onto the reflection enhancing layer in accordance with the first and second patterns 21, 25 respectively. The resist material 22 is a light absorbing resist and is preferably visually dark in colour, e.g. black ink. The resist material 24 is transparent although need not be colourless (e.g. it may carry a coloured tint). Preferably, each of the resists is applied by a printing process and most preferably the two printed workings are applied in the same in-line printing process in order to achieve accurate register between them. Additionally or alternatively, once the first resist 22 or 24 has been laid down, its position may be optically detected and used to align application of the second resist accordingly, e.g. using a camera providing its input to the control system of the application process for the second resist. If the light absorbing resist 22 (e.g. black ink) is laid down first, its location can be detected using standard imaging techniques, since it will present a high visual contrast against the rest of the element. If the transparent resist 24 is laid down first, it is preferred that the transparent resist contains a coloured tint and/or a machine-detectable substance such as a fluorescent dye in order that its position can be detected. It should be noted that in place of using a light absorbing resist 22, the transparent resist 24 could be laid down at the location indicated by light absorbing resist 22 and covered with a light absorbing material which does not require etch-resistant properties, with the same resulting visual effect. This variant also applies to all embodiments described below.

The structure is then subjected to etching or an equivalent process whereby the reflection enhancing material 27 is removed in any regions where it is not covered by either resist material 22 or 24. For example, where the reflection enhancing material is a metal or alloy, the printed structure may be passed through a metal etchant solution to remove the metal coating in the areas unprotected by either resist. For aluminium, a strong alkali solution such as NaOH solution may be used as the etchant, and for metals such as copper an acid etchant would be used.

Over both patterns, a non-opaque layer 23 containing an iridescent amplitude interference material is applied and as in the FIG. 2 example this may be by laminating a foil via a lamination adhesive 29*c*, or by printing for example. The structure may be completed by providing an optional mask layer 29*a* and adhesive layers 29*c*, 29*d* on either side of the element for affixing the element to the security document.

In the regions of the dark, light absorbing resist 22, the underlying reflective or diffractive relief device is concealed and the effect of the iridescent amplitude interference material enhanced. In contrast, where the transparent resist 24 is provided, the diffractive or reflective optically variable effect of the relief structure 18 is displayed and the colourshift effect of the interference material hidden. In the intervening areas between the resists 22 and 24, the removal of the reflection enhancing layer results in the relief structure 18*a* being locally "indexed-out" by contact between the adhesive 29*c* and lacquer 28 (which will generally be of substantially the same refractive index), such that little or no diffractive or reflective effect is visible. Likewise, the colourshift effect of iridescent amplitude interference layer 23 will be substantially hidden due to the absence of the light absorbing resist material 22. This technique results in high register between the two optically variable effects which will be extremely difficult to replicate using conventional means.

The diffractive or reflective relief structure 28*a* is formed of multiple sub-areas 26*a*, 26*b*, 26*c* etc., in the same way as described above with reference to FIGS. 2, 3 and 4. In this case, the sub-areas are all of equal length in the axial direction but vary in their shape and transverse size such that groups of eight sub-areas collectively define each triangle element of pattern 25. Thus, the size and shape of the sub-areas varies cyclically along the axial direction of the element which further emphasises the cyclical nature of the diffractive or reflective device. It is preferred that the cycle of the sub-areas' shape and size is the same (in terms of repeat length) as that of the relief parameters, but this is not essential.

It should further be noted that whilst it is preferred that the diffractive or reflective relief device 25 in the second embodiment is a cyclical device of the sort described with reference to any of FIGS. 2 to 5 above, this is not essential and any other diffractive or reflective relief device could be used in its place. The same applies to each of the embodiments described below.

It should also be appreciated that alternative structures could be employed to achieve the same visual effects as that shown in FIG. 6(*a*). For example, the reflection enhancing layer 27 could comprise a metallic ink or similar which is laid down by a selective process such as printing and is applied only to the region 25. In this case the transparent material 24 may be omitted since no etching step is required. The light-absorbing material 22 also need not possess resist qualities and can be applied alongside the reflection enhancing material onto the relief 28*a*. The relief 28*a* and/or lacquer 28 also need not extend outside region 25 if desired, with the light-absorbing material being applied instead to substrate 29. Examples of alternative structures will be discussed with reference to FIG. 23.

FIGS. 7 to 10 show four further embodiments of security elements based on the same principles as that of the FIG. 6 embodiment and providing similar benefits. In each case, in preferred embodiments a cross section through the respective element would appear substantially the same as that shown in FIG. 6*b*, and substantially the same manufacturing process can be applied, with the adoption of different patterns as necessary. However, the security elements can alternatively be manufactured by different techniques as indicated above.

Figure 7:
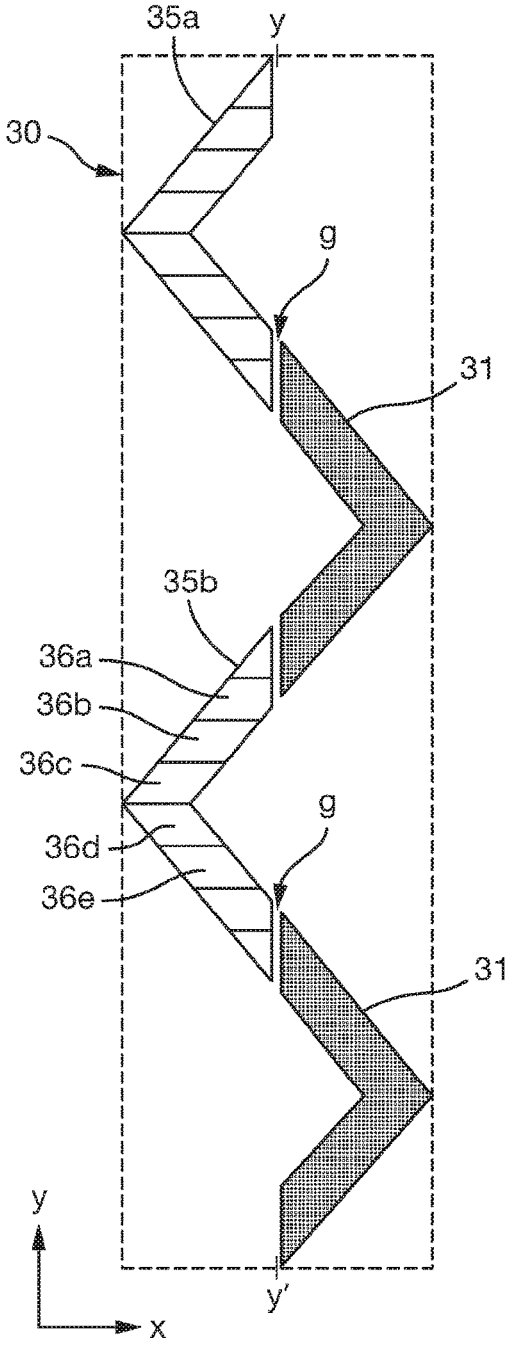
FIGS. 7 and 8 show security elements in accordance with third and fourth embodiments of the invention, respectively, in plan view.

In the third embodiment, shown in FIG. 7, the security element 30 carries a first pattern of chevron-shaped elements 31 on the right side of straight axis Y-Y' having their apexes pointing towards the right of the element, and a second pattern of matching chevron-shaped elements 35 (incorporating elements 35*a* and 35*b*) on the left side of the axis Y-Y' facing in the opposite direction. The two patterns are displaced from one another along the axis such that the overall impression is of a single, substantially continuous "zig zag" line element passing from one side of the axis to the other and back along the axial direction of the element. The first pattern of elements 31 defines an iridescent amplitude interference device and exhibits a colour shift effect, whilst the second pattern of elements 35 displays a cyclical diffractive or reflective relief device formed of a series of sub-areas 36*a*, 36*b* . . . as before. In a preferred construction, the two patterns 31, 35 are defined by regions of light absorbing resist and transparent resist respectively, as in the previous embodiment. Between elements of the first pattern and elements of the second pattern are gaps g which are preferably 1 mm or smaller, in order to demonstrate high register. In a preferred embodiment, the sub-areas 36*a* to 36*e* are arranged in the same order in each of the elements 35 making up the second pattern, in which case the apparent direction of motion exhibited by the cyclical diffractive or reflective relief device will be the same in each section of the security device. However in other cases the direction could be reversed in different sections. For example, upon tilting in one direction the element 35*a* could exhibit movement in the +y axis direction (Y' towards Y), whilst the element 35*b* exhibits movement in the −y axis direction (Y towards Y'), or vice versa. In still further cases the sub-areas 36*a* to 36*e* could be designed so that they are arranged not along the y-axis (as shown) but rather along a direction parallel to each "arm" of the chevon (i.e. at approximately 45 degrees to the y-axis), so that the movement effect occurs along each of these different directions in each different section of the device simultaneously.

Figure 8:
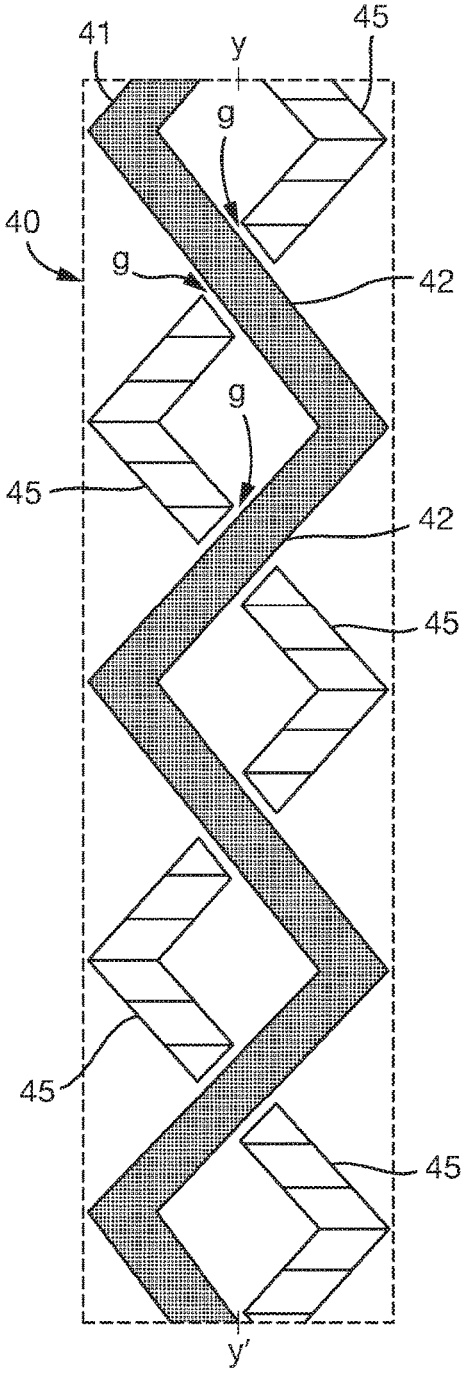

In a fourth embodiment, shown in FIG. 8, the security element 40 is provided with a first pattern defined by a single continuous "zig zag" element 41, exhibiting a colour shift effect, and a second pattern defined by multiple elements 45 in which a cyclical diffractive or reflective relief device is visible as in previous embodiments. Each element of the second pattern 45 is formed as an "L" shape and positioned on alternating sides of the first pattern element 41 so as to give the overall visual impression of a second continuous "zig zag" element positioned behind the first. The two devices therefore alternate with one another from left to right across the straight axis Y-Y' along the axial direction such that the two optically variable effects appear interlocked. Difficulty in producing a counterfeit version is further enhanced by arranging for at least one of the patterns (here the first pattern 41) to include portions 42 which cross over the axial line thereby further unifying the visual impression of the device as a whole and increasing the demands on the counterfeiter. Between elements of the first pattern and elements of the second pattern are gaps g which are preferably 1 mm or smaller, in order to demonstrate high register. As in the case of the FIG. 7 embodiment, the movement direction of each element forming the second pattern 45 is preferably the same but this is not essential.

FIG. 9*a* shows a fifth embodiment of a security element 50 alongside templates which depict the corresponding light absorbing resist areas (FIG. 9*b*) and transparent resist areas (FIG. 9*c*) according to which the relief structure is printed in a preferred construction. As shown in FIG. 9*a*, the finished element appears as two intertwining sinusoidal ribbons, one of which exhibits an iridescent amplitude interference colourshift effect (elements 51) and the other of which exhibits a cyclical diffractive or reflective relief device (elements 55). Each of the patterns is made up of a series of pattern elements each having the form of a nearly-complete single wavelength of the sinusoidal wave. FIG. 9*b* shows the first pattern elements 51 according to which the light absorbing resist is applied, and FIG. 9*c* shows the second pattern elements 54 according to which the transparent resist is applied. The two sets of elements are substantially identical in shape to one another, one being translated along the axial direction relative to the other such that they are out of phase and thus alternate with one another along the axial direction such that the two optically variable effects appear interlocked. Each of the elements includes a location 51*a*, 55*a* at which the element crosses over the axis Y-Y' of the element. Within each pattern, the ends of each element are positioned to allow an element of the other pattern to fit between them, leaving a gap g on each side between the elements of the two patterns. Preferably the gaps g are sized to be 1 mm or less in width, in order to demonstrate high register. As in the case of the FIGS. 7 and 8 embodiments, the movement direction of each element forming the second pattern 55 is preferably the same but this is not essential.

In this example, the first pattern 51 is also provided with negative indicia 53 defined within each pattern element. This is achieved by leaving gaps corresponding to the desired indicia in the applied light absorbing resist. If no transparent resist is present in this region, this results in the reflection enhancing layer on the underlying relief structure being removed in accordance with the indicia such that the indicia are visible against their (preferably opaque) surroundings when the element is viewed in transmission against a backlight. Negative patterns or indicia such as this can in practice be provided within elements of either or both patterns 51, 53. Further examples of such structures will be given below.

A sixth embodiment of a security element 60 is shown in FIG. 10*a* and is of similar construction to that of FIG. 9, having a first pattern of elements 61 (also shown in FIG. 10*b*), configured to give the appearance of sections of two interlocking ribbons, one of which comprises solid elements and the other is provided with negative pattern 63 (here, a series of circles). The first pattern elements 61 carry light absorbing resist and hence exhibit a colour shift effect. A second pattern of elements 65, corresponding to the transparent resist regions 64 shown in FIG. 10*c* and hence displaying a diffractive or reflective relief effect, is configured to provide the missing sections of the two ribbons. Again the diffractive or reflective relief is preferably cyclical as previously discussed. Each pattern element 61, 65 crosses over the straight axis Y-Y' at least once at locations 61*a*, 65*a*, and the two optical effects alternate with one another from side to side along the axis as before. Gaps g are provided between the elements of each pattern and are preferably 1 mm or less in width. As in the case of the FIGS. 7 to 9 embodiments, the movement direction of each element forming the second pattern 65 is preferably the same but this is not essential.

In all of the embodiments of FIGS. 7 to 10, the transparent resist could be omitted if the reflection enhancing layer is laid down in a selective manner so as to define the elements of the diffractive/reflective pattern itself, e.g. by printing of a metallic ink, in which case no etching step is required. In such implementations, the pattern elements shown in FIGS. 9(*c*) and 10(*c*) correspond to the areas in which the reflection enhancing material is applied.

FIGS. 11*a* and 11*b* provide two further examples of security elements according to seventh and eighth embodiments of the present invention, in which the pattern elements have the form of symbols, specifically alphanumeric characters. In both cases, dark shaded characters represent elements of a first pattern 71, 71' in which an iridescent amplitude interference material is visible, and light shaded characters represent elements of a second pattern 75, 75' in which a diffractive or reflective relief device is exhibited. Again, the patterns can preferably be formed through the selective application of light absorbing and transparent resists as previously discussed with respect to FIG. 6*b*.

In the FIG. 11*a* embodiment, first pattern elements 71 and second pattern elements 75 each constitute a set of elements of the number "5" of cyclically varying size. After each cycle repeat, the two patterns alternate from one side of axis Y-Y' to the other such that the two optically variable effects appear interlocked. Where the diffractive or reflective relief device is cyclical (as in the FIG. 2 embodiment), each individual pattern element "5" could comprise multiple sub-areas, e.g. in the form of bands perpendicular to the axial direction as before. Alternatively, each pattern element could correspond to a single sub-area 76*a*, 76*b*, 76*c* . . . of the appropriate size and shape. Thus, the sub-areas are spaced from one another and vary cyclically in size. The cyclical repeat period of the sub-areas' shape and/or size preferably corresponds to that of the relief parameters (and hence diffracted colour/reflected intensity variation), but this is not essential.

In the FIG. 11*b* example, again the first and second pattern elements 71', 75' comprise alphanumeric characters. In this case the sequence of characters is continuous along the element, corresponding to the English alphabet, but the first and second patterns alternate along the device so that some letters of each sequence exhibit the colour shift effect (letters 71') whereas others exhibit the diffractive or reflective relief effect (letters 75') such that the two optically variable effects appear interlocked. Again, where the diffractive or reflective relief device is cyclical (as in the FIG. 2 embodiment), each individual letter 76*a*', 76*b*', 76*c*' . . . preferably corresponds to a single sub-area of the relief pattern.

FIGS. 12*a* and 12*b* show two variants of the above embodiments. Again, in these examples the first and second pattern elements 81, 81', 85 and 85' comprise alphanumeric characters, here the numbers "1, 2, 3, 4". In the FIG. 12*a* embodiment, each of the cycle repeats comprises is arranged in the same direction, i.e. in the Y to Y' direction, so that here the element reads "1, 2, 3, 4, 1, 2, 3, 4 . . . " and so on along the axis of the element. As before, the first and second patterns 81, 85 alternate with one another along the device from one side to the other so that the two optically variable effects appear interlocked. Where the diffractive or reflective relief device is cyclical (as in the FIG. 2 embodiment), each individual number 86*a*, 86*b*, 86*c*, 86*d* preferably corresponds to a single sub-area of the relief pattern. In this embodiment it is desirable that within each cyclic repeat the sub-areas are arranged in the same order so that the change in appearance of the element occurs in the same direction simultaneously throughout the device, e.g. in the Y to Y' direction as illustrated by the arrows in FIG. 12*a*. Optionally, the security device 80 may be incorporated into a security document in a registered manner, e.g. so that the security device 80 is revealed in windows of the document and concealed in other areas (represented by shaded regions 89 in FIG. 12*a*) in such a way that a predetermined number of pattern elements or cyclical repeats is visible within each window. In this example, the security device 80 is arranged relative to the windows in such a way that all of the pattern elements making up each cyclical repeat are visible in any one window which is preferred but not essential.

FIG. 12*b* shows a variation in which the arrangement of the elements of both patterns 81', 85' is reversed in neighbouring cycles along the security device 80'. Hence in this example, the device reads "1, 2, 3, 4, 4, 3, 2, 1, 1, 2, 3, 4 . . . " and so on in the Y to Y' direction along the device. In this case it is preferred if the apparent movement imparted by the cyclical diffractive or reflective relief device also reverse direction in each region so as to complement the arrangement of elements. Thus, for example, when the device is tilted in one direction, in on repeat cycle "1, 2, 3, 4", the movement will be in the Y to Y' direction, whilst simultaneously in the neighbouring repeat cycle "4, 3, 2, 1", the movement will be in the opposite (Y' to Y) direction. As such, the movement in neighbouring regions will appear to move towards or away from one another, as illustrated by the arrows in FIG. 12*b*. It will be appreciated that both directions of movement are regarded as being "along" the same predetermined direction (i.e. the long axis of the security device, in this example), albeit in opposite senses. Again, optionally the security device may be incorporated into a security document in a registered manner such that portions of the device are visible in windows defined between areas 89' where the device is concealed by the document. Preferably the registration is such that the different movement directions exhibited by the cyclical diffractive or reflective relief are located in different windows.

A ninth embodiment of a security element is shown in FIG. 13, of which FIG. 13*a* shows a plan view of the element 90, FIG. 13*b* shows an enlarged detail thereof, and FIG. 13*c* shows a cross-section through a preferred construction of the element along the line E-E'. As depicted in FIG. 13*a*, the layout of the element 90 is similar to that of the second embodiment shown in FIG. 6, there being provided a first pattern 91 of triangular elements in which an iridescent amplitude interference device is exhibited, and a second pattern 95 in which a cyclical diffractive or reflective relief device made up of multiple sub-areas 96 (as previously described) is disposed. The two patterns alternate with one another from one side to the other of straight axis Y-Y' along the axial direction such that the two optically variable effects appear interlocked. However, in this case the first pattern 91 additionally comprises a region of half-tone or screened elements 91*a* (i.e. partial areas of the region to which the light-absorbing material has been applied), which are not individually discernible from a normal viewing distance but are illustrated in the enlarged detail of FIG. 13*b*. Each half-tone or screened element exhibits the colourshift effect of the iridescent amplitude interference material as in the pattern elements 91, resulting in the overall appearance of a semi-transparent colourshift effect across the half-tone or screened region as a whole. The half-tone or screened regions in this example coincide (i.e. wholly overlap) with the elements of the second pattern 95 which remains visible between the partial areas 91*a* carrying the light-absorbing material, such that the colourshift effect appears superimposed on the diffractive or reflective relief effect. This visually integrates the two devices and cannot be reproduced by the grafting together of two separate devices.

A cross-section through a preferred construction of the element 90 is shown in FIG. 13*c* and, as in previous embodiments, a substrate 99 is provided with a lacquer 98 in which a diffractive or reflective relief 98*a* is formed. A reflection enhancing material 97 is deposited onto the relief. In either order, a light absorbing resist material 92 and a transparent resist material 94 are applied to the relief in accordance with the desired patterns and in register with one another, e.g. by printing. In the example depicted, the transparent resist 94 is applied first, followed by light absorbing (e.g. black) resist 92 which is applied continuously to form triangular pattern elements 91 and in accordance with a half-tone or screened pattern of elements 91*a* over the transparent resist 94 across the triangle pattern elements 95. In other cases the same result can be achieved by applying the resists in the reverse order. The printed relief is then subjected to etching or another process whereby the reflection enhancing material 97 is removed from areas of the relief 98*a* which are not covered by either resist. A layer containing iridescent amplitude interference material 93 is then applied over the two resists and as before this may be achieved by lamination of a suitable foil via a lamination adhesive 99*c*, or by printing for example. The element is completed with an optional mask layer 99*a* and one or more adhesive layers 99*b*, 99*d* as appropriate.

In the regions of the triangular pattern elements 91, the light absorbing resist 92 absorbs stray reflected light, amplifying the optically variable effect of the iridescent amplitude interference layer 93 which dominates the appearance. In the regions of the pattern elements 95, the optically variable effect of the diffractive or reflective relief structure 98*a* is visible but its appearance is modified by the half tone or screened pattern of elements 91*a* which superimpose the effect of iridescent amplitude interference material 93 on top of the diffractive or reflective effect. Thus, regions 95 exhibit both optical effects.

The elements 91*a* making up the half-tone or screen pattern can be of any shape, e.g. dots, lines, symbols, characters, alphanumeric text etc., and can be positive (i.e. defined by the presence of the light absorbing resist) or negative (i.e. defined by its absence). Typically the elements are arranged according to a regular grid, such as an orthogonal or hexagonal grid. The size of the individual elements 91*a* can be selected according to the desired effect. For example, if a visually smooth appearance is desired, the individual elements will be sized so that they are not distinguishable by the unaided eye and may for instance have dimensions of the order of 50 to 100 microns. Alternatively a more "pixelated" appearance may be desirable in which case the individual elements could have dimensions around 0.5 mm. The pattern density of the half-tone or screened pattern (i.e. the spatial proportion of the region occupied by the light absorbing resist) in the present example is constant across the region at approximately 25%, but in other embodiments may be arranged to vary, optionally so as to incorporate further information such as an image into the security element.

An example of this is shown in FIG. 14, which depicts a variant of the FIG. 13 security element. In this example, the transparent resist 94 has been deposited across both triangular pattern elements 91 and 95, followed by a light absorbing material 92 (which need not be a resist) in accordance with a half-tone or screened pattern which varies in pattern density in a stepwise manner between four parts of the region, $R_1$, $R_2$, $R_3$ and $R_4$. It will be appreciated that the same result will be achieved if the transparent and light absorbing materials 94, 95 are applied in the reverse order. In the first part $R_1$, the density of the half-tone or screened pattern is 100% meaning that the underlying diffractive or reflective relief device is wholly concealed and the region exhibits the same optical effect as that of the triangles 91 in the FIG. 13 variant. In the second part $R_2$, the light-absorbing material is applied in partial areas of the region so as to define negative half-tone or screen elements 91*a* (i.e. gaps in the light-absorbing material), which decrease the pattern density to e.g. 75%, such that the underlying relief device is visible to a degree. In the third part $R_3$, the light absorbing partial areas define positive half-tone or screen elements 91*a* and the pattern density is decreased further to e.g. 25%, such that the optical effect of the underlying relief device is revealed yet further but the colourshift effect of the iridescent amplitude interference material remains superimposed across the region. In the fourth part $R_4$, no light absorbing material is provided, equivalent to a pattern density of 0%, such that only the effect of the relief device is visible. The result is a stepwise change from one optical effect to the other along the x-axis of the element, which further enhances visual integration between the two devices. Along the device, the position of the four parts $R_1$ to $R_4$ will preferably be reversed from left to right across the axis for each repeat of the triangular pattern elements so as to retain the interlocking appearance.

The effect can be rendered more gradual either by increasing the number of steps between parts $R_1$ and $R_4$, or by applying a continuous change in pattern density between the same parts. For example, FIG. 15 shows a tenth embodiment of a security element 100 with a half-tone pattern having a gradual change in pattern density from 100% to 0%. FIG. 15*a* shows the complete security element in plan view, whilst FIG. 15*b* shows the regions of the element which are printed with light absorbing resist and FIG. 15*c* shows the regions of the element which are printed with transparent resist. In this example the pattern elements 101 of the first pattern in which the iridescent amplitude interference effect is visible and the pattern elements 105 of the second pattern in which the underlying diffractive or reflective relief device is visible are all aligned with one another along the axial direction y of the element 100, in an alternating manner. In areas 101, the light absorbing resist is applied as a contiguous layer (equivalent to a half-tone or screen pattern with a density of 100%) such that only the iridescent amplitude interference effect is visible. In the areas 105, the light absorbing resist is absent (equivalent to a half-tone or screen pattern with a density of 0%, labelled as area 101*a* in FIG. 15*b*) such that only the diffractive or reflective relief effect is visible. In the intervening regions 103, the light absorbing resist is applied to partial areas in accordance with a half-tone or screen pattern with a density of more than 0% and less than 100%, which varies continuously across the region from close to 100% adjacent element 101 to nearly 0% adjacent area 105. Thus both optical effects are visible in region 103 to a greater or lesser extent depending on the pattern density. It will be appreciated that it is not essential to provide regions of 100% or 0% pattern density: if desired an intermediate half tone pattern (optionally of varying density) could be provided alone, such that the two optically variable effects are superimposed on one another across the device. Preferred screen densities are between 5 and 85%, more preferably between 10 and 60%, most preferably between 20 and 35%. It should also be appreciated that the screen patterns do not have to be regular and an array of screen elements could be used to produce a complex half-tone image, for example a portrait. In this scenario the visibility of the two optically variable effects will vary across the image in a complex manner increasing the difficulty in counterfeiting the device.

As in previous embodiments, the described half-tone or screened effect can also be achieved through alternative manufacturing techniques and structures, as will be described below with reference to FIG. 24.

It will be noted in the FIG. 15 example that the transparent resist is also applied in the form of a series of elements 106 spaced along the axial direction by gaps 106*a* as shown in FIG. 15*c*. This is not essential and the transparent resist could be continuous along the element and the above-described effects will still be achieved. However in this example, the areas 101 and 105 each carry negative indicia 107 and 108 respectively, which here take the form of the letters "DLR". The provision of gaps 106*a* in the transparent resist assists in the manufacture of the negative indicia 107 since the transparent resist must be absent within the letters "DLR" in order for the underlying reflection enhancing layer to be removed (e.g. by etching) and hence achieve the desired transparent effect. This could be achieved by printing the transparent resist elements 106 so as to include the appropriate indicia shaped gaps, but this would demand extremely high registration between the two resist materials which may not be achievable in practice. By providing gap 106*a* surrounding the region in which negative indicia 107 are to be formed, the registration requirements are reduced to an acceptable level, still greater than that readily achievable by counterfeiters. Negative indicia 108 meanwhile are formed only in the transparent resist 106 and will be exposed by gaps 101*a* in the light absorbing resist layer. It should be noted that in this example, as in other embodiments, the two resists could be printed onto the security element in either order, with the same result.

Further examples of security elements with negative indicia are shown in FIGS. 16 and 17. In the eleventh embodiment of FIG. 16, the construction of the element 110 is similar to that of the second embodiment shown in FIG. 6. An iridescent amplitude interference effect is exhibited by a first area 111 of the element and a cyclical diffractive or reflective relief effect by second area 115, which in this example is semi-transparent as discussed below. At intervals along the axial direction, negative indicia 116 are provided within the first area 111, here taking the form of the letters "DLR".

Figure 16A:
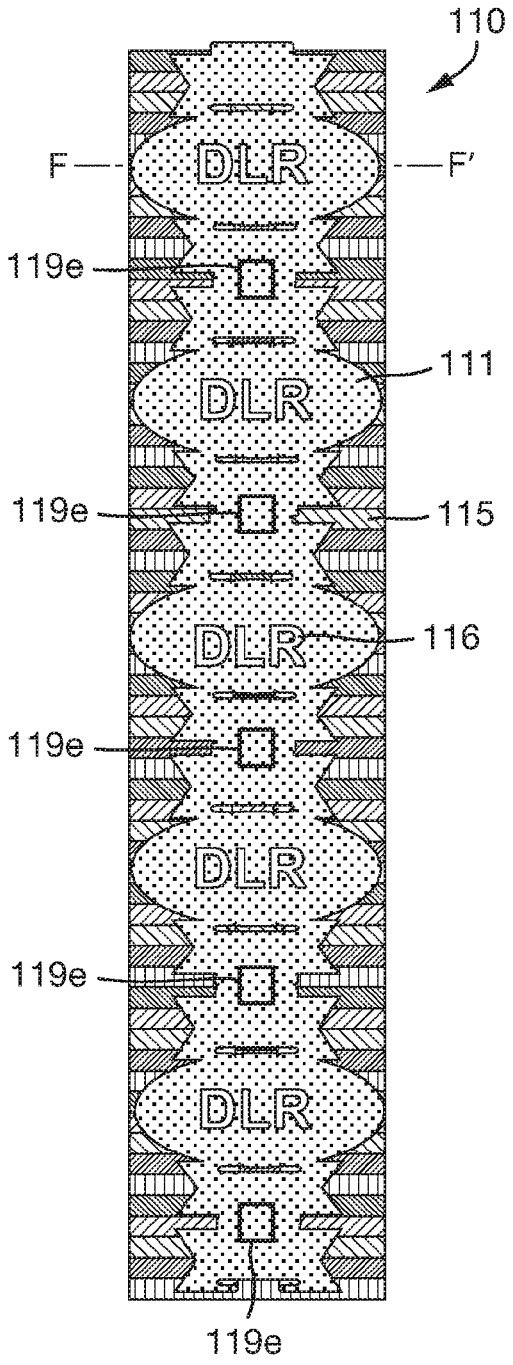
Figure 16B:
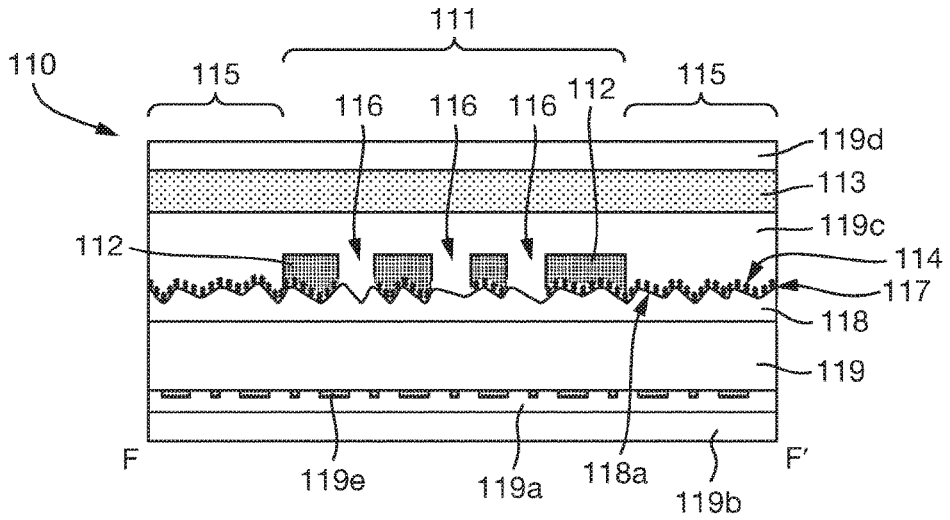

As shown in FIG. 16*b*, which is a cross section along the line F-F', the element 110 comprises a substrate 119 on which is provided a lacquer layer 118 having a diffractive or reflective relief structure 118*a* formed in its surface. A reflection enhancing material 117 is deposited onto the relief. A transparent resist 114 is applied onto the reflection enhancing material, which in contrast to previous embodiments, is arranged in accordance with a half-tone or screen pattern. Within the half-tone or screen pattern are included regions in which the pattern is absent which correspond to the desired negative indicia 116. A light absorbing resist 112 is then applied which includes the same gaps and is deposited in register with the transparent resist such that both resists are absent in the negative indicia regions 116. The printed structure is then subjected to etching or another process by which the reflection enhancing material 117 is removed in all regions where it is not covered by either resist. This results in the formation of negative indicia 116 in which neither optically variable effect will be exhibited, and additionally transfers the half-tone or screen pattern of the transparent resist 114 to the reflection enhancing material. This renders the reflection enhancing layer semi-transparent such that objects underlying the element 110 can be viewed through the element (assuming that the other layers of the element are also at least semi-transparent). For instance this may be desirable where the element 110 is to be placed over printed information or the like on a security document which is not to be wholly concealed by the element, or if the element is to be arranged in a window feature of a security document. It should be noted that the reflection enhancing layer could be made semi-transparent in this way in any of the other embodiments disclosed herein. The half-tone or screen according to which the reflection enhancing material is arranged could be of continuous density across the device or could vary, e.g. to exhibit a gradient or image whereby the diffractive or reflective effect will be visible to a greater or lesser degree depending on the density. In further variants, the reflection enhancing layer could alternatively be made semi-transparent by applying a continuous layer which is sufficiently thin so as not to wholly reflect incident light.

After etching, an iridescent amplitude interference layer 113 is provided in the same way as in previous embodiments, optionally via a lamination adhesive 119*c*. In this example, the element is further provided with a layer 119*a* which contains a substance such as a coloured tint, a fluorescent pigment, a luminescent pigment, a thermochromic pigment or the like, which is visible at least in the negative indicia 116 when the element is viewed in transmission, optionally under non-standard illumination (e.g. UV), depending on the substance in question. Another optional feature is the provision of a magnetic layer 119*e*, such as a printed magnetic ink, which is preferably applied in the form of a coding. Since magnetic inks are typically dark in colour, in this example it is preferred that the magnetic regions are only provided in locations which are covered by the light absorbing resist 112, such that the presence of the magnetic material is concealed and the transparent nature of the negative indicia is not inhibited. For example the magnetic regions 119*e* could be located in the intervals between the negative indicia 116 as shown in FIG. 16*a*. Dark magnetic inks can also be concealed behind a metal layer and therefore in other embodiments where the reflective layer 117 is not semi-transparent, such magnetic features could also or alternatively be arranged in the regions of transparent resist. In general, the only requirement is not to position dark magnetic features in the same regions as the negative indicia 116. As mentioned earlier this can be automatically achieved by using a magnetic resist to form layer 112 (in which case layer 119*e* could be omitted). It will be appreciated that layers such as 119*a* and 119*e* could be incorporated into any of the other embodiments of security element described herein. The security element is completed with adhesive layers 119*b* and 119*d*.

Figure 17B:
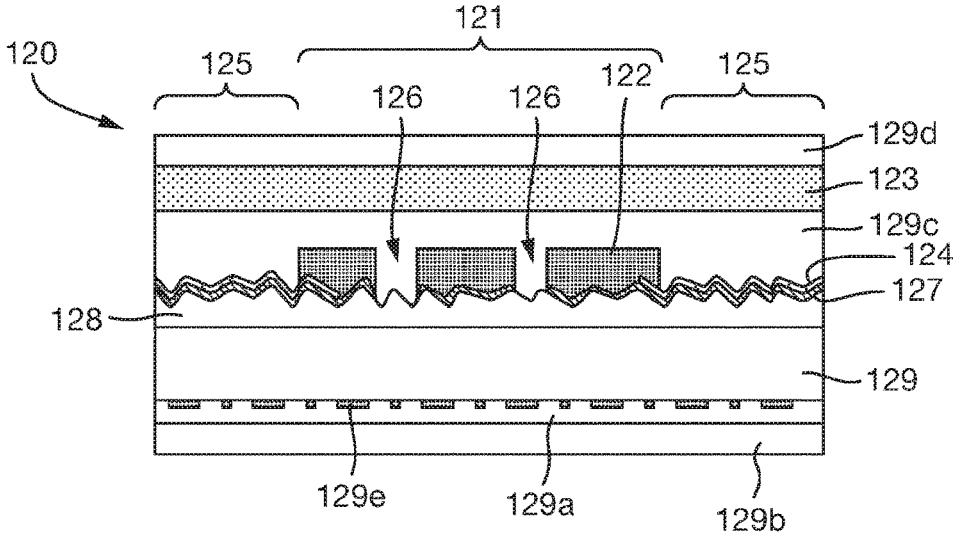

The twelfth embodiment of a security element 120, shown in FIG. 17, is of substantially the same construction and includes a first area 121 in which an iridescent amplitude interference effect is exhibited and a second area 125 in which the optically variable effect of an underlying diffractive or reflective relief is visible. Negative indicia 126, here in the form of "scroll" symbols, are provided in the first area. As shown in the cross-section along line G-G' (FIG. 17*b*), in this case the negative indicia 126 are defined solely by corresponding gaps in the light absorbing resist 122, and the transparent resist is absent across a region surrounding the negative indicia although preferably there is still some overlap between the two resists. As in the case of the FIG. 15 embodiment, this approach reduces the registration demands on the manufacturing process as compared with the FIG. 16 embodiment. The transparent resist is applied as a continuous layer elsewhere such that the diffractive or reflective relief effect is strongly displayed across area 125. In other respects the structure of the element is the same as discussed in relation to the FIG. 16 embodiment. The metal layer 127 conceals the underlying magnetic layer 129*c* which may therefore be present at any locations outside the negative indicia 126.

Further examples of embodiments with magnetic features will be provided below with reference to FIGS. 21 and 22.

Figure 18B:
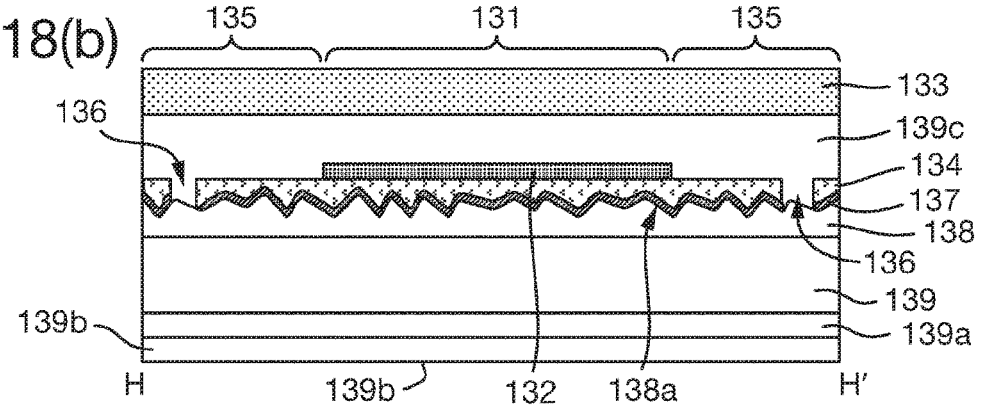

In the examples so far, negative indicia have generally been provided within the first area, in which the iridescent amplitude interference effect is visible. However such negative indicia or patterns can also be provided in the region of the diffractive or reflective relief structure, e.g. appearing as demetallised patterns in the relief effect. Similarly, negative indicia or patterns can be arranged in both areas, or so as to overlap a transition from one area to the other. FIG. 18 shows an example of a security element 130 in accordance with a thirteenth embodiment in which a negative pattern or demetalisation 136 is provided in the second area 135 where the relief effect is exhibited. As shown in the cross-section along line H-H' (FIG. 18*b*), the structure of the element 130 is substantially the same as that of previous embodiments, with a relief structure 138*a* being formed on a lacquer layer supported by substrate 139. A reflection enhancing layer 137 is deposited across the relief followed by transparent resist 134, arranged so as to define negative indicia 136. A light absorbing resist 132 is applied over the transparent resist 134 so as to define the first area 131 of the element in which the iridescent amplitude interference effect will be visible. The resists could be applied in the reverse order. After etching, a layer 133 containing iridescent amplitude interference material is provided using any of the techniques previously discussed. The element is completed with optional layers which in this case include a layer 139*a* which may act as a mask or carry a substance such as a coloured tint or fluorescent material, and adhesive layer 139*b*.

FIG. 19 shows a further example in accordance with a fourteenth embodiment, in which both the first area, made up of pattern elements 141, and the second area, made up of pattern elements 145, include negative indicia 142, 146 respectively. FIG. 19*a* shows the portions of the element in which light absorbing resist 142 is applied, and FIG. 19*b* shows the portions of the element in which transparent resist 144 is applied. After etching, all regions of the element not covered by either resist will display substantially no optically variable effect. Gaps g are provided between the two patterns and preferably these are less than 1 mm in width in order to demonstrate the high register between the two patterns.

Whilst the provision of gaps between the areas exhibiting each optical effect and/or negative indicia increases the security level of the element and is thus advantageous, it is not essential and hence in some embodiments there may be no requirement for patterning of the reflection enhancing layer (whether by way of etching or selective application processes such as printing). This was the case in the first embodiment where no transparent resist was provided. FIG. 20 shows a further example of a security element according to a fifteenth embodiment in which there is no demetalisation. However in this case a transparent material 154 (which need not be a resist) is applied over the whole of the second area 155 (and optionally also in the first area 151), in order to impart a coloured tint or other optical property carried by the material 154 to the element. For example, where the material 154 contains a visible colour pigment or dye this will modify the diffracted or reflected light from relief 158*a* causing it to take on a tinted appearance. In other cases the material may carry a substance such as a fluorescent or luminescent pigment which is preferably invisible under standard visible illumination and emits when illuminated with a wavelength outside the visible spectrum, e.g. UV. In this case the element would appear identical to that of FIG. 2 under normal illumination but would reveal the presence of luminescent material when examined under appropriate lighting. The rest of the element is constructed in the same manner as in previous embodiments.

It will be appreciated that, in any of the embodiments previously described, the transparent resist could carry a substance of this sort. The transparent resist could also be laid down in more than one portion, with different portions containing different substance(s), or no additives, in order to create a pattern within the transparent resist elements.

Two further embodiments containing magnetic features will now be described with reference to FIGS. 21 and 22. In plan view each element 160, 170 exhibits first and second areas in which an iridescent amplitude interference effect and a diffractive effect, respectively, are displayed, such as the arrangements depicted in any of FIGS. 6 to 12. FIGS. 21 and 22 each show a cross section through the element. It should be noted that in both cases the contours of the relief structures 168*a* and 178*a* are not depicted, but will be present in practice.

In the FIG. 21 embodiment, the security element 160 is of similar construction to that of FIG. 16, with a relief structure 168*a* (not depicted) formed in an embossing lacquer 168 on a substrate 169 such as polyester. The relief 168*a* is coated with a reflection enhancing layer 167 such as metal. A transparent resist 164 and a light absorbing resist 162 are deposited onto the relief in accordance with the desired patterns to form the first and second areas 161, 165 respectively. An iridescent amplitude interference material 163 such as a liquid crystal film covers both areas via a laminating adhesive 169*c*. In practice this may be achieved by forming the liquid crystal film on a second substrate 169' (which again may be polyester) via another layer of laminating adhesive 169*f* and then joining this assembly to the embossed assembly by means of adhesive layer 169*c*. On the other side of substrate 169, a magnetic layer 169*e* is provided and in this example the layer comprises a transparent magnetic material such as Magform™ supplied by De La Rue International Limited and described in WO2009053673A1. This magnetic material is substantially transparent when viewed in transmitted light but can be observed in reflected light from the reverse side of the device. As such the layer 169*e* is preferably applied in the form of indicia such as characters or an image and can extend across gaps in the reflection enhancing layer 167 (e.g. negative indicia) without detriment. If desired, the presence of the layer 169*e* may be concealed fully or partially by the application of a masking coat 166 which may be fluorescent. The element is completed by adhesive layers 169*b* and 169*d* which are preferably provided on both outer surfaces of the element.

The security element 170 shown in FIG. 22 is of substantially the same construction as that of FIG. 21 except from the construction of the magnetic feature. A diffractive relief structure 178*a* is formed on an embossing lacquer 178 carried on a substrate 179 and the layers above the relief are as previously described. On the opposite surface of the substrate 179, magnetic features 179*e* are applied, in this case using a conventional magnetic ink which is typically opaque. Preferably, the magnetic region(s) 179*e* would be applied as tramlines along the two long edges of the element (as shown) or as a series of bars running transversely across the device forming a code. In this example, the presence of the magnetic material is concealed from an observer viewing the element from above by the reflection enhancing layer 177 (e.g. metal). Optionally, a metallic ink layer 179*f* such as silver ink may be provided over the magnetic features to conceal the magnetic material from the rear of the security element. Again, a fluorescent masking material 176 may be provided.

It should be noted that whilst in this example the magnetic material 179*e* is concealed from view, in other cases it could be designed to be visible, e.g. in areas where the metal layer 177 has been removed. Due to the typically dark colour of the material it will act as an absorbing material in the same way as light absorbing material 172 and can thus be used to render the optical effect of the amplitude interference material 173 visible at selected locations.

Indeed, as an alternative to the magnetic constructions in FIGS. 21 and 22, magnetic material (for example $Fe_2O_3$ particles) could be incorporated into a light absorbing resist layer such as 162. The structure would be the same as shown in FIG. 21 but without additional magnetic layer 169*e*.

If the magnetic material is incorporated into the resist it will therefore automatically follow the pattern of the reflection enhancing layer, which allows the magnetic material to be more easily applied in complex patterns without concern over registration to the negative indicia (such as letters 116) and therefore enables more complex coding arrangements.

In the embodiments described so far, the reflection enhancing material generally takes the form of a metal layer which is etched if the material is only to be present in selected regions, with a transparent material being applied to the reflective layer to act as a resist. In other embodiments, the reflection enhancing material may be applied using an inherently selective method such as printing as may be used where the reflection enhancing material is a metallic ink or similar. Generally metallic inks are less preferred than deposited metal layers since the reflected or diffracted replay is typically less intense, but they can still be used to produce an acceptable effect. Some examples of structures making use of selectively-applied reflective materials such as metallic ink will now be described with reference to FIGS. 23 and 24.

FIG. 23(*a*) shows an exemplary security document 1' which here takes the form of a polymer banknote. The document is based on a polymer substrate 189 such as BOPP and carries a printed layer 2' (optionally including an underlying opacifying layer, if the substrate 189 is transparent) across the majority of the document. A security element 180 is applied onto the substrate 189 in a gap formed by the print layer 2', here forming a patch shape. If the substrate 189 is transparent, the security element 180 may appear as a transparent window in the document 1'. However, this is not essential and the substrate could be translucent or opaque, and/or the element 180 could be disposed on top of the print layer 2'.

The security element 180 has substantially the same appearance as the security element 20 shown in FIG. 6 and described previously. Thus, a first set of partial areas 181 correspond to a first pattern of elements and each exhibit an iridescent amplitude interference effect. A second set of partial areas 185 correspond to a second pattern of elements and exhibit a diffractive or reflective optical effect, preferably a cyclical effect as previously described. The two patterns are arranged to interweave with one another along a straight line across the security element 180, which in this example is configured to lie parallel to the y-axis of the security document 1'. It will be appreciated that the arrangement of pattern elements shown is exemplary and any of the arrangements shown in FIGS. 7 to 12 previously could be adopted instead.

FIG. 23(*b*) shows a cross section through the document 1' along the line K-K' according to a first option. As in previous embodiments, an embossing lacquer or cast cure resin 188 is applied to the substrate 189 and a relief structure 188*a* is formed therein. In alternative examples the relief could be formed directly in the surface of substrate 189. In the areas 181, corresponding to the elements of the first pattern, a light-absorbing material 182 is applied to the relief structure, e.g. by printing. In the areas 185 corresponding to the elements of the second pattern, a reflection enhancing material such as a metallic ink is applied and again this may be via a printing process. The two material application steps are performed in either order but in register, preferably in a continuous in-line process, such that the first and second patterns are registered to one another. An optional lamination adhesive 189*a* is applied over the light absorbing and reflection enhancing materials for joining of a layer 183 containing iridescent amplitude interference material as before. Finally a protective layer 189*b* may be applied.

An alternative construction which will also achieve substantially the same appearance is shown in FIG. 23(*c*). Here, the structure is the same as in FIG. 23(*b*) except for those aspects now identified. Firstly, the relief structure 188*a* does not extend across the whole of the element but is only provided in the vicinity of the areas 185 in which the diffractive or reflective effect is to be rendered visible. The reflection enhancing material 187 and hence also the light-absorbing material 182 will be applied in register with the relief. In this example, the relief structure is depicted as extending across the area 185 and some of its adjacent surroundings as may be desirable in order to reduce the registration requirements between the relief and the reflection enhancing material. However, the relief structure need only be provided in the areas 185 in which it is ultimately to be exhibited if highly accurate registration can be achieved. It will be appreciated that this applies to all embodiments and is not tied to the use of a selectively applied reflection enhancing material.

In the FIG. 23(*c*) structure, the iridescent amplitude interference layer 183 is also provided only locally in the areas 181 in which it is to be rendered visible by the light-absorbing material 182, rather than across the whole region. This can be achieved for example by applying the layer 183 through a selective process such as printing rather than by laminating a foil. In this case the lamination adhesive can be omitted but preferably the element is provided with a protective coating 189*a*'. The iridescent amplitude interference layer 183 will in this example be applied in register with the light absorbing material 182 and therefore is preferably applied in the same in line process as that in which the reflection enhancing material 187 and the light absorbing material is applied. To reduce the registration requirements, the layer 183 may extend outside the areas 181 to a degree (not shown). Again, this selective application of the iridescent amplitude interference layer 183 can be applied to all embodiments and is not tied to the use of a selectively applied reflection enhancing material.

FIG. 24 shows another exemplary security document 1" which again takes the form of a polymer banknote as in FIG. 23. A security element 190 in the form of a patch is applied in a window region defined by surrounding print 2" which region may be transparent depending on the underlying substrate 199, such as BOPP. Again, the element could instead be formed on top of the print layer 2".

The security element 190 has substantially the same half-tone or screened appearance as described previously with respect to FIG. 14. Thus, four parts of a half tone pattern are formed across two triangular areas 191 and 195, with part $R_1$ exhibiting 100% pattern density (i.e. wholly the iridescent amplitude interference effect), the opposite part $R_4$ exhibiting 0% pattern density (i.e. wholly the diffractive/reflective effect), and intervening parts $R_2$ and $R_4$ exhibiting both optical effects superimposed on one another, to different degrees.

FIG. 24(*a*) depicts a cross section through the document 1' along the line L-L' according to a first option. As in previous embodiments, an embossing lacquer or cast cure resin 198 is applied to the substrate 199 and a relief structure 198*a* is formed therein. In alternative examples the relief could be formed directly in the surface of substrate 199. In either order, a light absorbing material 192 and a reflection enhancing material 197 are selectively applied in register with one another to the relief, e.g. by printing, to form the desired half tone pattern. A layer of iridescent amplitude interference material 193 is applied over the element as before. Thus, in part $R_1$, the light absorbing material is applied continuously over the region resulting in a pattern density of 100%. In part $R_2$, the light absorbing material is applied only to partial areas $P_2$, which as shown in FIG. 24(*a*) define gaps therebetween which correspond to elements 191*a* of the half-tone pattern (here taking the form of dots). In the gaps, or partial areas $P_1$, the reflection enhancing material 197 is applied following the contours of the relief structure. The result is that the diffractive/reflective effect is exhibited by the pattern elements 191*a*, surrounded by a background of the iridescent amplitude interference material, giving rise to the impression that the two optical effects are superimposed on one another.

In the next part $R_3$, the construction is substantially the same as in part $R_2$, with the relative arrangement of the light absorbing and reflection enhancing materials being reversed such that here the pattern elements 191*a* exhibit the iridescent amplitude interference effect and the background exhibits the diffractive/reflective effect. In part $R_4$, the reflection enhancing material is applied continuously such that the pattern density of the half tone pattern is effectively 0%. An optional lamination adhesive 199*a* is applied over the light absorbing and reflection enhancing materials for joining of the layer 193 containing iridescent amplitude interference material as before. Finally a protective layer 199*b* may be applied.

An alternative construction which will also achieve substantially the same appearance is shown in FIG. 24(*c*). Here, the structure is the same as in FIG. 24(*b*) except for those aspects now identified. Firstly, the relief structure 198*a* does not extend across the whole of the element but is only provided in the those parts $R_2$, $R_3$ and $R_4$ in which the diffractive or reflective effect is to be rendered visible. The reflection enhancing material 197 and hence also the light-absorbing material 192 will be applied in register with the relief. In this example, the relief structure is depicted as extending across the whole of each part parts $R_2$, $R_3$ and $R_4$ as may be desirable in order to reduce the registration requirements between the relief and the reflection enhancing material. However, in parts $R_2$ and $R_3$, the relief structure need only be provided in the partial areas $P_1$ in which it is ultimately to be exhibited if highly accurate registration can be achieved.

In the FIG. 24(*c*) structure, the iridescent amplitude interference layer 193 is also provided only locally in the areas in which it is to be rendered visible by the light-absorbing material 192, rather than across the whole region, e.g. by printing. In this case the lamination adhesive can be omitted but preferably the element is provided with a protective coating 189*a*'. The iridescent amplitude interference layer 193 will in this example be applied in register with the light absorbing material 192 and therefore is preferably applied in the same in line process as that in which the reflection enhancing material 197 and the light absorbing material is applied. To reduce the registration requirements, the layer 193 may extend outside the areas to which the light absorbing material is applied, e.g. across the whole of parts $R_2$ and $R_3$ of the element if desired.

In FIGS. 23 and 24 it will be noted that the light absorbing material is depicted has having a much greater thickness than the reflection enhancing material. This is primarily for clarity and is not essential in practice. What is required is that the reflection enhancing material follows the contours of the relief and thus replicates the relief structure in its surface. This is not a requirement of the light absorbing layer, the thickness of which is therefore not constrained.

Whilst in the FIGS. 23 and 24 embodiments, the security elements have been depicted as being formed directly on the polymer substrate of a security document it will be appreciated that this is not essential and element structures of this sort could equally be used in the case of security elements formed as threads, strips, patches or other articles which are then incorporated into or applied to security documents or other articles as described with respect to FIG. 1.

In all embodiments, the light absorbing material (preferably a resist) will be sufficiently absorbent of visible light (i.e. wavelengths between 380 and 750 nm) such that the majority of light reflected back to the viewer from the area is from the iridescent amplitude interference material in order that its optical effect is distinct. Preferably, the visible light reflected back by the material should also be less than the proportion of light reflected or diffracted back to the viewer by the areas of the diffractive/reflective device. Hence in preferred implementations, the light absorbing material absorbs at least 70% of incident visible light, preferably at least 80%, more preferably at least 90%. Visible light is defined here as meaning all light with wavelengths between 380 nm and 750 nm, inclusive.

Advantageously the light absorbing material is additionally non-transparent so as to mask any underlying reflective material, as may be present depending on the construction of the element, and so preferably transmits less than 30% of incident visible light in a single pass, more preferably less than 20%, still preferably less than 10%, most preferably is substantially opaque. Desirably, the light absorbing material is dark in colour, preferably black, although alternatives such as dark blue or dark green are also envisaged.

For example, the light absorbing material may include a dark dye or pigment such as BASF Neozapon X51 or carbon black, with a preferred dye loading of up to 50% by weight. If the light absorbing material is also to be used as a resist during etching, the dye or pigment should be carried in a material with both good adhesion to metal and caustic resistance. An example of a class of suitable resist materials is vinyl chlorides/vinyl acetate copolymers such as Union Carbide Ucar resins, Sun VHL 31534, or Wacker Vinnol E 15/45 m.

The light absorbing material may also comprise a magnetic or electrically conductive substance, which may or may not be the same pigment as that which gives the material its colour and/or light absorbing properties. The light absorbing material could additionally include a fluorescent or other detectable substance if desired. The light absorbing material could also be laid down as in multiple portions, each having the same visual appearance under standard illumination but possessing different (or no) detectable substances. This could be used to create a hidden magnetic coding within the light absorbing material, for example.

The iridescent amplitude interference material provided in each embodiment could comprise for example liquid crystal materials in the form of continuous films or pigmented coatings, interference pigments such as Irodine™, photonic crystals, or a thin-film interference structure. Since the layer carrying the iridescent amplitude interference material may be provided across the full extent of the device in some embodiments, it should be non-opaque such that the underlying relief structure is not wholly concealed. Therefore, where interference pigments or thin-film structures are used it is preferred that these are all-dielectric interference stacks as opposed to metal-dielectric structures. However it is also possible to use semi-transparent metal-dielectric structures as is known from EP1478520 for example.

In all embodiments, the reflection enhancing layer could be formed in various ways including deposition of a layer of material having a different refractive index from that in which the relief structure is formed (so-called "high refractive index" or "HRI" materials, e.g. ZnS), or printing or a layer comprising metallic particles or similar, such as a metallic ink. However, most preferably the reflection enhancing layer comprises a metal layer (e.g. aluminium, copper, chrome or any alloy thereof), laid down for example by vacuum deposition. This produces a particularly bright replay effect.

In addition metallic materials such as these are typically electrically conductive and this property can also be detected and therefore act as an additional security feature. In particularly preferred examples, at least one continuous conductive path is formed of the reflection enhancing material from one end to the other of the security element, which can be detected (e.g. by a capacitive probe) and hence acts as an additional authentication feature. The presence of the conductive path can be concealed by the overlying light absorbing relief, which preferably appears to interrupt the conductive path at at least one location. As such, visual inspection of the security element does not reveal the conductive feature which will thus more likely be absent in a counterfeit version of the element. FIG. 15 showed an example of a security element in which such a hidden conductive path is intrinsically incorporated, since aside from the negative indicia regions 107, 108, the underlying reflection enhancing layer is continuous along the full length of the element 100. The presence of the conductive material (e.g. metal) will be apparent in regions 105 and 103, but region 101 will appear non-metallic and hence the conductive path appears interrupted. Any of the other embodiments could also be modified to include a continuous metallic path which appears interrupted by the iridescent amplitude interference effect.

In the described embodiments, the security elements are self-supporting as is suitable for example where the element is a thread configured for incorporation into a substrate during a paper-making process. However, in other cases the element could be formed for example on a transfer foil which includes a carrier or support layer to provide structural support, in which case the substrate layer on which the relief is carried need not be self-supporting. A release layer may be provided between the carrier and the multi-layered element structure so that the element can be transferred from the foil to the surface of a document or other article, e.g. by hot stamping.

In yet further implementations, the security element could be formed integrally with a security document or other article. For example, where the article is a security document having a polymer substrate, such as a polymer (or paper/polymer hybrid) banknote, the security element could be formed directly on the document substrate, with the relief structure being formed either directly in the surface of the document substrate or in a lacquer or resin layer applied thereto (e.g. by cast curing). The subsequent manufacturing steps will be the same as described with respect to any of the embodiments described above.

In alternative implementations the security element may be subsequently incorporated into a paper or polymer base substrate so that it is viewable from both sides of the finished security substrate. Methods of incorporating security elements in such a manner are described in EP-A-1141480 and WO-A-03054297. In the method described in EP-A-1141480, one side of the security element is wholly exposed at one surface of the substrate in which it is partially embedded, and partially exposed in windows at the other surface of the substrate.

Base substrates suitable for making security substrates for security documents may be formed from any conventional materials, including paper and polymer. Techniques are known in the art for forming substantially transparent regions in each of these types of substrate. For example, WO-A-8300659 describes a polymer banknote formed from a transparent substrate comprising an opacifying coating on both sides of the substrate. The opacifying coating is omitted in localised regions on both sides of the substrate to form a transparent region. In this case the transparent substrate can be an integral part of the security device or a separate security device can be applied to the transparent substrate of the document. WO-A-0039391 describes a method of making a transparent region in a paper substrate. Other methods for forming transparent regions in paper substrates are described in EP-A-723501, EP-A-724519, WO-A-03054297 and EP-A-1398174.

The security device may also be applied to one side of a paper substrate so that portions are located in an aperture formed in the paper substrate. An example of a method of producing such an aperture can be found in WO-A-03054297. An alternative method of incorporating a security element which is visible in apertures in one side of a paper substrate and wholly exposed on the other side of the paper substrate can be found in WO-A-2000/39391.

In all embodiments incorporating a diffractive relief structure, this can be originated using any known technique such as classical two-step rainbow holography, dot-matrix interferometry, lithographic interferometry and e-beam lithography. Once originated the relief structures can be replicated onto a substrate by using thermal embossing or a casting process. For thermal embossing a thermoformable layer typically 1 to 2 microns thick is embossed with the relief structure. An alternative approach would be to use a UV curable monomer composition rather than a thermal embossing lacquer. The diffractive relief structure could then be cast into the UV curable monomer and cured. Such techniques are described in more detail in U.S. Pat. No. 4,758,296. It has been found that a combination of e-beam origination and cast-cure replication is the preferred method for generating the relief structures according to the first aspect of the invention.

The invention claimed is:

1. A security element comprising a substrate on which is disposed:

in a first area, a first optically variable device comprising a diffractive or reflective relief structure and a reflection enhancing material following contours of the relief structure; and in a second area, a second optically variable device comprising an iridescent amplitude interference material;

wherein the first optically variable device is constituted by a plurality of sub-areas arranged in a cyclically repeating sequence along a predetermined direction of the security element, the plurality of sub-areas collectively forming the first area, relief parameters of the diffractive or reflective relief structure varying from one sub-area to the next within each repeat cycle, wherein each repeat cycle of the relief parameters includes at least three sub-areas, and whereby, at any one viewing angle, each sub-area within any one repeat cycle exhibits a different diffractive colour or reflected intensity from those of the other sub-areas within the same repeat cycle, and such that, when the device is tilted in a direction parallel to the predetermined direction, different diffractive colours or reflected intensities appear to move from one sub-area to the next within each repeat cycle along the predetermined direction.

2. A security element according to claim 1, wherein the first and/or second area comprising the first or second optically variable device respectively is elongate and extends along the predetermined direction of the security element.

3. A security element according to claim 1, wherein the security element is elongate in the predetermined direction.

4. A security element according to claim 1, wherein the first optically variable device comprises one of:

a diffractive relief structure, the relief structure having a pitch which varies from one sub-area to the next, the pitch within each sub-area lying in the range 0.5 microns to 10 microns; or a reflective relief structure, the relief structure comprising an array of reflective facets, the angle between the facets and the plane of the device varying from one sub-area to the next.

5. A security element according to claim 1, wherein the first optically variable device is configured such that, when the device is tilted in the direction perpendicular to the predetermined direction, the different diffractive colours or reflected intensities appear to move from one sub-area to the next within each repeat cycle along the predetermined direction.

6. A security element according to claim 5, wherein the first optically variable device comprises one of:

a diffractive relief structure, the orientation of the relief structure in the plane of the device varying from one sub-area to the next; or a reflective relief structure, the relief structure comprising an array of reflective facets, the orientation of the facets in the plane of the device varying from one sub-area to the next.

7. A security element according to claim 1, wherein each sub-area has the form of a line, band, geometrical shape, symbol or alphanumeric character.

8. A security element according to claim 1, wherein a plurality of adjoining sub-areas collectively form a geometrical shape, symbol or alphanumeric character.

9. A security element according to claim 1, wherein at least some of the sub-areas abut one another along the predetermined direction, the boundary between one sub-area and the next lying substantially perpendicular to the predetermined direction.

10. A security element according to claim 1, wherein the sub-areas are each of substantially the same size and shape.

11. A security element according to claim 1, wherein the size and/or shape of the sub-areas varies cyclically along the predetermined direction.

12. A security element according to claim 1, wherein the diffractive or reflective relief structure is disposed in both the first and second areas of the element, and is substantially concealed in the second area of the element by an overlying light absorbing material.

13. A security element according to claim 1, wherein the iridescent amplitude interference material is disposed in both the first and second areas of the element, and is substantially concealed in the first area of the element by light diffracted or reflected from the diffractive or reflective relief structure.

14. A security element according to claim 1 further comprising one or more substantially transparent regions in which the reflection enhancing material and light absorbant material are absent, the substantially transparent regions defining a decorative pattern or negative indicia.

15. A security element according to claim 1 wherein the iridescent amplitude interference material comprises any of: a thin film interference structure, interference pigments, iridescent pigments, pearlescent pigment, mica pigments, liquid crystal (LC) pigments and photonic crystals.

16. A security element according to claim 1 wherein the reflection enhancing material is arranged in accordance with a screened or half-tone pattern, or is semi-transparent.

17. A security element according to claim 1, wherein the reflection enhancing material is electrically conductive and includes at least one continuous path from one end to the other of the security element, at least a portion of the continuous path being concealed by the iridescent amplitude interference material.

18. A security element according to claim 1, further comprising a layer of magnetic material, the magnetic material being concealed by the reflection enhancing layer and/or the iridescent amplitude interference material.

19. A security article, comprising a security element according to claim 1.

20. A security document comprising a security element according to claim 1 applied to or incorporated in the security document, wherein the security document is preferably a banknote, polymer banknote, passport, identification document, passport, visa, cheque or certificate.

21. A security element comprising a substrate on which is disposed, in at least a region of the security element:

a diffractive or reflective relief structure present at least in first partial areas of the region in accordance with a first pattern;

a reflection enhancing material provided in the first partial areas of the region in accordance with the first pattern, disposed on and following contours of the diffractive or reflective relief structure;

a light absorbing material provided in second partial areas of the region in accordance with a second pattern;

one or both of the first and second patterns comprising a plurality of discrete pattern elements; and a non-opaque layer of iridescent amplitude interference material at least over the second partial areas of the light absorbing material;

wherein the first and second patterns are in register with one another and each switches repeatedly from one side to the other of a straight line defining an axis of the security element along the same portion of the line in an alternating manner with the other pattern, whereby in the areas of the reflection enhancing layer defined by the first pattern, visual effect of the diffractive or reflective relief structure is visible, and in the areas of the light absorbing material defined by the second pattern, visual effect of the non-opaque iridescent amplitude interference material is visible, such that the two visual effects are exhibited on opposite sides of the straight line at any one location and alternate with one another along the axis of the security element, and wherein the first and second partial areas of the region share at least one structural feature in common in the form of the diffractive or reflective relief structure being additionally provided in the second partial areas of the region defined by the second pattern and the light absorbing material being additionally disposed on the diffractive or reflective relief structure.

22. A method of manufacturing a security element, comprising:

forming a diffractive or reflective relief structure at least in first partial areas of a region of the security element in accordance with a first pattern;

applying a reflection enhancing material in the partial areas of the region in accordance with the first pattern, onto and following contours of the diffractive or reflective relief structure;

applying a light absorbing material in second partial areas of the region in accordance with a second pattern;

one or both of the first and second patterns comprising a plurality of discrete pattern elements; and applying a non-opaque layer of iridescent amplitude interference material at least over the second partial areas of the light absorbing material;

wherein the first and second patterns are in register with one another and each switches repeatedly from one side to the other of a straight line defining an axis of the security element along the same portion of the line in an alternating manner with the other pattern, whereby in the areas of the reflection enhancing layer defined by the first pattern, visual effect of the diffractive or reflective relief structure is visible, and in the areas of the light absorbing material defined by the second pattern, visual effect of the non-opaque iridescent amplitude interference material is visible, such that the two visual effects are exhibited on opposite sides of the straight line at any one location and alternate with one another along the axis of the security element, and wherein the first and second partial areas of the region share at least one structural feature in common in the form of the diffractive or reflective relief structure being additionally formed in the second partial areas of the region defined by the second pattern and the light absorbing material being additionally applied on the diffractive or reflective relief structure.

* * * * *